US007472962B2

(12) United States Patent
Caruso et al.

(10) Patent No.: US 7,472,962 B2
(45) Date of Patent: Jan. 6, 2009

(54) SEATING STRUCTURE HAVING FLEXIBLE SUPPORT SURFACE

(75) Inventors: Jerome Carmel Caruso, Lake Forest, IL (US); Steven Jerome Caruso, Antioch, IL (US); John Fredric Aldrich, Grandville, MI (US); Andrew Keith Hector, Grandville, MI (US); Thomas William Granzow, Plainwell, MI (US); Dean Thomas Miller, Wyoming, MI (US); Richard Thomas Peek, Caledonia, MI (US); Benjamin Booth Edinger, Grand Haven, MI (US); Chad D. Aerts, Grand Haven, MI (US)

(73) Assignee: Herman Miller Inc., Zeeland, MI (US)

( * ) Notice: Subject to any disclaimer, the term of this patent is extended or adjusted under 35 U.S.C. 154(b) by 636 days.

(21) Appl. No.: 11/103,371

(22) Filed: Apr. 11, 2005

(65) Prior Publication Data

US 2006/0103222 A1 May 18, 2006

Related U.S. Application Data

(63) Continuation-in-part of application No. 10/809,279, filed on Mar. 25, 2004, which is a continuation-in-part of application No. 09/897,153, filed on Jun. 29, 2001, now Pat. No. 6,726,285, application No. 11/103,371, which is a continuation-in-part of application No. PCT/US02/00024, filed on Jan. 3, 2002.

(60) Provisional application No. 60/215,257, filed on Jul. 3, 2000.

(51) Int. Cl.
*A47C 7/42* (2006.01)

(52) U.S. Cl. ..... 297/452.46; 297/452.32; 297/452.35; 297/452.31

(58) Field of Classification Search ..... 297/452.21, 297/452.23, 452.24, 452.32, 452.37, 452.42, 297/452.43, 452.46, 452.52; 428/98, 131, 428/174, 172; 5/653, 652.1
See application file for complete search history.

(56) References Cited

U.S. PATENT DOCUMENTS 54,314 A 5/1866 Farmer
567,639 A 9/1896 Crouch (Continued)

FOREIGN PATENT DOCUMENTS

EP 0 021 191 A2 6/1980

(Continued)

OTHER PUBLICATIONS

Digital images of "Ypsilon" chair, date unknown.

(Continued)

*Primary Examiner*—Sarah B McPartlin
(74) *Attorney, Agent, or Firm*—Brinks Hofer Gilson & Lione

(57) ABSTRACT

A seating structure includes a plurality of boss structures arranged in a pattern and a plurality of web structures joining adjacent boss structures within the pattern. At least some of the web structures are spaced apart such that they define openings therebetween. Adjacent rows of said web structures are spaced or staggered.

30 Claims, 32 Drawing Sheets

U.S. PATENT DOCUMENTS 662,647 A 11/1900 Howe
1,005,330 A 10/1911 Schmits et al.
1,769,294 A 7/1930 Johnson et al.
2,126,439 A 8/1938 Zerbee
2,260,352 A 10/1941 Trapani
2,667,654 A 2/1954 Peterson et al.
2,878,860 A 3/1959 Brattrud
3,041,109 A 6/1962 Eames et al.
3,059,919 A 10/1962 Marchino
3,080,579 A 3/1963 Gordon
3,107,944 A 10/1963 Baermann
3,117,819 A 1/1964 Kudriavetz, Jr.
3,120,407 A 2/1964 Propst
3,140,086 A 7/1964 Lawson
3,162,487 A 12/1964 Trotman
3,198,578 A 8/1965 Geoffrey et al.
3,217,786 A 11/1965 Earl
RE25,943 E 12/1965 Lawson
3,233,885 A 2/1966 Propst
3,514,156 A 5/1970 Fields
3,565,482 A 2/1971 Blodee
3,681,797 A 8/1972 Messner
3,720,568 A 3/1973 Rowland
3,767,261 A 10/1973 Rowland
3,840,269 A 10/1974 Ambrose
3,877,750 A 4/1975 Scholpp
4,143,916 A * 3/1979 Trotman et al. ..... 297/452.45
4,318,556 A 3/1982 Rowland
4,367,897 A 1/1983 Cousins
4,368,917 A 1/1983 Urai
4,377,016 A 3/1983 Niermeijer
4,390,210 A 6/1983 Wisniewski et al.
4,399,574 A 8/1983 Shuman
4,533,174 A 8/1985 Fleishman
4,582,361 A 4/1986 Kennel
4,585,272 A 4/1986 Ballarini
4,660,887 A 4/1987 Fleming et al.
4,713,854 A 12/1987 Graebe
4,761,035 A 8/1988 Urai
4,789,201 A 12/1988 Selbert
D301,088 S * 5/1989 Kawaguchi ..... D5/58
4,826,249 A 5/1989 Bradbury
4,828,320 A 5/1989 Saiger
4,834,458 A 5/1989 Izumida et al.
4,856,846 A 8/1989 Lohmeyer
4,889,387 A 12/1989 Gregory
4,913,493 A 4/1990 Heidmann
4,980,936 A 1/1991 Frickland
4,993,164 A 2/1991 Jacobsen
5,013,089 A 5/1991 Abu-Isa et al.
5,025,519 A 6/1991 Spann
5,067,196 A 11/1991 Chen
5,067,772 A 11/1991 Koa
5,094,580 A 3/1992 Abe
5,154,485 A 10/1992 Fleishman
5,249,839 A 10/1993 Falks et al.
D346,279 S 4/1994 Stumpf et al.
5,318,348 A 6/1994 Hess
5,320,410 A 6/1994 Faiks et al.
5,399,406 A * 3/1995 Matsuo et al. ..... 428/57
5,439,271 A 8/1995 Ryan
5,441,331 A 8/1995 Vento
5,445,436 A 8/1995 Kemnitz
5,459,896 A 10/1995 Raburn et al.
D368,399 S 4/1996 Buffon
5,529,373 A 6/1996 Olson et al.
5,551,673 A 9/1996 Furusawa et al.
D377,431 S 1/1997 Stumpf et al.
5,662,383 A 9/1997 Hand
5,679,439 A 10/1997 Schmidt et al.
5,747,140 A 5/1998 Heerklotz
5,762,403 A 6/1998 Robinson
5,934,758 A 8/1999 Ritch et al.
6,029,962 A 2/2000 Shorten et al.
6,035,901 A 3/2000 Stumpf et al.
6,059,368 A 5/2000 Stumpf et al.
6,106,063 A 8/2000 Dauphin
6,170,808 B1 1/2001 Kutschi
6,193,318 B1 2/2001 Becker et al.
6,254,190 B1 7/2001 Gregory
6,420,015 B1 7/2002 Nord et al.
6,439,665 B1 8/2002 Cvek
6,451,400 B1 9/2002 Brock et al.
6,523,898 B1 2/2003 Ball et al.
D471,024 S 3/2003 Chadwick et al.
D471,042 S 3/2003 Schmitz et al.
D471,370 S 3/2003 Schmitz et al.
6,546,578 B1 4/2003 Steinmeier
6,550,866 B1 4/2003 Su
D474,346 S 5/2003 Saylor et al.
D475,859 S 6/2003 Kryger
6,588,842 B2 7/2003 Stumpf et al.
6,623,079 B2 9/2003 Gregory
D485,097 S 1/2004 Raftery
D486,027 S 2/2004 Baxter et al.
D487,359 S 3/2004 Giugiaro
6,726,285 B2 4/2004 Caruso et al.
6,726,286 B2 4/2004 Stumpf et al.
D489,191 S 5/2004 Ma
D489,541 S 5/2004 Su
D489,542 S 5/2004 Giugiaro
6,729,691 B2 5/2004 Koepke et al.
D490,994 S 6/2004 Schmitz et al.
6,869,140 B2 3/2005 White et al.
6,901,617 B2 6/2005 Sprouse et al.
6,954,315 B2 10/2005 Tracy
2002/0096931 A1 7/2002 White et al.
2005/0001461 A1 1/2005 Caruso
2005/0001464 A1 1/2005 Caruso et al.
2005/0116526 A1 6/2005 Vanderiet et al.

FOREIGN PATENT DOCUMENTS

EP 0 021 191 B1 6/1980
GB 2088206 6/1982
GB 2225229 A 5/1990
WO WO 00/22961 4/2000
WO WO 0115572 3/2001

OTHER PUBLICATIONS

Vitra "Ypsilon" brochure, date unknown.
International Search Report, International Application PCT/US02/00024, May 29, 2002.
"IDEA" advertisement, Intes USA, High Point, NC, single page, date unknown.
"NEW! Bungie Hi-Back Chair" advertisement, source and data unknown.
"Aeron Chair," *Herman Miller*, 1995, 4 pages.
International Preliminary Examination Report from PCT/US2002/00024, Apr. 12, 2005, 4 pages.
Pearlman, C., "Made to Measure" *I.D.*, Sep.-Oct. 1994, 8 pages.
Zurowski, T., "Designers Rate . . . Herman Miller's Aeron Chair", *Interiors*, Jul. 1995, 1 page.

* cited by examiner

SEATING STRUCTURE HAVING FLEXIBLE SUPPORT SURFACE

This application is a continuation-in-part of U.S. patent application Ser. No. 10/809,279, filed Mar. 25, 2004, which is a continuation-in-part of U.S. patent application Ser. No. 09/897,153, filed Jun. 29, 2001, now U.S. Pat. No. 6,726,285 which claims the benefit of U.S. Provisional Application No. 60/215,257, filed Jul. 3, 2000, the entire disclosures of which are hereby incorporated herein by reference. This application also is a continuation-in-part of PCT Application PCT/US02/00024, filed Jan. 3, 2002, the entire disclosure of which is hereby incorporated herein by reference.

FIELD OF INVENTION

The present invention relates to chairs and seating normally associated with but not limited to residential or commercial office work. These chairs employ a number of structures and methods that enhance the user's comfort and promote ergonomically healthy sitting. These methods include various forms of padding and/or flexing of the seat and back as well as separate mechanical controls that control the overall movement of the seat and back.

BACKGROUND

Various approaches to making a chair seat and/or back form fitting for various users are known in the industries of seating manufacture. These approaches range from the rather traditional use of contouring synthetic foam, to seat/back shells that have a degree of flex. There have also been approaches that use a frame that has a membrane or sling stretched or supported across or within a frame. Problems can arise from each of these approaches.

For example, under normal manufacturing conditions, it can be difficult to vary the amount of firmness and corresponding support in different areas of a foam padded cushion. Additionally, foam can lead to excessive heat-build-up between the seating surface and the occupant. One of the problems with foam is the forming and molding process. Current manufacturing technology makes it a relatively inefficient process compared with the manufacture of the other components that make up a chair or seating surface. Often, the forming/molding of a contoured seating surface can be slow, thereby requiring the manufacturer to make several molds (typically hand filled) in order to maintain an efficient level of production.

Another problem inherent to the use of foam is that in order to achieve a finished look, the cushions typically must be covered, e.g. upholstered. When a manufacturer upholsters a cushion, a number of issues may arise. For example, the formed or molded foam may have curves, many of which can be compound-curves, which leads a manufacturer to use glue or other adhesives to make the fabric conform to the contours. This laminating technique often makes the foams surface firmer than it was when it was originally molded/formed because the glue/adhesive and the fabric are now part of the foam structure. Additionally, the amount of change in firmness can vary from fabric to fabric which results in an unpredictability of the firmness of a cushion from one manufactured unit to the next.

Alternatively, if a slipcover is used, it must be sized properly. Such sizing can be difficult as a result of the differing mechanical properties found from one fabric to another. The most important properties of a fabric when upholstering a contoured surface are its thickness and its rate of stretch. Thickness variations can make one fabric upholster smooth around radii or contours, while a thicker one will wrinkle in the same area. Variations in the amount of stretch can lead to other problems. Therefore, a proper size slipcover in one type of fabric, with its stretch characteristics, may be the wrong size in another type or style of fabric. Often a manufacturer will "wrap" a piece of fabric around a cushion and then staple the fabric to the underside/backside of the cushion. This approach also suffers from the aforementioned problems associated with using variable fabrics. Additionally, the manufacturer must now cover the staples and the area of the cushion not covered by fabric in order to achieve a finished look. This leads to an additional manufacturing step or molding etc. that often also has to be upholstered.

The other reality of cushion upholstery, regardless of the techniques used, is that whether it is done in a small shop or in a production situation, it can be the most labor-intensive aspect of chair/seating construction.

In the case of incorporating flex into the shells of a chair, it can be difficult to achieve the proper amount of flex in the right areas to give correct ergonomic comfort for a wide range of individuals. In the case of a membrane approach, the curves imparted on the membrane by the frame are often simple in nature (non-compound) and thus cannot provide the proper contouring necessary for ergonomic comfort. Also, this approach can lead to "hammocking," where the areas adjacent a pressed area have the tendency of folding inward, squeezing the occupant, and not yielding the proper ergonomic curvatures. An additional problem with membrane chairs is that the tension of the membrane may not be appropriate for all ranges of users.

To solve some of these problems, manufacturers have produced "sized" (i.e. small, medium and large) chairs that effectively narrow the amount of contouring-compromise that the designer must normally exercise. This approach, however, may require the manufacturer to tool three independent products instead of one, and the manufacturers, wholesalers, and retailers having to stock (in this example) three times the quantity of product. Additionally, the purchaser ends up with a chair that at some point in the future may be the wrong size for a different user.

In some seating structures, the frame members, such as a backrest support, may be made from metal to accommodate the large loads applied thereto by the user. Metal, however, can be expensive to purchase as a raw material, as well as to form into a final product. Moreover, the resultant chair is relatively heavy, leading to increased shipping costs and decreased portability. In some cases, various components have been made of plastic or composite materials, e.g., fiberglass. These components, however, can be susceptible to wear and often cannot carry the necessary loads, for example in bearing.

BRIEF SUMMARY

In one aspect, the present invention relates to an improved method of constructing seating structures and surfaces, which provides greater comfort through superior surface adjustment for a variety of users. In one embodiment, the seating surface construction is comprised of a plurality of support sections (bosses/platforms) and of a plurality of web connectors interconnecting the support sections. In one embodiment, the support sections, or bosses/platforms, are more rigid than their corresponding web connectors. A variety of methods are disclosed for making the bosses/platforms with a greater degree of rigidity than the web connectors.

One exemplary method disclosed herein includes making the thickness of the bosses/platforms different than the thickness of the web connectors. Another exemplary method includes providing the bosses/platforms with stiffening geometry that provides a greater degree of rigidity than the web connectors. Such stiffening means can include in one embodiment the addition of one or more returns or ribs. Another exemplary solution is to make the bosses/platforms out of a different material than the web connectors. Yet another solution includes constructing the webs with a geometry that acts as a hinge. Yet another embodiment includes providing a given geometry and material that can exhibit stretch in addition to flexure.

In one embodiment, a seating structure includes a plurality of boss structures arranged in a pattern, wherein each of the boss structures has a body-facing surface. The pattern of boss structures include at least some rows of boss structures extending in a first direction and at least some columns of boss structures extending in a second direction, with the first and second directions being substantially perpendicular. At least some adjacent rows of boss structures are offset in the first direction such that the boss structures in the adjacent rows of boss structures define at least in part different columns of boss structures. A plurality of web structures join at least some adjacent boss structures within the pattern. At least some of the adjacent web structures are spaced apart such that they define openings therebetween.

In one embodiment, the pattern of boss structures includes at least some rows of boss structures extending in a first direction and at least some columns of boss structures extending in a second direction, wherein the first and second directions form a substantially oblique angle.

In one embodiment, a plurality of boss structures are arranged in a pattern, with a plurality of web structures joining at least some adjacent boss structures within the pattern. At least some of the boss structures have at least six web structures connected thereto.

In one embodiment, a seating structure includes a plurality of boss structures arranged in a pattern and a plurality of web structures joining adjacent boss structures within the pattern. At least some of the web structures are non-planar. At least some adjacent web structures are spaced apart such that they define openings therebetween. In various embodiments, the boss structures can be the same size and/or shape, or different sizes and/or shapes.

In another aspect, a seating structure includes a support structure having a first component made of a first material. The first component has opposite side portions defining a cavity therebetween. A plate-like second component made of a second material is disposed in the cavity and is secured to the first component. The second component defines at least one engagement location. The second material is stronger than the first material. A third component engages the second component at the engagement location.

In yet another aspect, a seating structure includes a plurality of boss structures arranged in a pattern and defining a support surface and a plurality of web structures joining adjacent boss structures within the pattern. At least some adjacent web structures are spaced apart and shaped such that they define substantially non-circular openings therebetween when viewed in a direction substantially perpendicular to the support surface. In various exemplary embodiments, the openings are X-shaped and V-shaped.

In various embodiments, the structure provides increased airflow to contact areas of the occupant's body, relative to foam for example. In addition, the seating surface can be made more efficiently and economically relative to foam and other types of seating surfaces. Moreover, the structure can be formed to provide different flexure characteristics in different areas of the seating structure.

The support member with its different materials also provides advantages. In particular, the plate-like structure can be provided in areas requiring high strength, with the remainder of the structure being made from a lighter and/or less expensive material.

Figure 2:
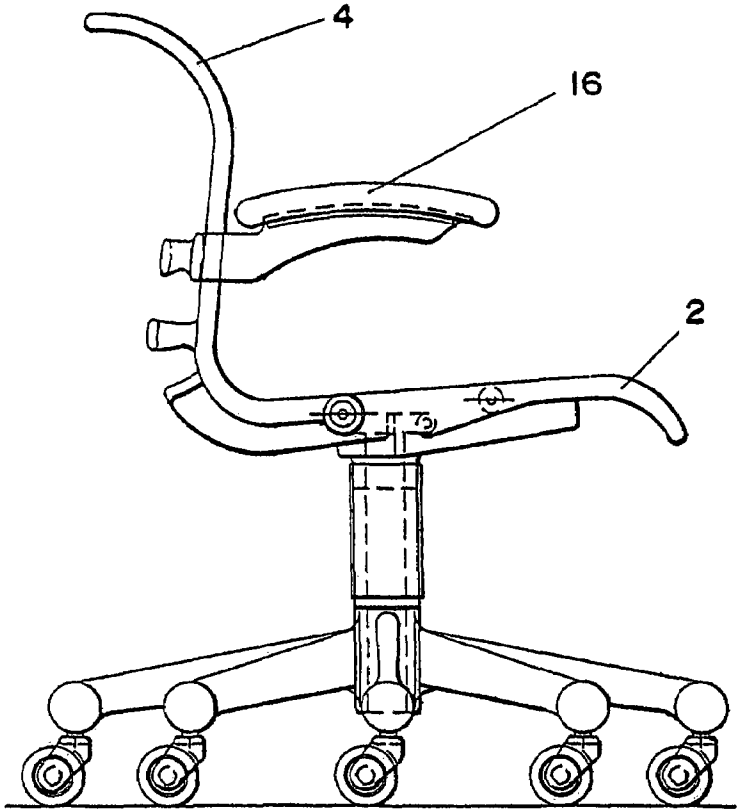
FIG. 2 is a side elevation of the seating structure shown in FIG. 1.
Figure 1:
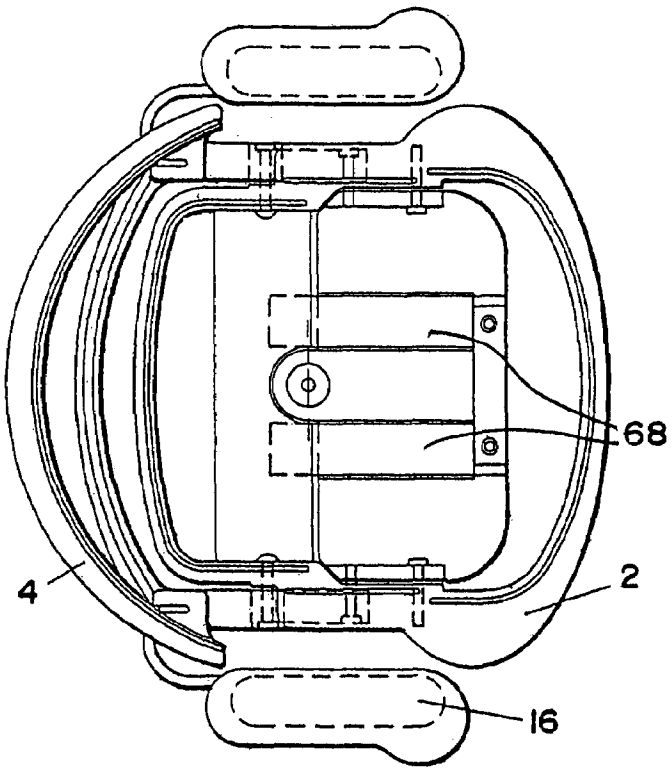
FIG. 1 is top view of a seating structure without a seat support.

DETAILED DESCRIPTION OF THE PRESENTLY PREFERRED EMBODIMENTS:

While the invention will be described in connection with one or more preferred embodiments, it will be understood that we do not intend to limit the invention to those embodiments. On the contrary, we intend to cover all alternatives, modifications and equivalents within the spirit and scope of the invention.

Referring to FIGS. 22-29, 38 and 39, various embodiments of a seating structure, configured as a chair, are shown. It should be understood that the term "seating structure" includes any structure intended to support the body of a user, whether standing, sitting or lying, and includes without limitation chairs, sofas, benches, automotive seats, stools, suspended structures, etc.

The chair 26 includes a back 28 having a pair of support arms 30 pivotally connected to a control housing 40 at a first pivot axis 32 and pivotally connected to opposite sides of a seat 44 at a second pivot axis 34. The seat 44 is pivotally connected to a link 42 at a third pivot axis 36 positioned forwardly of said first and second pivot axes 32, 34. The link 42 is pivotally connected to the control housing 40 at a fourth pivot axis 38 positioned below the third pivot axis 36 and forwardly of the first and second pivot axes 32, 34. The link 42 extends laterally across the housing and includes a pair of lower lugs 46 pivotally secured to opposite sides of the control housing 40 and a pair of upper lugs 48 pivotally secured to opposite sides of the seat 44. The link 42 is preferably made of plastic, such as glass-filled (e.g., 33%) nylon or polypropylene. The control housing 40, back support arms 30, seat 44 and link 42 form a four-bar linkage that provides for synchronous tilting of the seat and back.

An adjustable support column 50 has an upper end connected to the control housing and a lower end connected to a base 52. The base includes a plurality of support arms terminating in casters 54. The casters can be configured as conventional two-wheel casters 56, or as a one-wheeled caster 54, disclosed for example in U.S. patent application Ser. No. 10/613,526, filed Jul. 3, 2003, the entire disclosure of which is hereby incorporated herein by reference.

Figure 26:
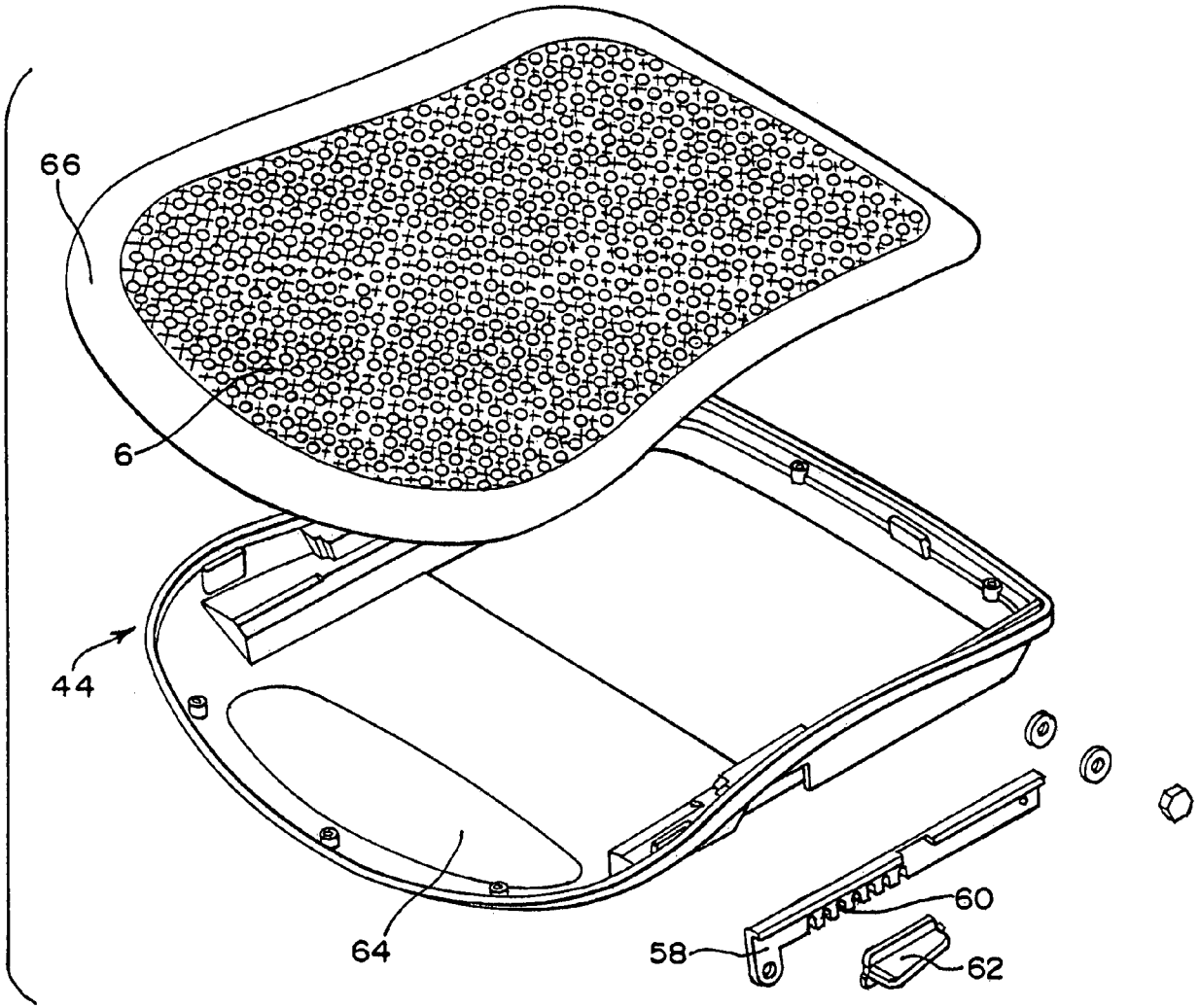
FIG. 26 is an exploded perspective view of a seat support assembly.

Referring to FIG. 26, the seat includes a pair of seat links 58 each having opposite ends pivotally connected respectively to the back support arm 30 and link 42 at the second and third pivot axes 34, 36. The seat link 58 includes a rack 60 formed along a bottom edge thereof. The seat further includes a frame 64 slidably supported on the seat links. For example, the frame can be slidably connected to an upper flange of the seat link, or it can be slidably captured thereon with various fasteners, which can be permanent or removable, for example by a snap-fit or with screws. The frame 64 is preferably made of plastic, such as glass-filled (e.g., 20%) polypropylene. It should be understood that the various glass-filled materials disclosed herein can have various percentages of fill, or can be unfilled. Of course, other plastic materials or metal can also be used. The seat links 58 are preferably made of metal, such as steel. A lever 62 or latch is pivotally secured to the seat frame 64 and is releasable engageable with the rack 60 to secure the seat frame at a desired location relative thereto.

A support member 6, made of various web 18 and boss structures 20, as described below, is secured to the frame 64. In one embodiment, the support member 6 includes a peripheral ring portion 66, or frame, that is secured to the frame 64. In one embodiment, a cushion is disposed on top of the support member and is covered with a fabric. In another embodiment, the support member is directly exposed to the user without any covering disposed thereover. In yet another embodiment, a thin flexible covering, such as a fabric, is disposed over the support member without a cushion. In other embodiments, a membrane can be secured to the frame, as disclosed for example in U.S. patent application Ser. No. 10/738,641, filed Dec. 17, 2003, and U.S. Pat. No. 6,386,634, the entire disclosures of which are hereby incorporated herein by reference.

Figure 24:
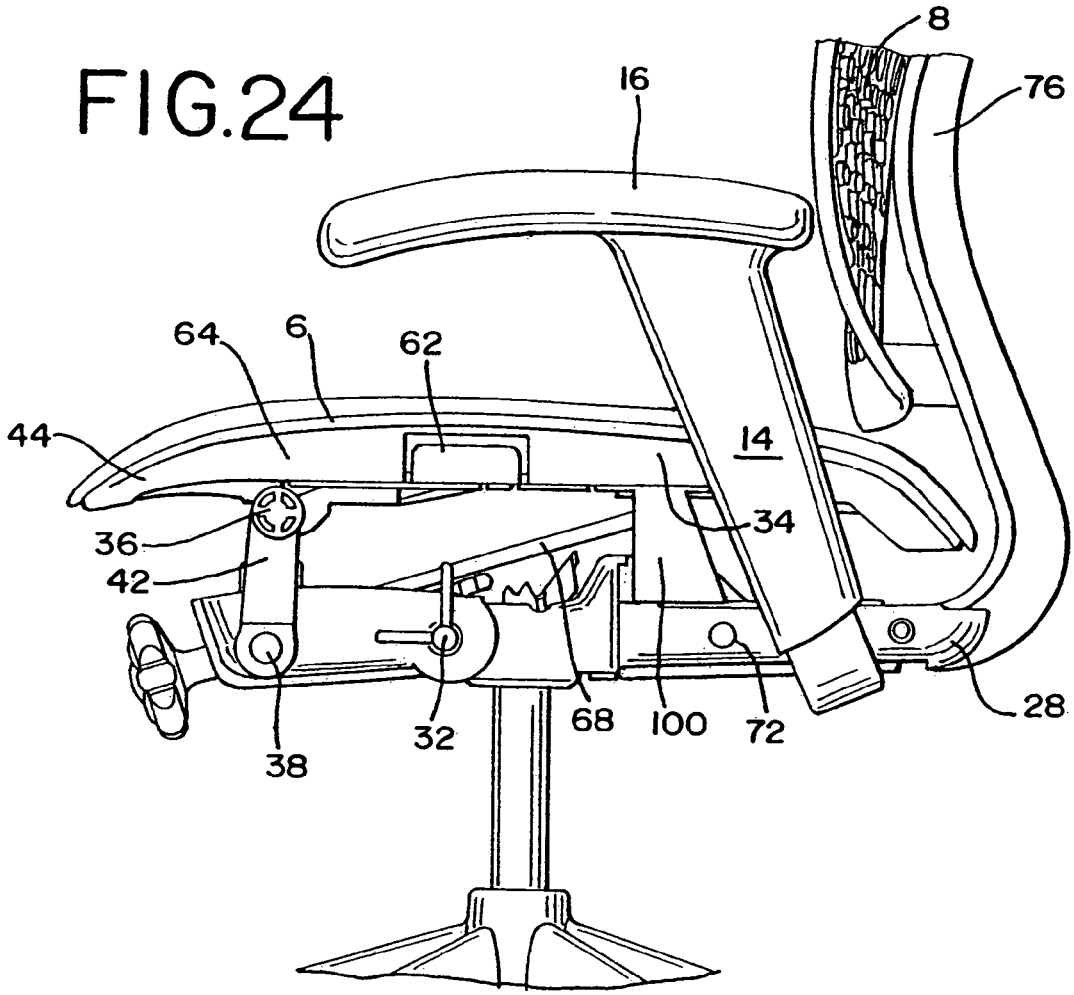
FIG. 24 is a side view of the chair shown in FIG. 22.
Figure 25:
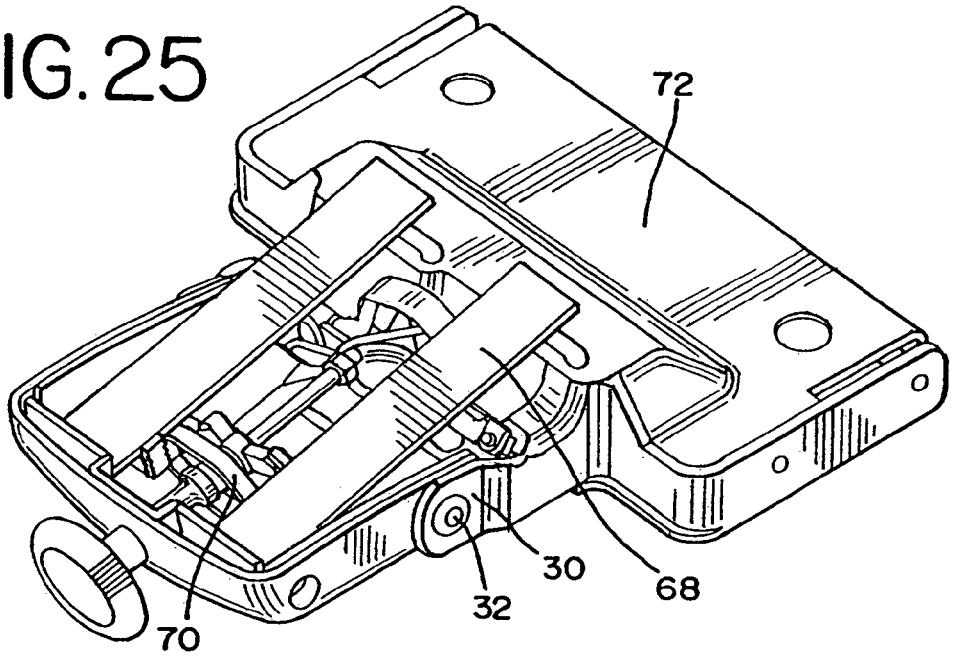
FIG. 25 is a perspective view of a tilt control assembly.

The tilt control assembly, shown in FIGS. 24 and 25, includes a pair of leaf springs 68 (shown in an unloaded position) that bias the seat and back to an upright position. A moveable fulcrum member 70 can be translated to adjust the amount of biasing force exerted by the springs 68.

In one embodiment, shown in FIGS. 22-25, the back 28 includes a support bracket 72 defining the support arms 30. The rear end of the springs 68 engage a bottom surface, which can be downwardly raised, of the support bracket. The rear ends of the spring slidably engage the bottom surface of the support bracket as the support bracket is rotated relative to the housing. A back frame 74 includes a pair of opposite uprights 76 each having a forwardly extending portion 80, secured to one side of the support bracket 72, and an upwardly extending section 80. A cross-member 78 is secured to and extends between the upper ends of the upwardly extending portions. In other embodiments, the cross member is omitted.

The back is attached to the back frame in at least two locations. In one embodiment, a first portion, shown as a top of the back, is pivotally secured to the frame, and in particular to the uprights or cross-member 78, at a first location defined by pivot joints, which define a horizontal axis. A second portion, shown as a bottom of the back, is slidably secured to the frame 74 with a slide element at a second location. It should be noted that the locations of the pivot joint and slide element are interchangeable, in other words, the slide can positioned at the top of the back and the pivot at the bottom.

The top pivot joint can be formed with a pivot pin. Alternatively, the pivot joint can assume other forms, which are not hard pivot points, but serve a similar function. For example and without limitation, the pivot joint could be formed by a rubber mount or a plastic hinge, which can flex and yield in a virtual pivoting motion. In other embodiments, the top of the back is fixed relative to the back frame, meaning it does not rotate or pivot relative thereto.

Figure 38:
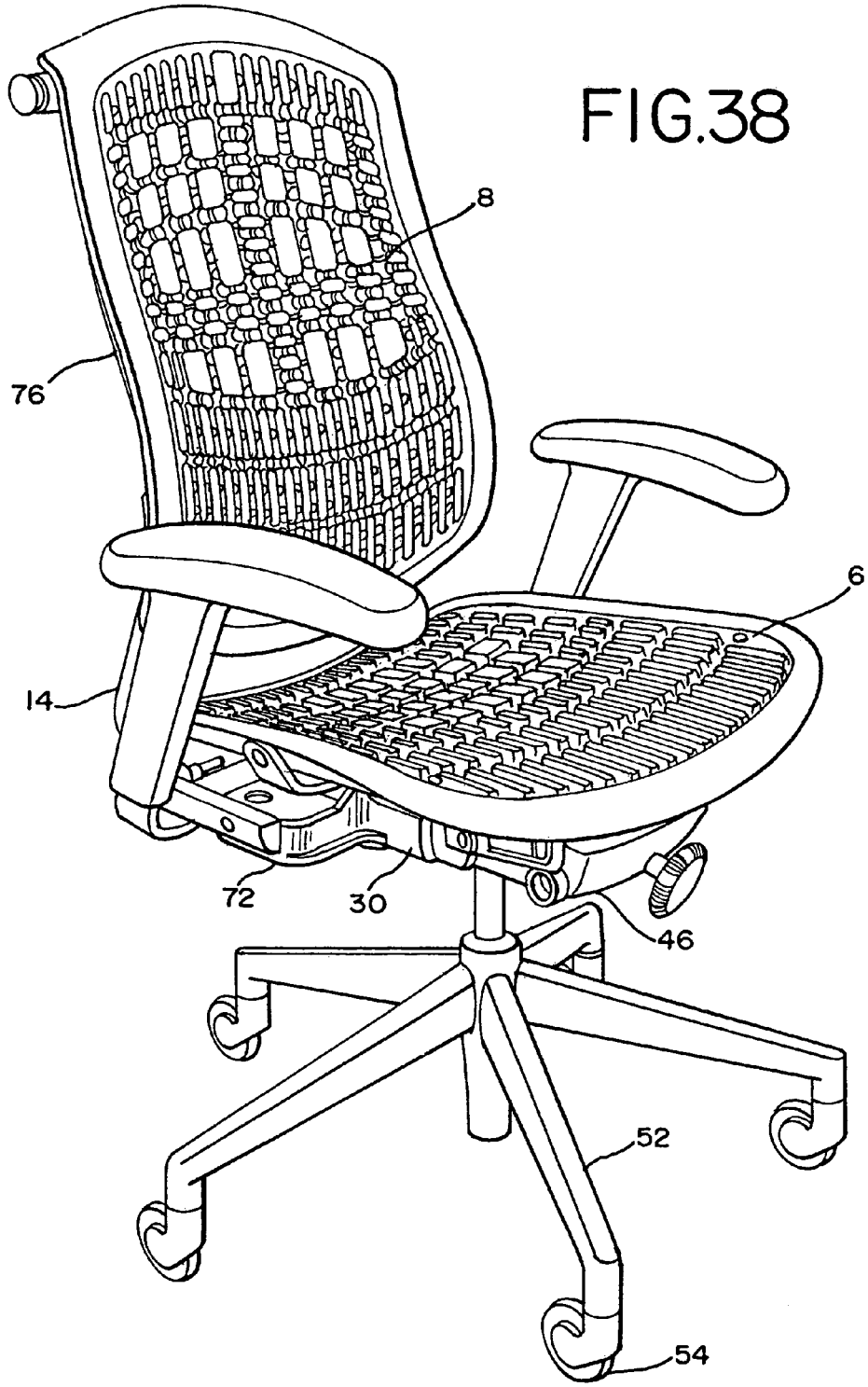
FIG. 38 is a front perspective view of one embodiment of a chair.
Figure 39:
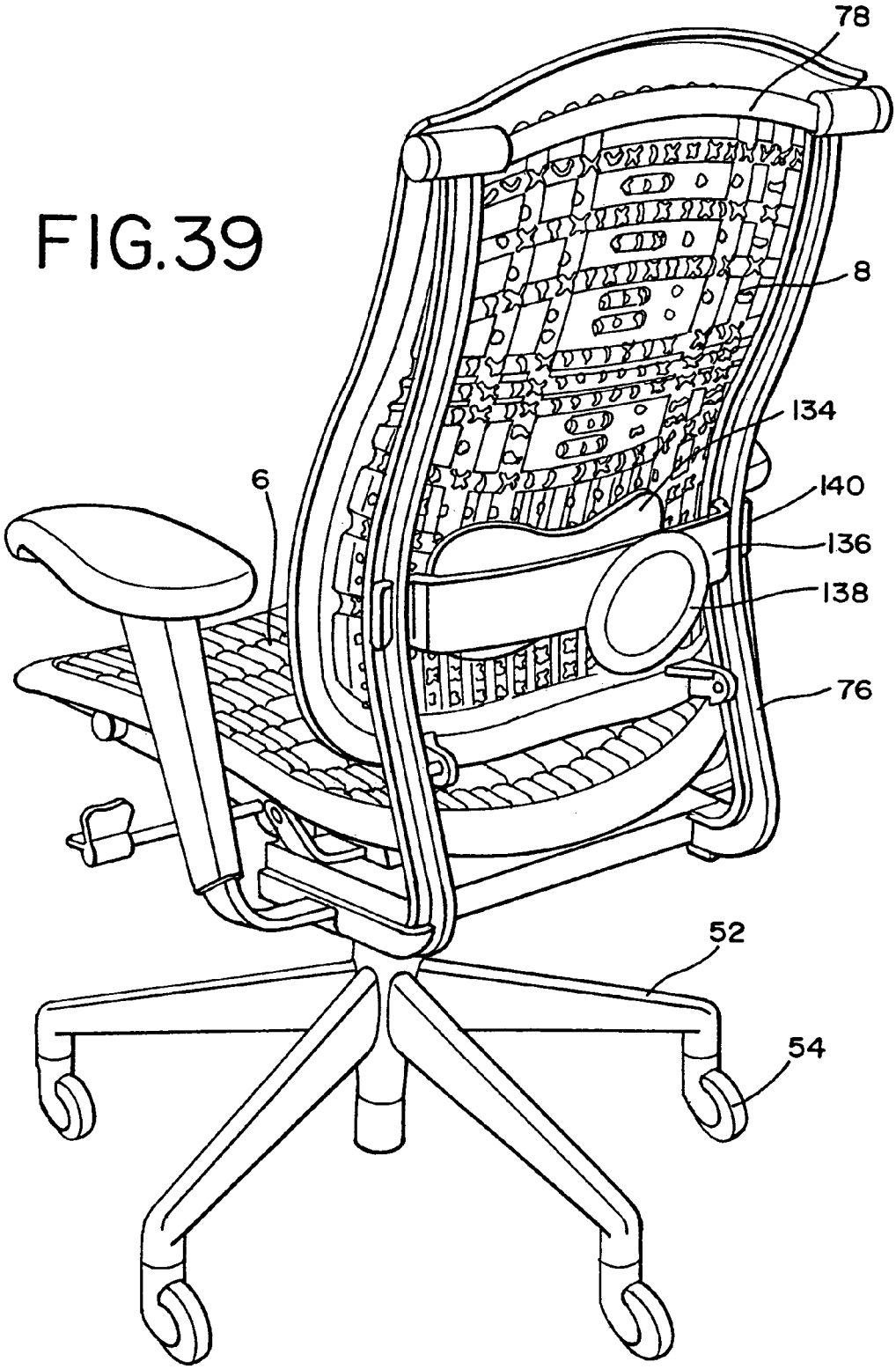
FIG. 39 is a rear perspective view of the embodiment shown in FIG. 38.

Referring to FIG. 38, the flexible back member has an inherent shape/contour molded into it. In particular, the back member has a forwardly protruding contour adjacent the lower portion of the back, for example at the lumbar and/or sacral region of the back. In one embodiment, as the user leans back against back member, it pivots about a horizontal axis joint at the top of the back. At the same time, the bottom of the back, and in particular a slide element on the back member, slides or translates along the upright so as to change the shape of the back, e.g., to flatten it. For example, the back can be moved from a first position to a new position, where the slide element is moved from a first position to a second lower position, and the back member has a generally flatter profile. Of course, the bottom of the back member can be moved toward the top thereof to form a greater bowed section in the back member.

Figure 76:
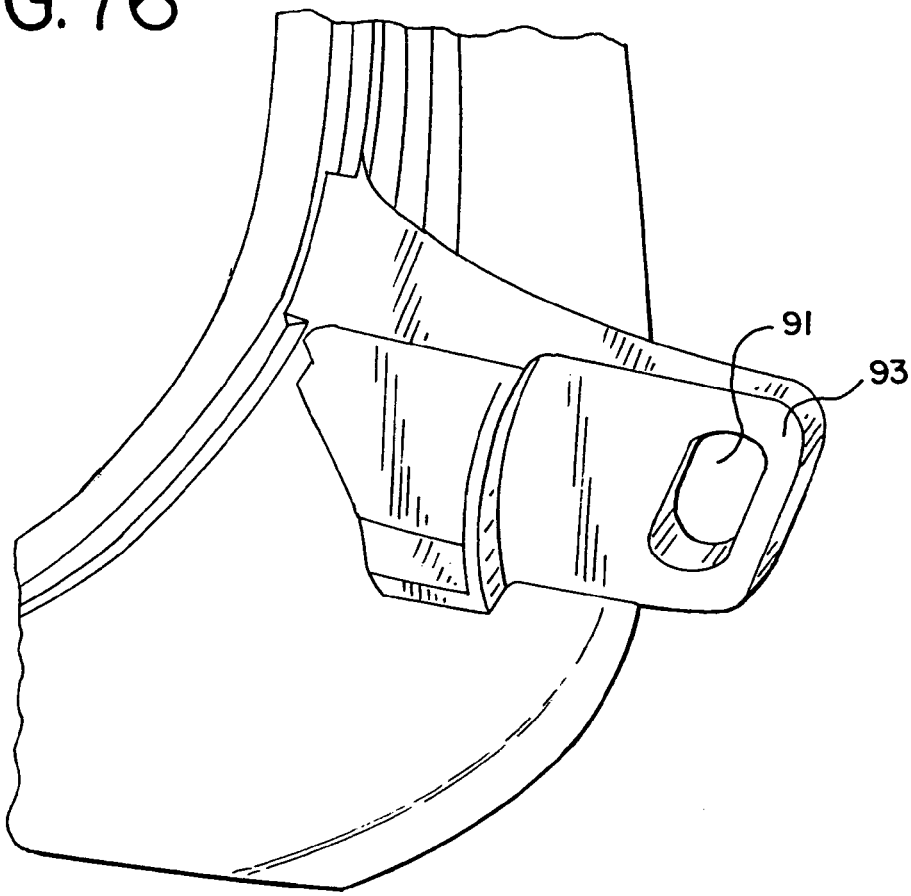
FIG. 76 is an enlarged, partial perspective view of a back frame component.

In one embodiment, shown in FIG. 76, the back member includes a lug 93 having a slot 91. The lug 93 is inserted into a channel formed in the upright, e.g. between first and second components of the upright. A pin or slide member, e.g. a screw, is driven through the upright and is secured through the slot. The slot is generally vertically oriented, but at a slight angle, i.e. at a diagonal. The slot allows the back to deflect, for example when the lumbar support is adjusted. It should be understood that the back member could be configured with a pin that rides in a slot on the upright.

Preferably, the resilient, elastic properties inherent to the back member will cause the back to return to its original shape when outside user forces are removed.

Figure 28:
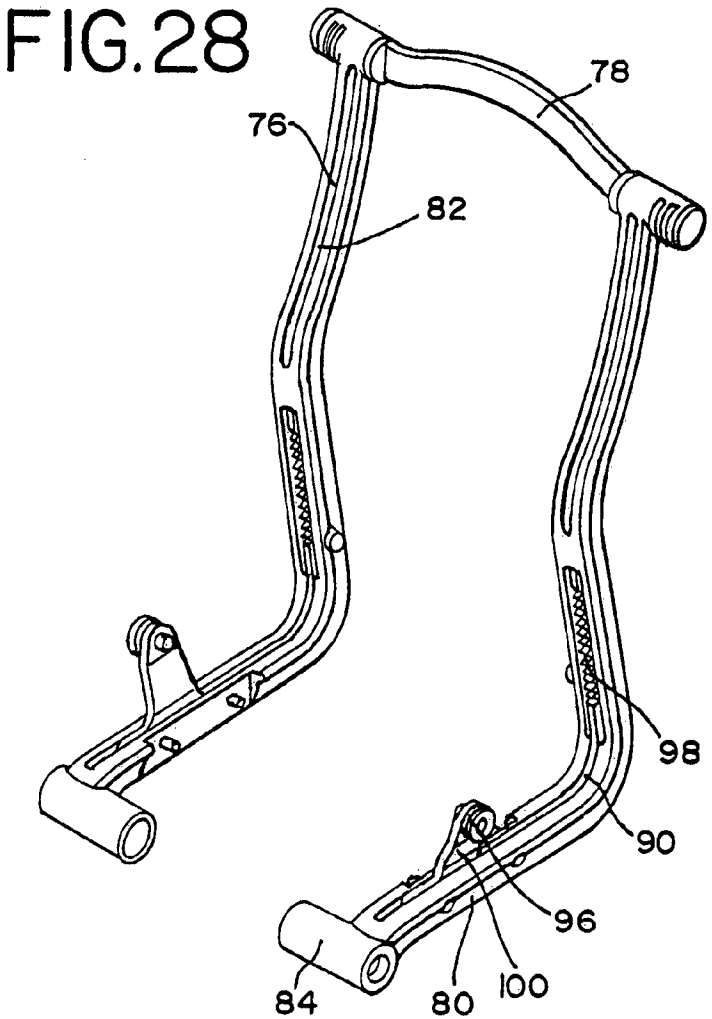
FIG. 28 is a perspective view of the back support frame assembly shown in FIG. 27.
Figure 27:
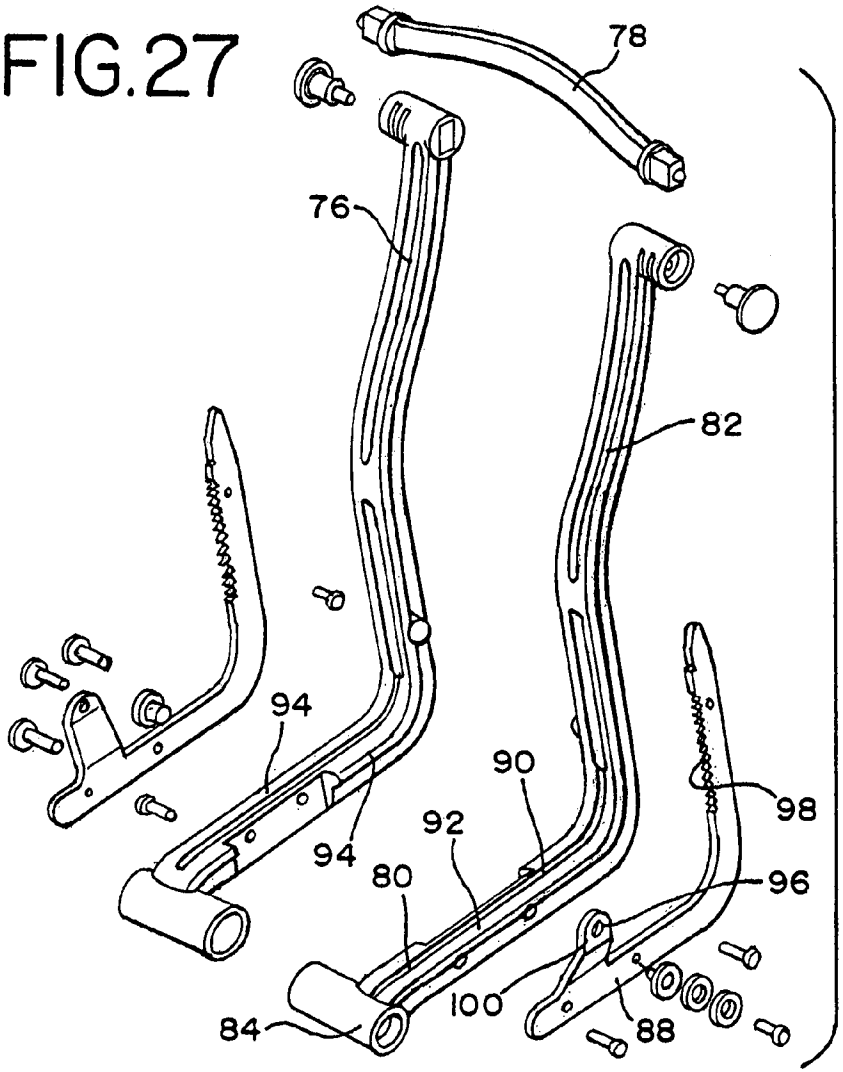
FIG. 27 is an exploded perspective view of a back support frame assembly.
Figure 29:
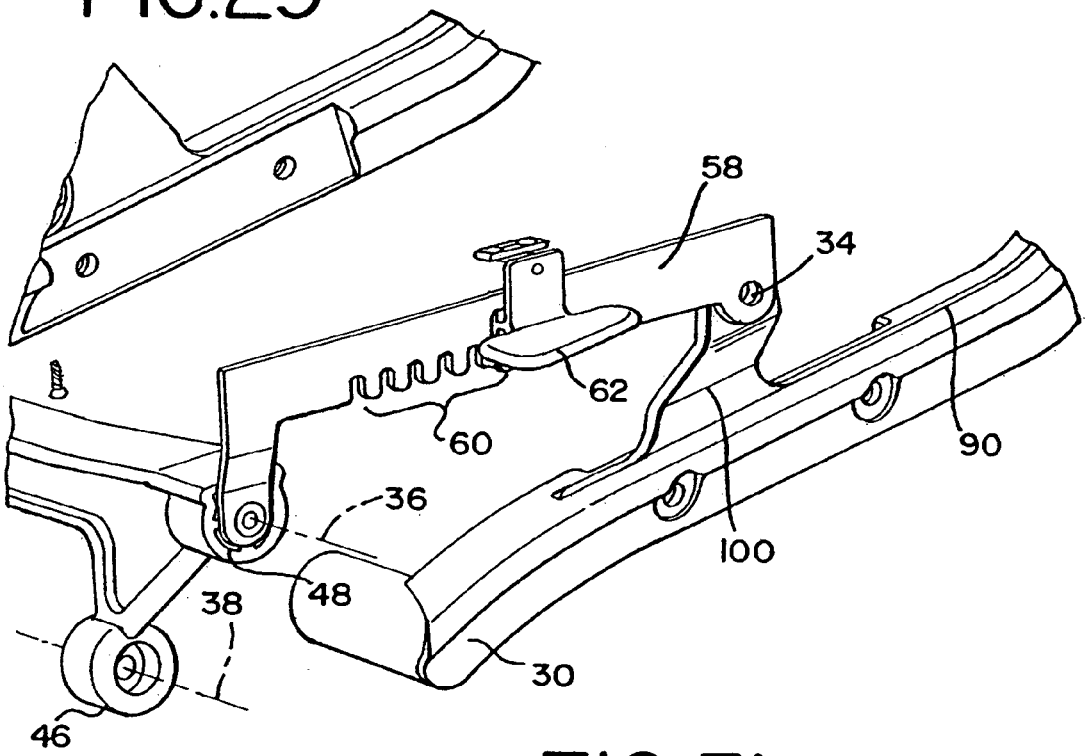
FIG. 29 is an enlarged, partial perspective view of three links of a four-bar linkage assembly.

In an alternative embodiment, shown in FIGS. 27 and 28, the forwardly extending portions 80 of the uprights have end portions 84 that are configured as lugs and are pivotally mounted to the control housing at the first pivot axis 32.

In either embodiment, and with reference to FIGS. 22, 28 and 70-72, the uprights 76 include a first component 86, 486 preferably made of a first material, such as a plastic, wood, fiberglass, polymer, metal, etc., including nylon and polypropylene (unfilled and glass-filled (e.g., 20-25%)). The first component 86, 486 includes a groove 90, 490 or other cavity, formed therein, preferably along a front face 92, 492 between opposite side portions 94, 494 of the first component defining the groove. A second component 88, 488 is inserted in the cavity 90, 490. Preferably, the second component 88, 488 is made of a second material different from the first material, for example and without limitation a metal such as steel, although it should be understood that the second material can be a composite, plastic, wood, or any other material. In one embodiment, the second component 488 is made of the same material as the first component.

Figure 22:
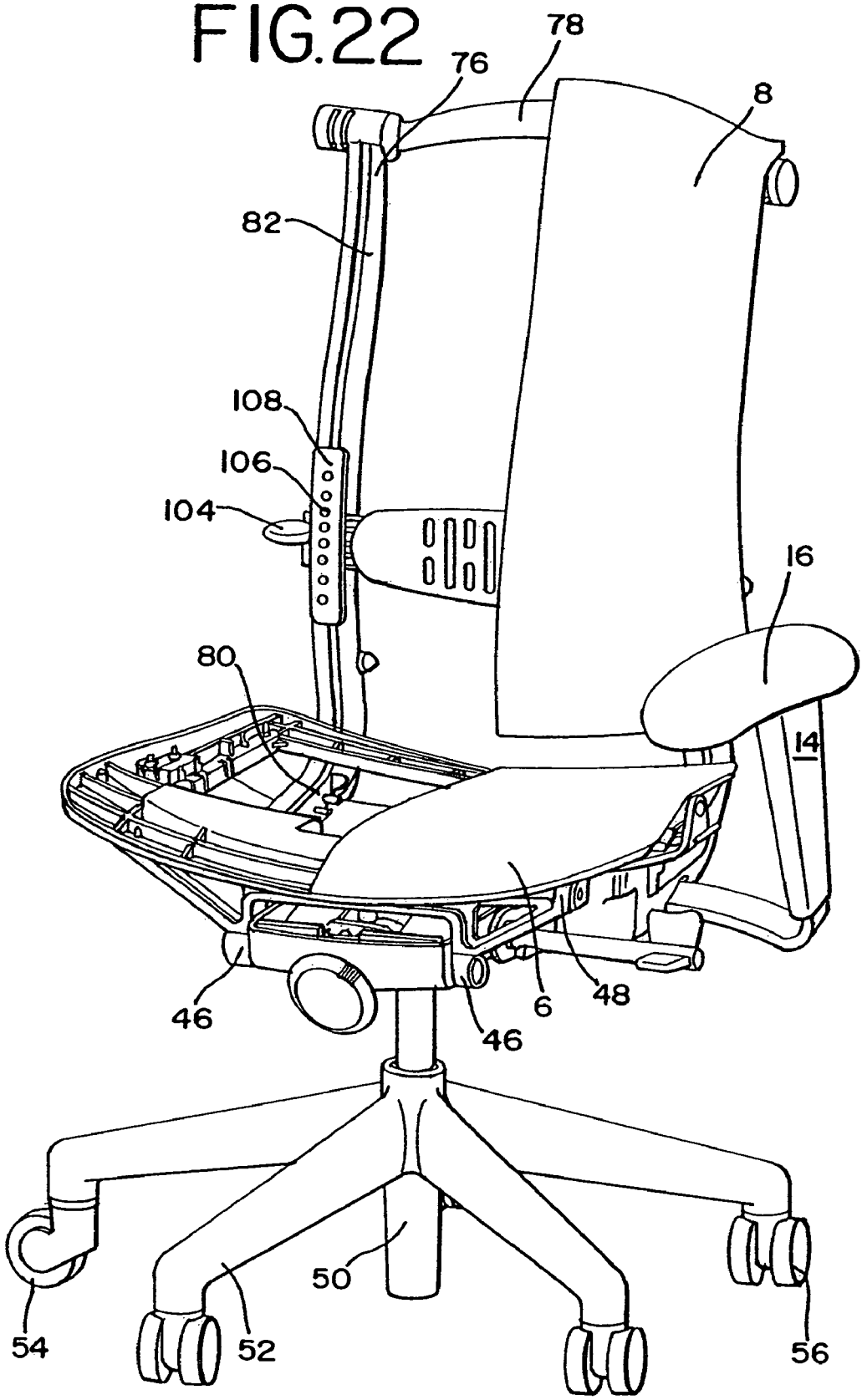
FIG. 22 is a front perspective view of one embodiment of a chair with portions of the seat and back cut away.

In one embodiment, shown in FIGS. 22 and 28, the second component 88 is configured as a metal insert, preferably formed from a sheet or plate-like member. In this way, the metal insert can be easily manufactured by stamping or cutting, yet still provide increased bending strength due to its vertical orientation. The metal insert 88 provides various engagement locations 96, 98 or surfaces for joining the back to other components. At the same time, the metal insert 88 is substantially hidden from view, such that the back frame 74 is provided with a pleasing aesthetic appearance. It should be understood that the composite frame structure, otherwise referred to as a laminated beam structure, can be incorporated into other seating structure components, including without limitation the seat and armrests.

In one embodiment, shown in FIGS. 24 and 27, the metal insert includes a flange 100 that extends upwardly and provides an engagement location 96 formed as a pivot joint for the seat defining the second pivot axis. The flange 100 can be bent as desired. In another embodiment, shown in FIG. 27, the metal insert includes a second engagement location, formed as a rack 98 formed on a front edge thereof, which is exposed to the front of the frame member. The back support or armrests can be configured with a latch device that releasably engages the rack to secure one or both of those components in a desired position, as shown for example in FIG. 2. Various back and arm configurations are disclosed in U.S. Provisional Application No. 60/381,769 filed May 20, 2002 and PCT Application PCT/US03/16034, filed May 20, 2003, the entire disclosures of which are hereby incorporated herein by reference.

Figure 71:
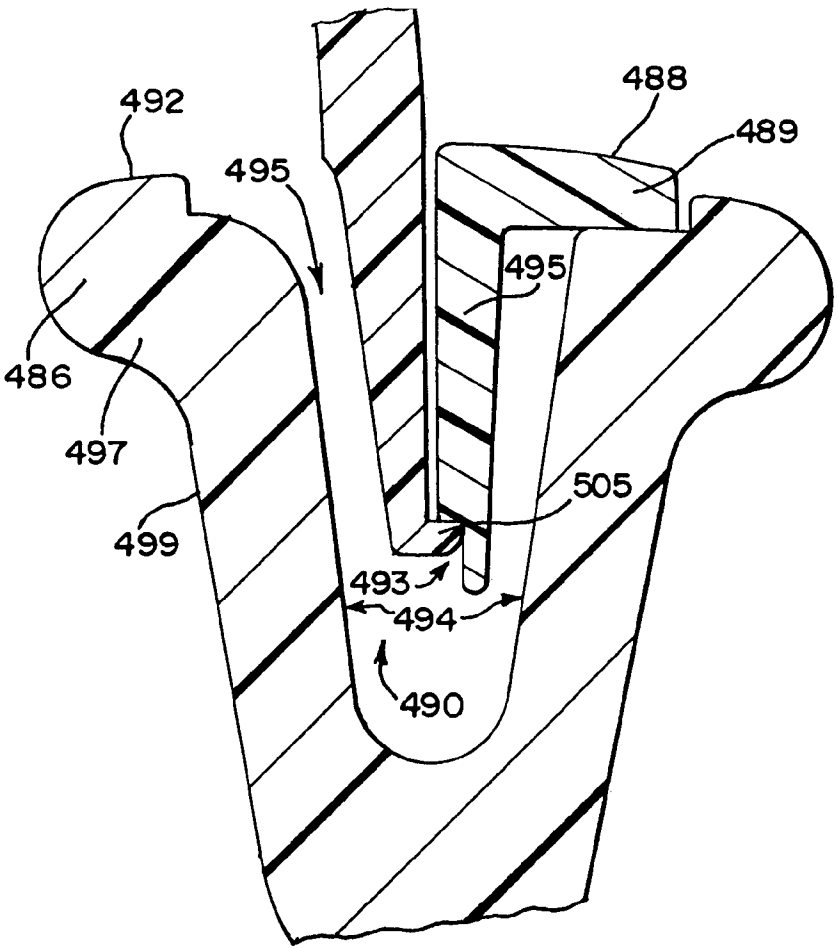
FIG. 71 is a cross-sectional view of the frame upright and lumbar support interface shown in FIG. 70.
Figure 70:
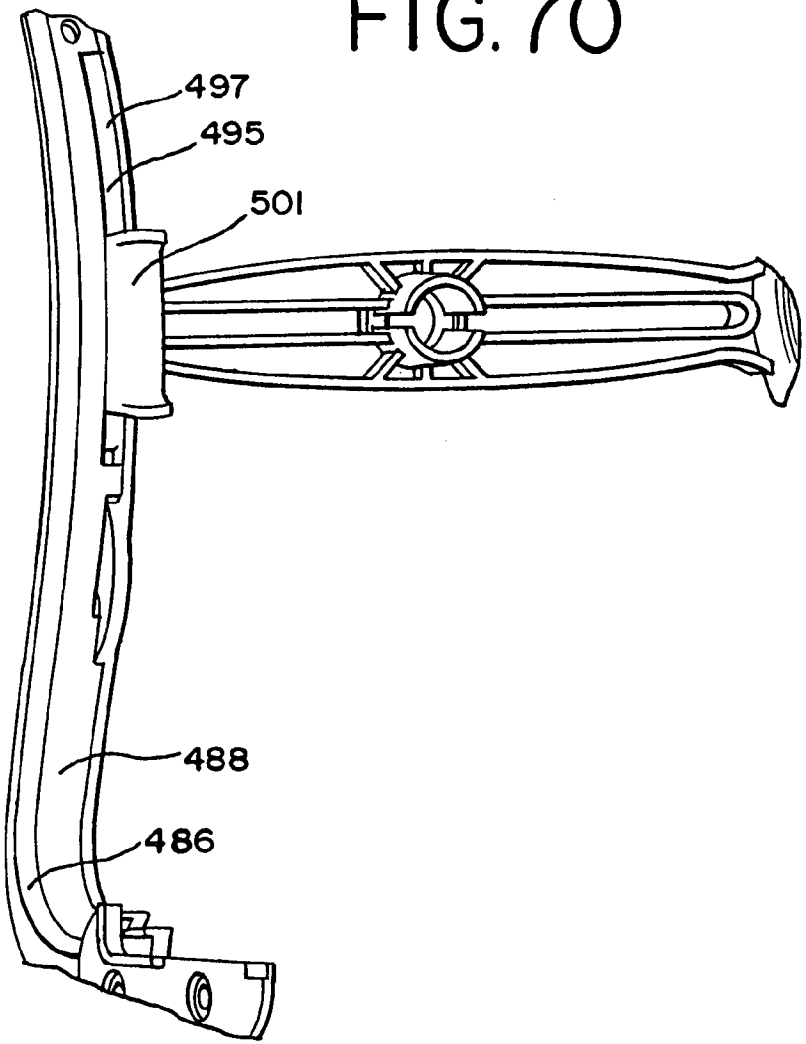
FIG. 70 is a partial perspective view of one embodiment of a back frame upright and lumbar support.
Figure 72:
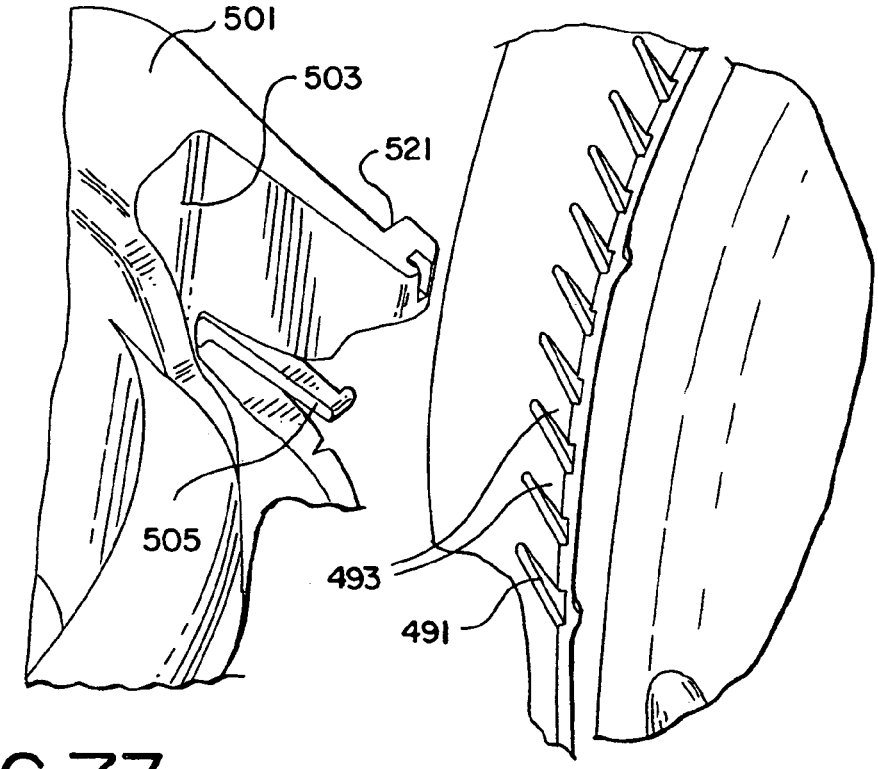
FIG. 72 is an exploded, partial perspective view of the interface between the lumbar support and frame upright.

In the embodiment of FIGS. 70-72, the insert 488 functions as a cover and has a portion with a front flange 489 and a side flange 491, with the side flange having a plurality of vertically spaced openings 493 defining a rack. The side flange 491 is spaced from the inner wall 494 of the upright to form a gap therebetween. The upright has an wall portion 497 defined between the inner wall 494 and an outer wall 499. In one embodiment, the support member can be made with both inserts 88, 488, or combinations thereof.

Figure 77:
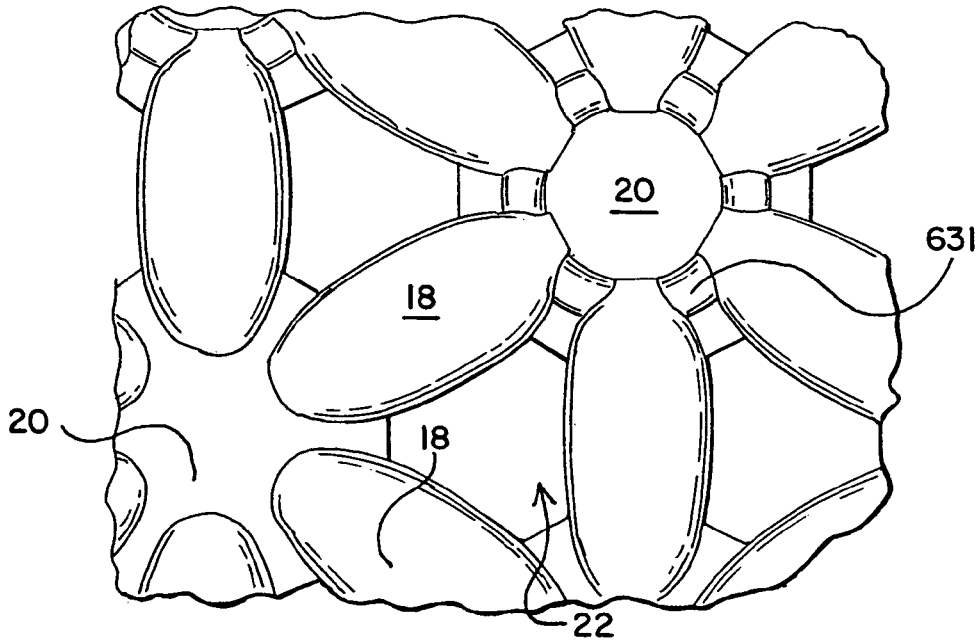
FIG. 77 is a bottom view of one embodiment of a body support member.
Figure 78:
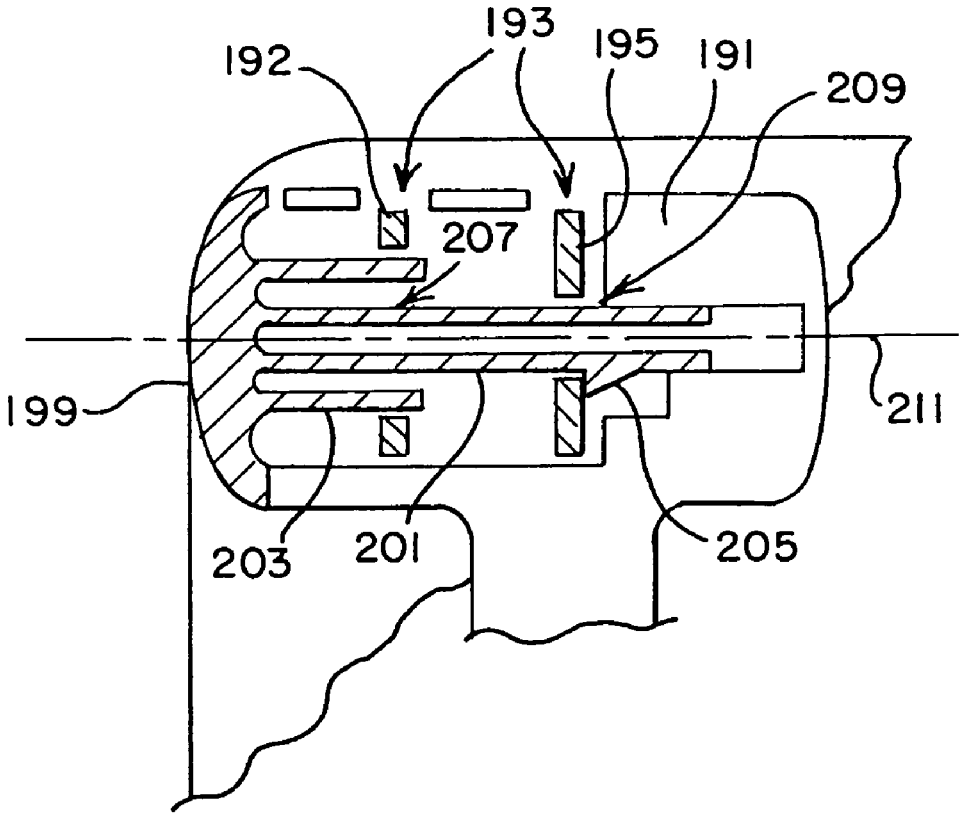
FIG. 78 is a partial cross-sectional view of a connection between a back upright and the back.

Referring to FIG. 77, the upper portion 191 of the backrest is configured with a pair of lugs 197, 195, one having a larger diameter opening 207 than another opening 209, with the openings being axially aligned. The lugs are inserted through a pair of slots 193 formed in the upper end portion 191 of each upright. A connector, having a decorative cap portion 199, has an inner shaft 201 inserted laterally through the two openings, and in engagement with the second opening 209 and the upper end portion 191. A second shaft portion 203 is inserted through the second opening 207. The connector is secured to the upper end portion or one of the lugs with a snap fit, for example using a tab or catch member 205, so as to thereby connect the back member with its lugs to the upper end portions. The lugs and upper end portion can be configured with mating stop surfaces (not shown) to prevent rotation therebetween about a lateral axis 211.

Figure 23:
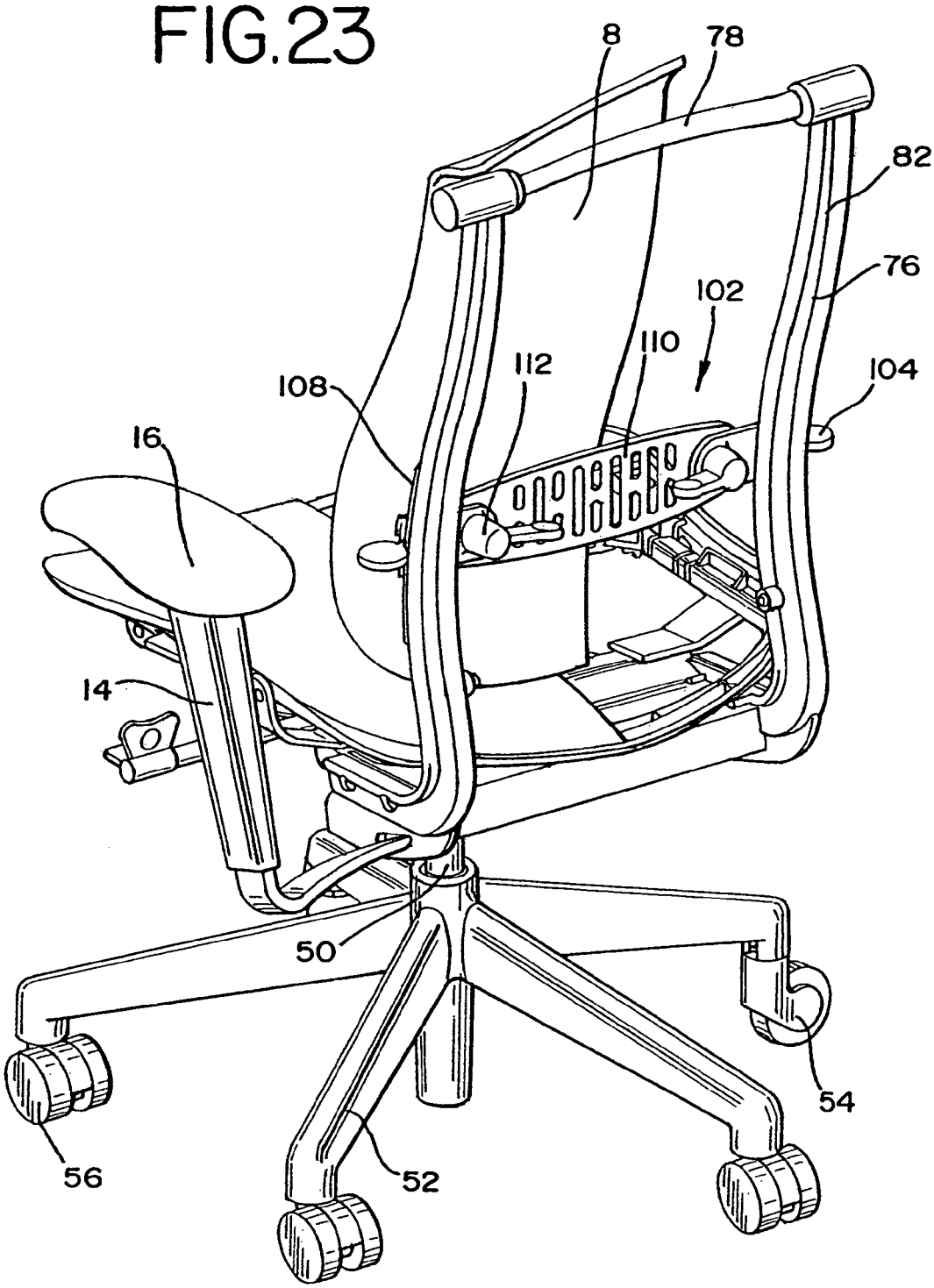
FIG. 23 is a rear perspective view of the chair shown in FIG. 22.

Referring to FIGS. 22-24, a lumbar support 102 is secured to a front of the vertical frame members. The lumbar support is vertically adjustable along the frame members. A pair of end supports 104 are trapped between the frame and a strap 108 secured to the frame. The end supports are vertically moveable between the frame and strap to a plurality of positions. The strap includes a plurality of openings 106, allowing a latch device to secure the end supports to the strap at one of the openings. The latch device can include a simple detent, or a moveable latch. The lumbar support further includes a belt 110 extending between the end supports the belt can be tightened or loosened by a pair of adjustment members 112.

In another embodiment, shown in FIG. 39, 52-58 and 70-72, the lumbar includes a cross member 136, or support member, secured to the uprights and a body support member 134 disposed between a front of the cross member and the rear surface of the back seating surface 8. The cross member has a U-shaped guide 501 forming a rearwardly facing channel 503 that engages and rides along the wall portion 497, which acts as a track to support the lumbar support. The guide 501 includes a flexible tab or finger 505 that selectively engages the rack or openings 493 formed on the upright insert 488. The lumbar support includes a shoulder or step 521 that is engaged by the cover 488 to hold the lumbar support against the upright and to trap it therebetween. In operation, the user simply grasps the lumbar support and moves it to a desired position where the finger engages the rack.

An adjustment member 138, including for example a knob 140 and screw, can be used to adjust the fore/aft position of the support member 134 relative to the cross member 136 and seating surface 8. In particular, the cross member has a hub 400 formed on a back side thereof and an opening 402 formed therethrough. A wheel 404, shown in FIGS. 56 and 57, includes an inner hub 406 that extends into the opening and an outer hub 408 disposed radially outward from the inner hub. In one embodiment, the wheel includes an outer overmold grippable ring that surrounds the wheel and has a forwardly facing, ribbed gripping surface 412. The grippable ring is made of a relatively resilient material, such as GLS Dynaflex D3202 TPE. The cross member hub 400 is disposed in the space between the inner and outer hubs 406, 408.

A connector, or screw 414, includes a first head portion 416 having a plurality of longitudinal grooves 418 formed thereon. An annular groove 420 on the head is captured by a lip extending radially inward from and formed on the inner hub of the wheel with a snap-fit. The longitudinal ribs 424, which are formed on the interior of the hub 406, are disposed in and engaged with the grooves 418 so that the wheel and screw are maintained in a non-rotatable relationship. The screw 414 rotates with the wheel 404 due to the engagement between the ribs and grooves 418, 424. Of course, it should be understood that the ribs can be formed on the connector and the grooves formed in the wheel.

Figure 54:
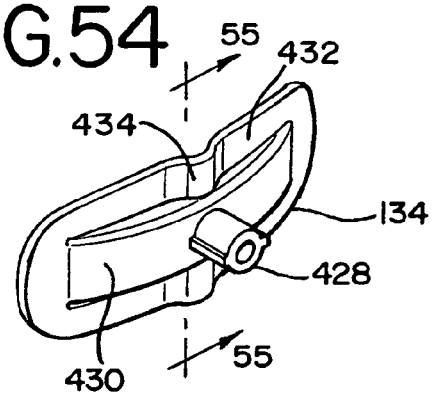
FIG. 54 is a perspective view of a lumbar body support member.
Figure 55:
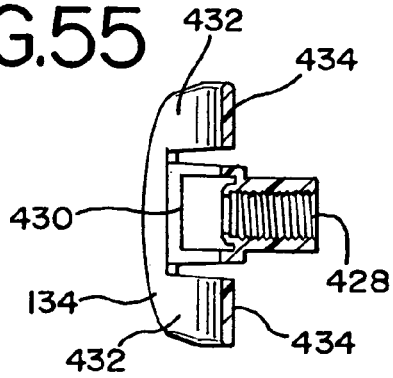
FIG. 55 is a cross-section of the lumbar body support member taken along line 55-55.
Figure 56:
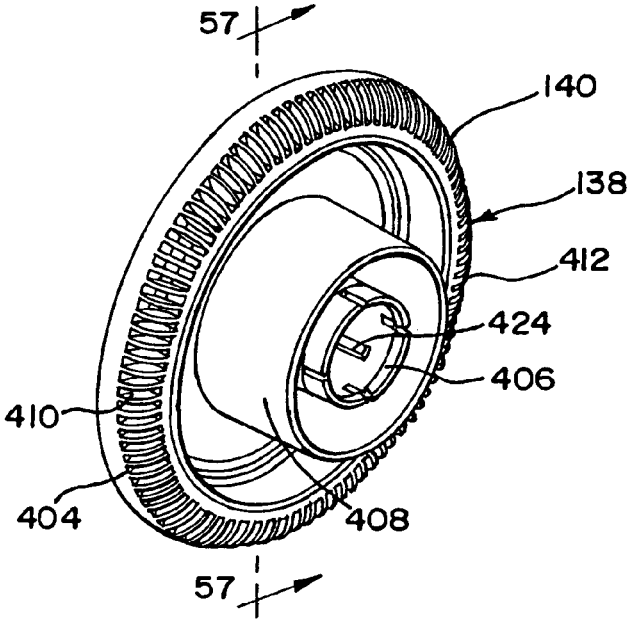
FIG. 56 is a front perspective view of a lumbar adjustment member.
Figure 57:
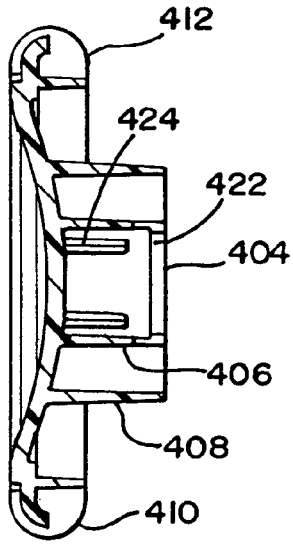
FIG. 57 is a cross-section of the lumbar adjustment member shown in FIG. 56 taken along line 57-57.
Figure 59:
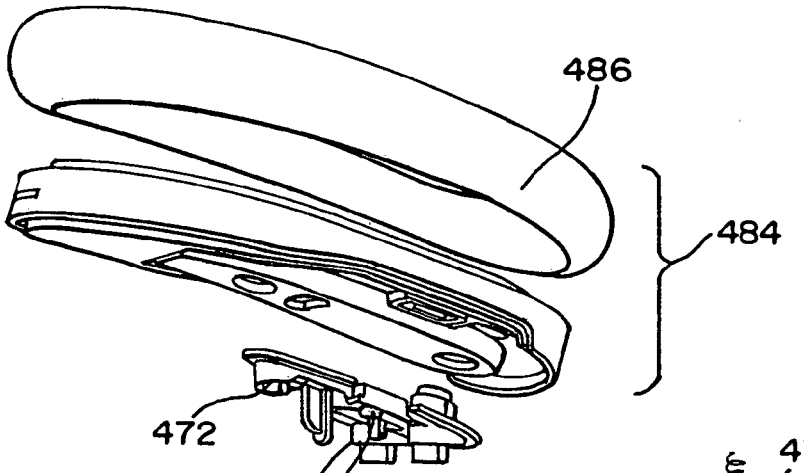
FIG. 59 is an exploded perspective view of an armrest assembly.
Figure 58:
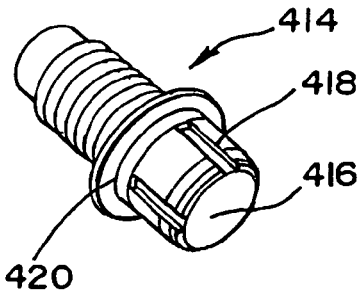
FIG. 58 is a perspective view of a lumbar adjustment screw.
Figure 58:
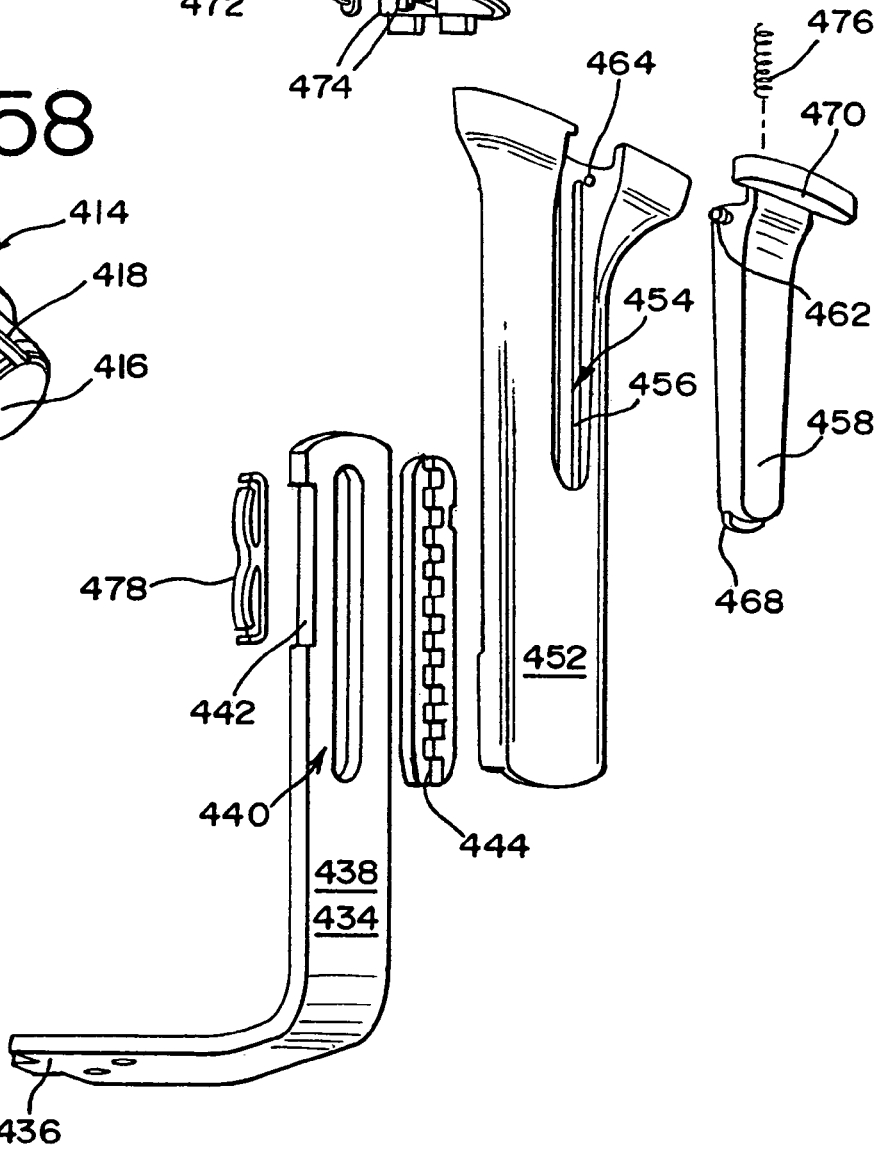
Figure 60:
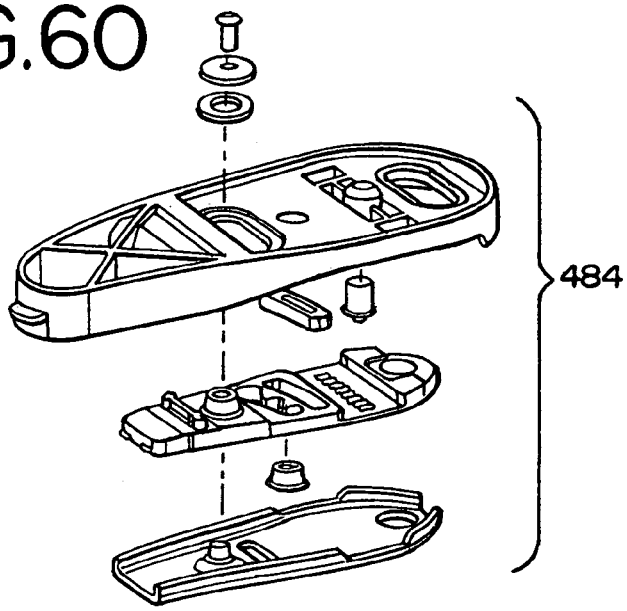
FIG. 60 is an exploded perspective view of an adjustable armrest pad assembly.
Figure 61:
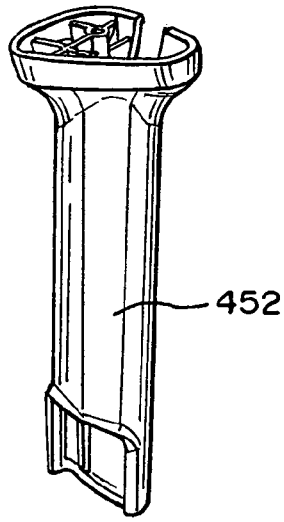
FIG. 61 is a perspective view of an armrest sleeve.
Figure 62:
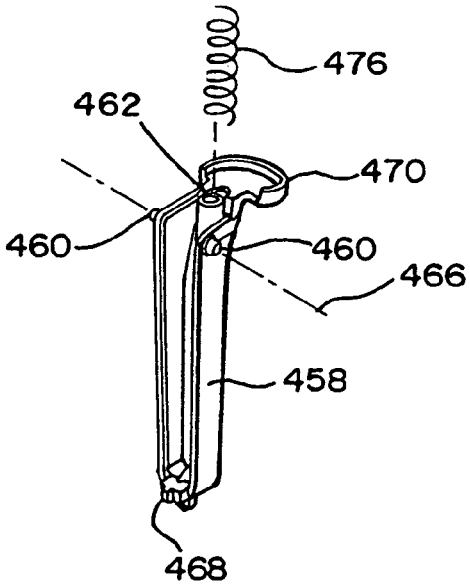
FIG. 62 is a perspective view of a trigger member.
Figure 63:
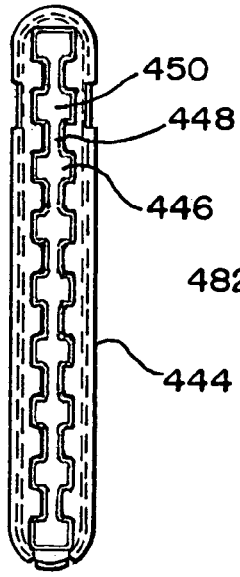
FIG. 63 is a side view of an armrest rack member.
Figure 64:
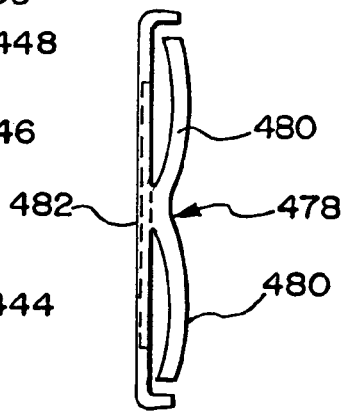
FIG. 64 is a side view of an anti-rattle member.
Figure 65:
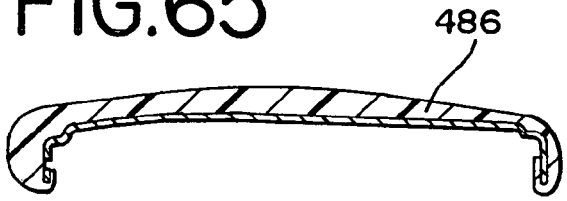
FIG. 65 is a cross-section of an armrest pad.

The screw 414 has a threaded end portion 426 that threadably engages a threaded socket 428 formed in the lumbar body support member, shown in FIGS. 54 and 55. The body support member includes a central, laterally extending beam 430, and a peripheral frame 432 secured to ends of the beam. Central portions of the top and bottom members of the frame have curved portions 434, which provide a rearwardly facing recess so as to relieve pressure on the seating structure along the spinal region of the user. As the wheel is rotated in first and second directions, the connector or screw moves the body support member forwardly and rearwardly to provide more or less support for the user adjacent the lower back region.

Referring to FIGS. 22-24, 38-40 and 59-65, an armrest assembly is shown as including an L-shaped strap support member 434 having a horizontal portion 436 secured to the support bracket and a vertical portion 438 having a central, longitudinally extending slot 440 and a longitudinally extending recess 442 or cut-out formed along one side thereof. A rack insert, made for example of nylon, is disposed in the slot. The rack insert has a plurality of vertically spaced openings 446 joined by narrower openings 448. The rack insert includes a peripheral flange 449 that engages one face of the strap support member. A bottom hook or tab 451 and a pair of flexible tab members 450 spaced from the hook or tab 451 engage an opposite face of the vertical portion 438 of the strap to secure the strap between the tabs 450, 451 and the flange 449 with a snap-fit. A sleeve member 452 is disposed over the vertical portion of the support member and has a central opening 454 shaped to receive the vertical strap. On outer side of the sleeve has a longitudinally extending cut-out 456 formed therein that opens to the top of the sleeve.

A trigger member 458 includes a pair of pivot axles 460 defining a pivot axis 466 that are seated in bearing seats 464 formed in the top of the sleeve, preferably in a snap-fit engagement. The trigger further includes a spring seat 462 extending upwardly from a top thereof, and spaced outwardly from the pivot axis 466 so as to form a lever arm therebetween. A bottom of the trigger includes a nose 468 or protuberance longitudinally spaced from the pivot axis 466 and shaped to selectively engage the openings 446 of the rack. A handle 470 or grippable actuating platform extends laterally outward from the top of the trigger and has a bottom gripping surface spaced from the pivot axis 466. A plate 472 is secured to the top of the sleeve and includes a second spring seat extending downwardly therefrom in alignment with and above the spring seat 462 of the trigger. A longitudinally oriented spring 476 is disposed between and on the spring seats 466, 474. An anti-rattle spring 478 has a pair of cantilever springs 480 and a base portion 482. The spring is disposed in the cut-out 442 formed in the side of the strap. The spring 478 has a non-biasing width greater than the width of the cut-out, such that the spring engages an inner surface of the sleeve and biases an opposite surface of the sleeve into engagement with the strap so as to provide a tight fit between the strap and sleeve. In essence, the spring is preloaded to maintain a tight fit and eliminate any feeling or sound of looseness or rattling.

In operation, the user pushes upwardly on the trigger grippable member 470 against the biasing force of the spring 476 engaging the plate 472 such that the trigger member pivots in a first direction about the pivot axis 466. The pivotal movement disengages the nose 468 from one of the openings of the rack 446 and the user can move an armrest pad assembly 484 and sleeve 452 to a desired vertical position. The user then releases the trigger 458, with the spring 476 biasing the trigger to an engaged position with the nose 468 engaging one of the openings 446 in the rack. The anti-rattle spring 478 maintains a tight relationship between the sleeve and strap and provides the user with a firm, smooth movement of the sleeve relative to the strap.

Referring to FIGS. 59, 60, 65 and 67, the armrest pad assembly 484 provides lateral and pivotable adjustment of an armrest. The assembly includes a pad member 486, the plate member 472 or mounting platform, a support platform 600, a second platform 602 and armrest support 604. The pad 486 can be made of foam and a substrate 487, which is secured to the armrest support 604 with various fasteners and/or adhesive. The pad also can include various gels or other fluids and/or gases to provide a comfortable feel to the user's arm, which rests thereon.

The mounting platform 472 has a guide member 606, or pivot member, extending upwardly therefrom and defining a substantially vertical pivot axis 608. The term "platform" as used herein means any support structure or surface, and includes, but is not limited to, a substantially flat, horizontal member or surface, or platelike member. In addition, a protuberance or guide/pivot member extends from the mounting platform 472 at a location spaced from the guide member 606, or is secured to the platform with a fastener.

The support platform 600 includes an opening 610 that is shaped to receive the guide member 606, with the platform disposed on the guide member at the opening such that the platform 600 can pivot about the pivot axis 608. The protuberance extends through an opening 612 formed in the platform 600 and is indexed in a slot 617 formed in the platform 602 by a pair of arms 614 that have end portions that are shaped to define three openings 620. Of course, more openings could be formed and defined by the slot and arms. A rubber or elastomeric spring 618 is disposed in a slot 616 formed opposite slot 617. The spring 618 biases the arms 614 against the protuberance.

In operation, the platform is moved or pivoted about the pivot axis 608 relative to the mounting platform 472, with the protuberance indexing with one of the plurality of openings 620 so as to locate the platforms 600, 602 relative to the mounting platform 472 in a plurality of pivot positions corresponding to the plurality of recesses. A bearing member 621 can be disposed on the protuberance, with the bearing member indexing with the openings. In one embodiment, the bearing 621 is secured to the platform 472 with a fastener, with the bearing 621 disposed between the platform 600 and platform 602.

It should be understood that the location of the recesses (or openings) and protuberance can be reversed, with the protuberance extending downwardly form the platform and with the array of recesses or openings formed in the mounting platform on the top of the stem. Likewise, it should be understood that an array of protuberances could be provided on one or the other of the platforms and which mate with a recess.

The first platform 600 is secured to the second platform 602. The platform 602 has an opening 622 formed on one end thereof that is shaped to receive the guide member 606. A boss 624 is formed on the platform 600, with the boss extending into a boss formed in platform 602 and through opening 622. A fastener 628, extending through one or more washers, extends downwardly through the platform 602 and is engaged with the boss to secure the platforms 600 and 602 together.

A detent 640, shown as a ball plunger, is secured to the armrest support 604. The detent 640 releasably and selectively engages one or more recesses 642 formed on a top surface of the platform 602. The armrest support 604. includes a pair of spaced apart and substantially parallel tracks 644, shown as slots, formed therethrough. One of the tracks 644 receives the guide member 606 extending upwardly from the mounting platform 472 through the platforms 600, 602, while the other receives a guide member 646 formed on an upper surface of the platform 602, and through which the opening 624 is formed.

In operation, the user moves the armrest support 604 laterally relative to the platform 602, such that in one preferred embodiment, the detent 640 selectively engages one or more of the recesses 642 at one of a plurality of lateral positions. The interaction between the detent 640 and recesses 642 provides a firm solid feel as the armrest support is moved in the lateral direction and is guided by the guide members riding in the tracks. The platform 602 includes an additional guides 648, configured as posts, that extend upwardly therefrom and are received in a track or channel (not shown) formed in the bottom of the armrest support.

It should be understood that the various guide members and tracks could be formed in either the platform or armrest support. Likewise, the recesses could be formed in the armrest support, with the detent secured to the next lower platform. Also, it should be understood that the upper and lower platforms 600, 602 can be made as a single, one-piece member, with the recesses or protuberances formed on one side thereof, and with the channel and linear gear(s) formed on the other side thereof.

Preferably, the push button, or other actuator, is received in an opening or recess formed in the pad, and is configured with an outer contour shaped to mate with the outer contour of the pad.

Other suitable armrest assemblies are disclosed in U.S. application Ser. No. 10/738,641, filed Dec. 17, 2003, which is hereby incorporated herein by reference. For example and without limitation, the armrest can include a meshing gears and a locking device instead of the detent for control of the lateral adjustment feature.

Figure 9:
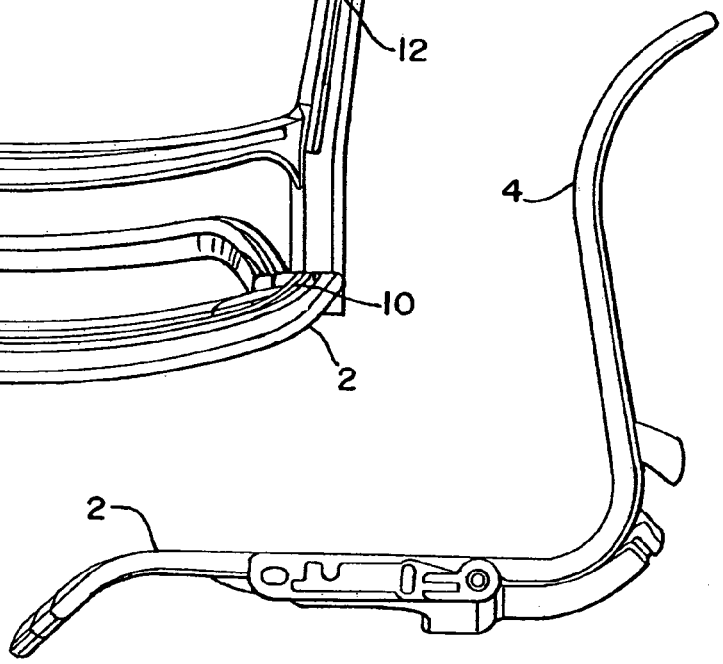
FIG. 9 is a side view of frame structure configured to support the back support and seat support shown in FIGS. 3-6.
Figure 10:
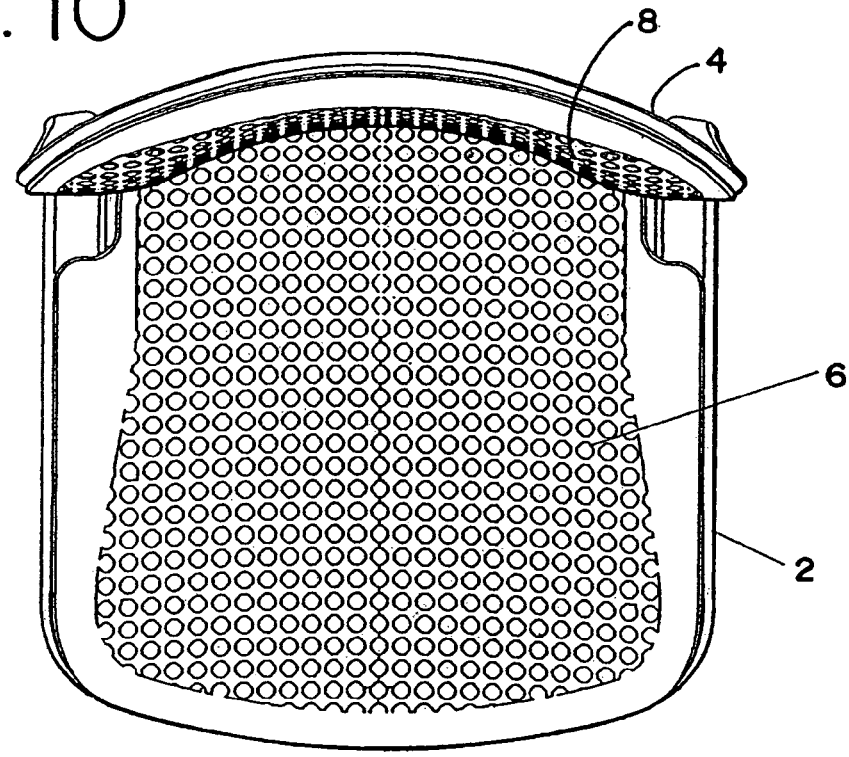
FIG. 10 is a top view of a seating structure.
Figure 11:
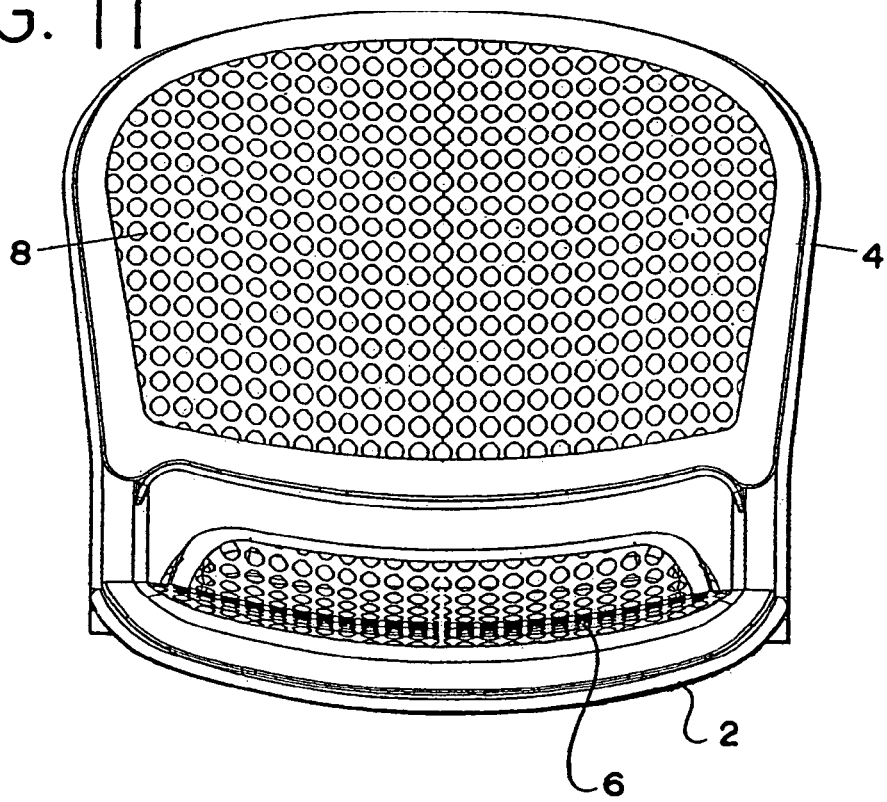
FIG. 11 is a front view of the seating structure shown in FIG. 10.
Figure 12:
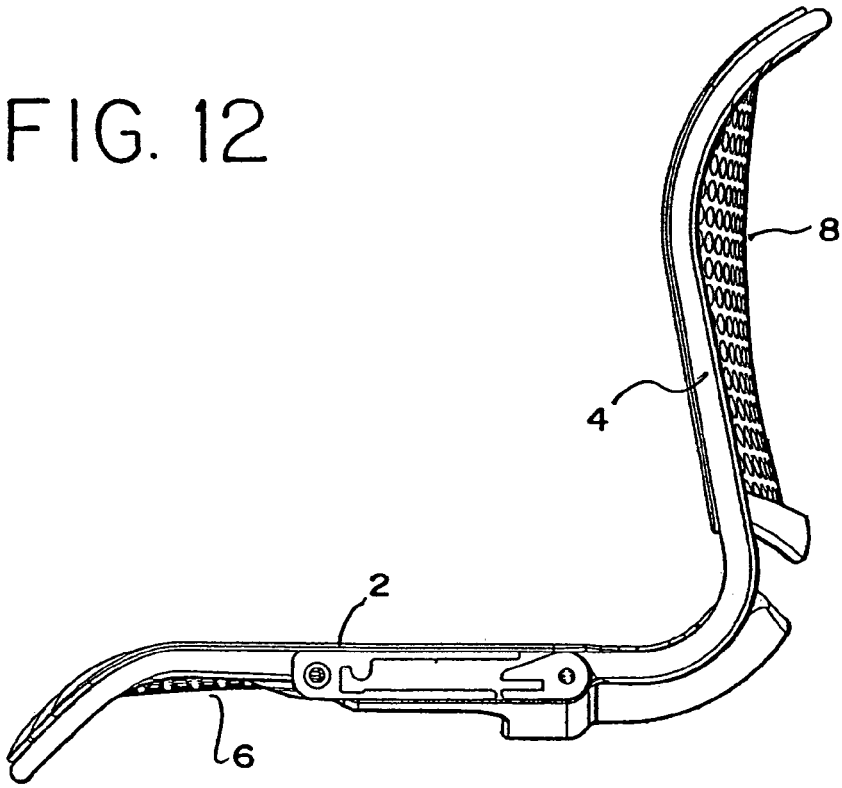
FIG. 12 is a side view of the seating structure shown in FIG. 10.

Referring to FIG. 10, a top view of one embodiment of a seating support structure shows a seat-pan seating structure 6 or surface and its support frame 2 and a back support structure 8 and its support frame 4 can be seen. Referring to FIGS. 3-6, the shells or pans 6, 8, can be seen separate from the frames 2, 4, and the frames can be seen separate from the seating surface shells or pans in FIGS. 1, 2, 7, 8 and 9. Also, it should be noted that a separate peripheral support frame is not a necessity of the invention, for the shells 6, 8 could be self-supporting with an integral structure, or surrounding, integral frame 66 as shown for example in FIGS. 30-32. Additionally for clarification, a seat-pan, or back-pan seating surface refers to a structure which may be the primary support surface, as in a plastic or wood chair, or a structure which may accept foam and upholstery and thus not be the primary support surface as can be commonly found in many articles of furniture. Of course, the seat pan or back pan seating surface can also be covered with only a thin membrane, for example and without limitation fabric, an elastomeric material, leather, rubber etc. Often these pan structures are also referred to as seating shells. All of these and any other terms used to describe a similar structure are considered to be equivalents and should be viewed as such.

Figure 45:
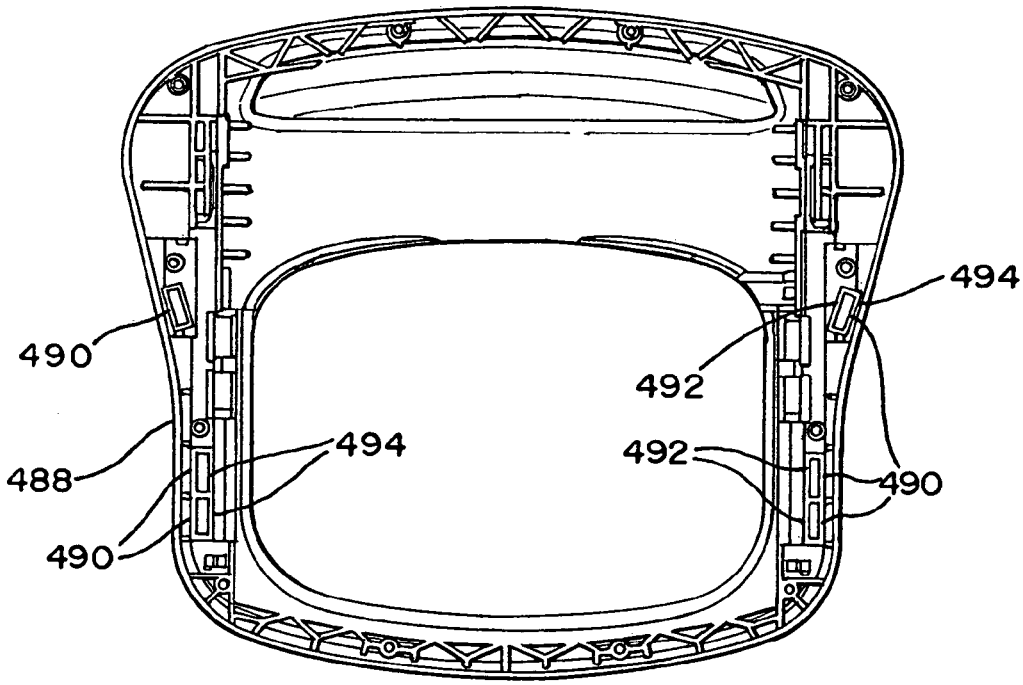
FIG. 45 is a top view of a seat support frame.
Figure 46:
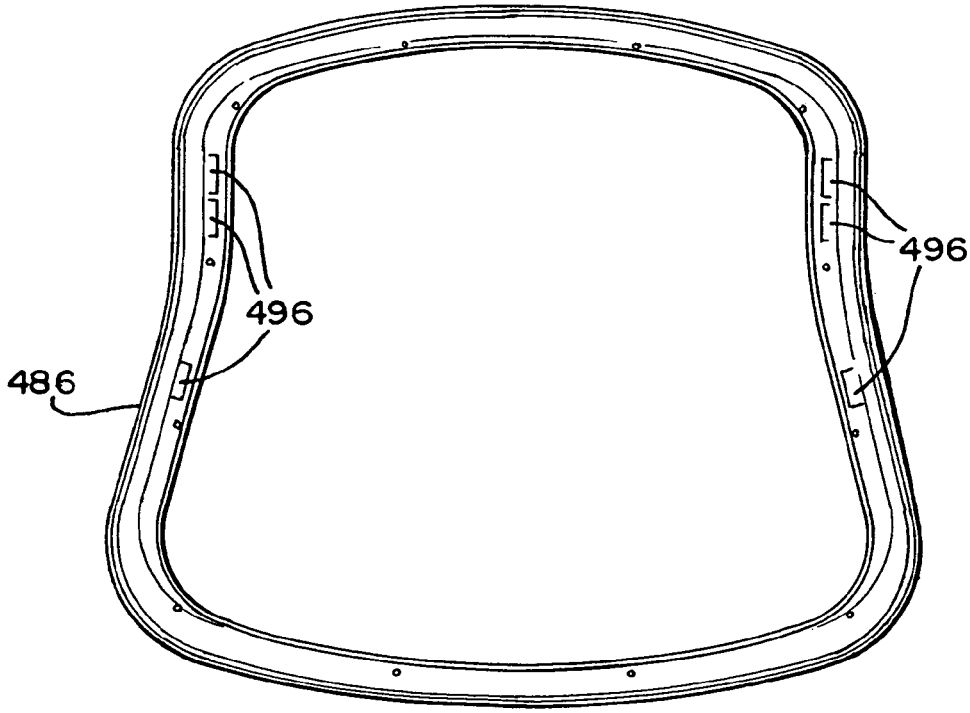
FIG. 46 is a bottom view of an integral seat frame and seating structure.
Figure 47:
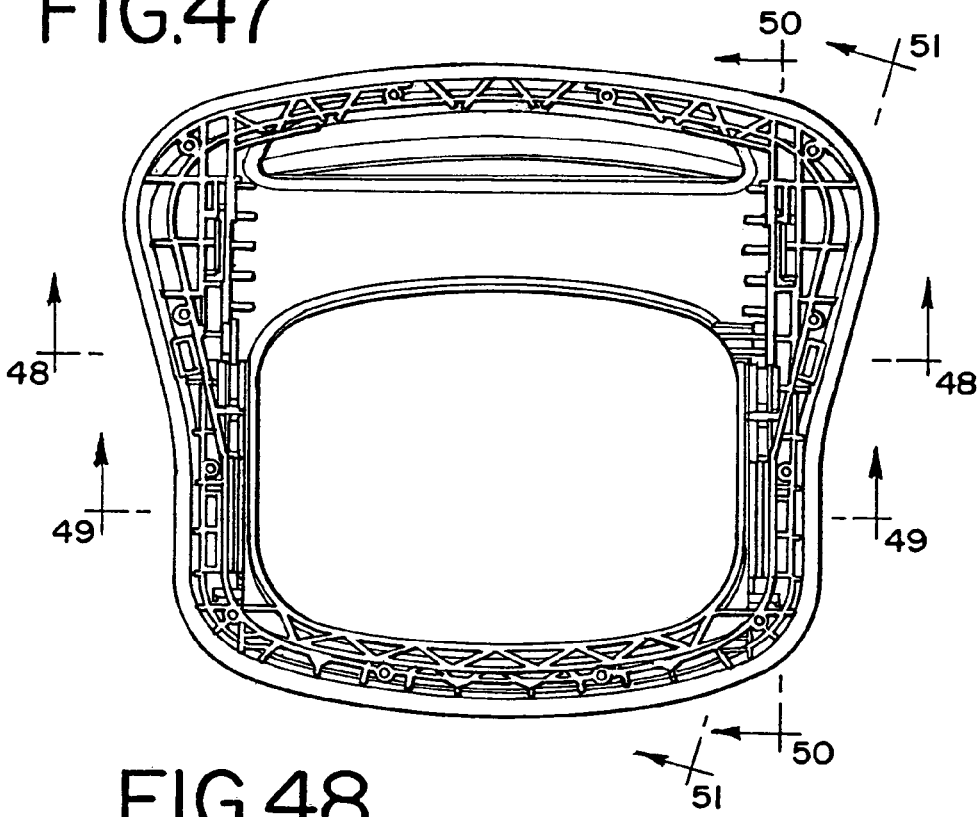
FIG. 47 is a top view of the seat frame and seating structure secured to the seat support frame.
Figure 48:
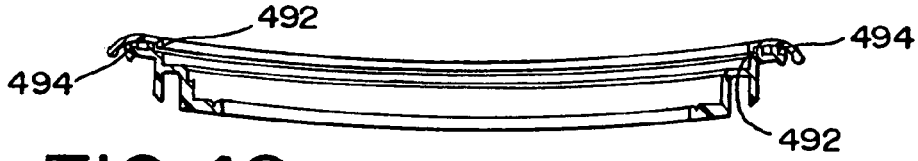
FIG. 48 is a cross-section of the seat assembly shown in FIG. 47 taken along line 48-48.
Figure 49:
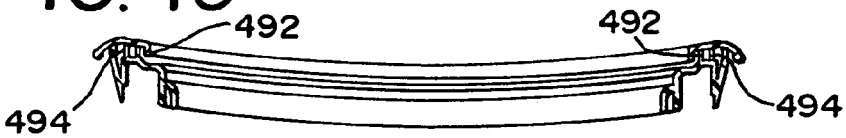
FIG. 49 is a cross-section of the seat assembly shown in FIG. 47 taken along line 49-49.
Figure 50:
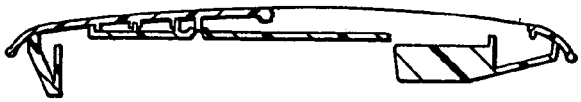
FIG. 50 is a cross-section of the seat assembly shown in FIG. 47 taken along line 50-50.
Figure 51:
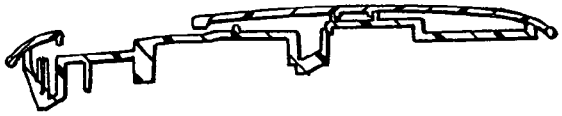
FIG. 51 is a cross-section of the seat assembly shown in FIG. 47 taken along line 51-51.
Figure 52:
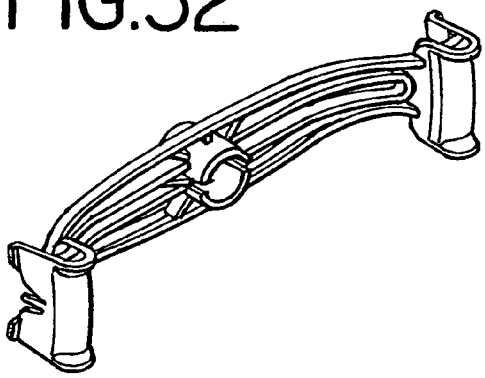
FIG. 52 is a front perspective view of a lumbar support member.
Figure 53:
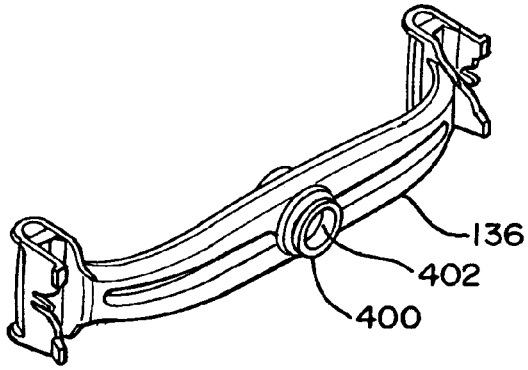
FIG. 53 is a rear perspective view of a lumbar support member.

Referring to FIGS. 45-51, various cross sections of a seating structure 486 secured to a support frame 488. The support frame 488 has a plurality of channels 490 or openings spaced around the periphery thereof, with the openings defined at least in part by an inner and outer wall. In one embodiment, the openings include three openings formed on each of the opposite side portions of the frame 488, with two of the openings lying proximate one another adjacent a rear of the seat (FIGS. 45, 47 and 50), and one opening positioned forwardly therefrom (FIGS. 45, 47 and 51). As shown in FIGS. 46-49, the seating structure, in turn, has a corresponding plurality of arms or tabs 496 that are shaped to be received in the openings 480 and bear against one or both of the inner and outer walls 492, 494. In this way, as a user sits in the chair, the tensile load applied by the seating structure in a lateral side-to-side direction is resisted by the arms bearing against the inner and outer walls. In addition, a plurality of screws are inserted from a bottom of the support frame and engage the seating structure to further secured the two components together. It should be understood that the back seating structure can be secured to a frame in the same fashion.

Figure 66:
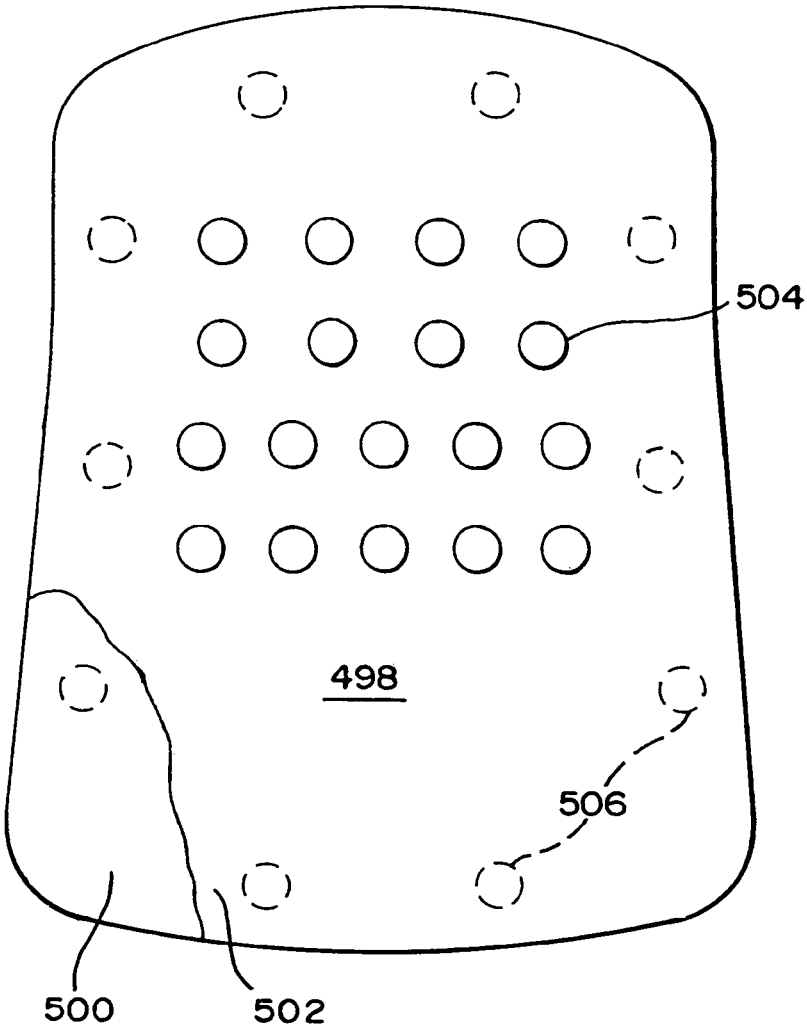
FIG. 66 is a front view of one embodiment of a backrest pad.
Figure 67:
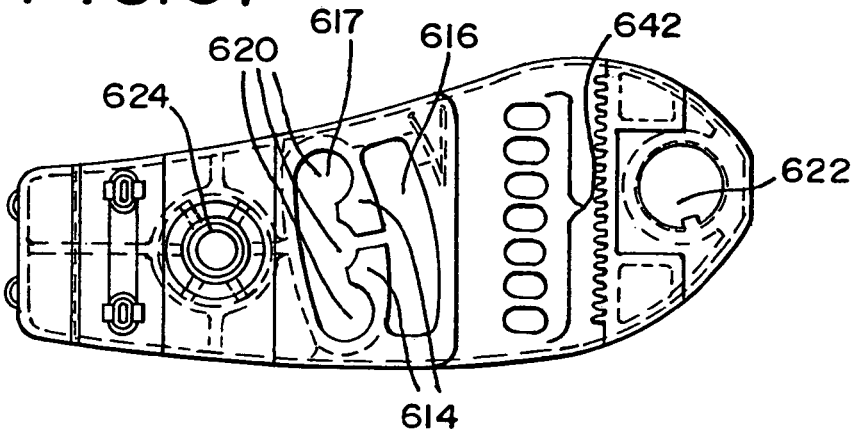
FIG. 67 is a top view of a support platform component of an armrest pad assembly.

In one embodiment, and referring to FIG. 66, a thin pad 498 is secured over one or both of the seat and back seating structure. Preferably, the thin pad is a molded batt or panel material, as disclosed for example in US patent application Publication US 2004/0028958 A1 (U.S. application Ser. No. 10/463,187), PCT application PCT/US01/10262 (Publication No. WO 01/74583 A1), U.S. Provisional Application No. 60/193,196, U.S. Provisional Application No. 60/389,647, U.S. application Ser. No. 09/869,418, PCT application PCT/US00/32272 and U.S. Provisional Application No. 60/167,303, all of which are hereby incorporated herein by reference. In particular, the pad includes a layer of moldable material 500 and a finish material, such as a fabric 502, secured or disposed along one side of the moldable material.

The thin pad can be formed in a three-dimensional shape to mate with and conform to the upper, body-facing surface of the seating structure, whether it be the back or seat. In one embodiment, the moldable material is made of a non-woven material, and can include without limitation thermoplastics, polyester, co-polyester, polypropylene, nylon, polyethylene, or combinations thereof. For example, one suitable non-woven material is available from Western Nonwovens, Los Angeles, Calif. The finish, e.g. fabric, is bonded to the moldable material substrate with an adhesive, for example and without limitation a powder adhesive, including for example and without limitation a co-polyester resin available from EMS-Griltech, S.C. Alternatively, the fabric is simply embedded into the moldable material substrate. The overall pad preferably has a thickness of 0.10 inches to about 0.75 inches, and in one embodiment is about 0.25 inches when covering the back and about 0.50 inches when covering the seat. In any event, the pad is relatively thin, such that it is flexible and can flex and conform to the underlying seating structure.

Figure 73:
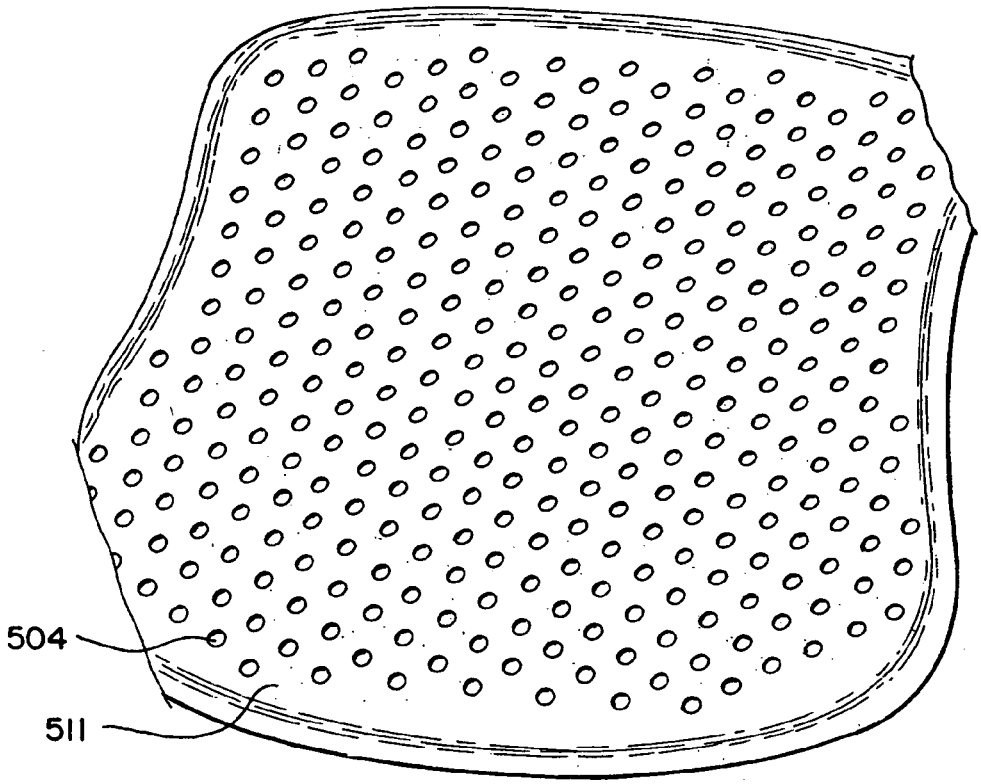
FIG. 73 is a top, perspective view of one embodiment of a seat pad.
Figure 74:
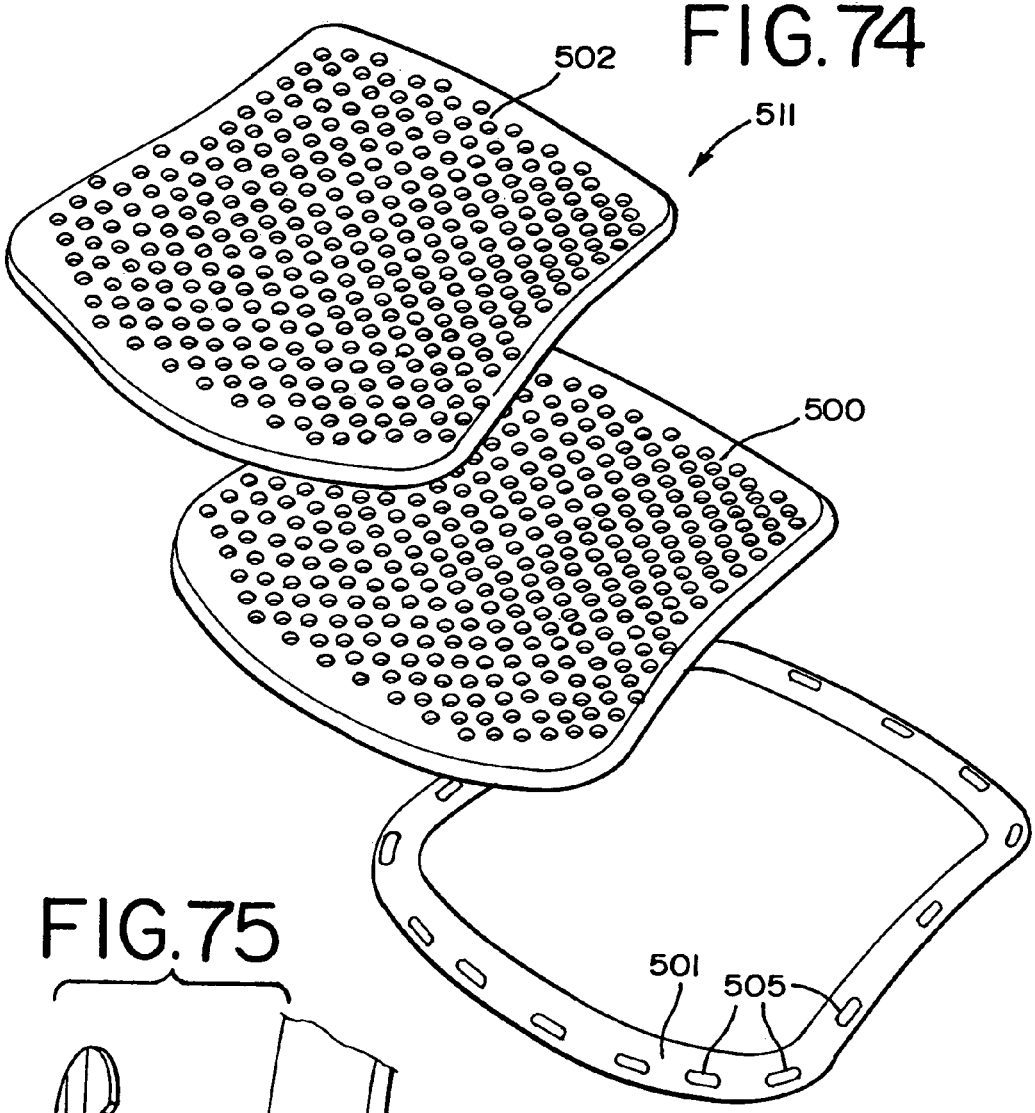
FIG. 74 is an exploded view of a seat pad assembly.
Figure 75:
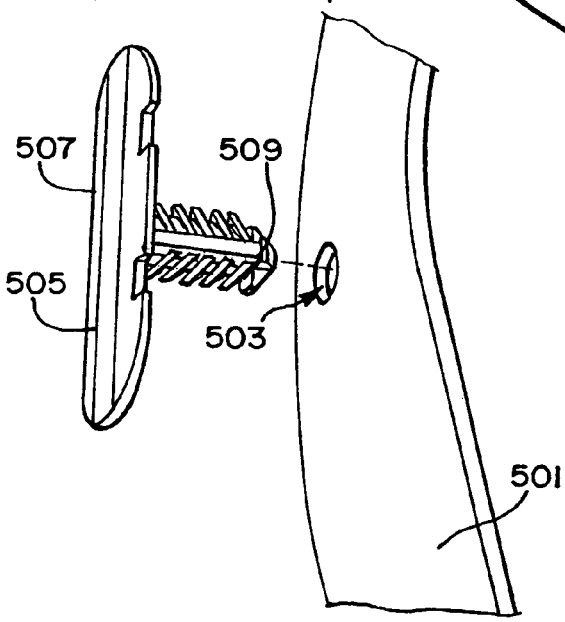
FIG. 75 is a an exploded view of a fastener and rim component of the seat pad assembly.

Referring to FIGS. 73-75, a seat pad assembly 498 is shown as including a rim component 501, a pad component 500 and a fabric covering component 502, or finish material. The rim component 501 is formed by placing a polyester material into a first mold. The mold compresses the polyester material and creates a rigid rim in the shape of the perimeter of the seat or back. The mold further forms a plurality of openings 503 spaced around the rim component. The rim component is then placed in a second mold. Fasteners, such as christmas tree fasteners 505 include a one-way insert portion 509 that are inserted in the openings 503 of the rim. The term "one-way" insert portion means the fastener can be easily inserted in one direction, but cannot be easily removed in the other, opposite direction.

Additional polyester material is placed in the second mold on top of the rim. The pad component 500 is formed and bonded to the rim component 501 with heat. The fasteners 505, which include a top flange component 507, are trapped or secured/in-molded between the rim component and pad component. The second mold further trims or cuts the perimeter of the pad component. By making the rim component 501 separately from the pad component 500, the rim component can be made more rigid such that it can support the fasteners 505.

Next, the bonded rim and pad components 501, 500 are inserted into a third mold. A powder adhesive is added to the top of the pad component and a fabric covering is placed over the top of the pad component. The mold heat cures the fabric 502 onto the pad component 500. The mold further forms the shape of the pad around the edge thereof, for example by forming a radius or curve to the edge. The mold further forms embossments 504, shown as a plurality of dimples, in the top of the pad assembly. In one embodiment, the dimples are formed by using pins.

After the pad assembly is removed from the third mold, the fabric 502 is trimmed and wrapped around the bottom of the assembly where it is secured with adhesive. The underlying support member 6 is placed in a die, which stamps or forms a plurality of openings shaped and dimensioned to receive the one-way insert portion of the fasteners. The pad assembly 498 is then secured to the support member by inserting the fasteners into the openings with a one-way attachment and pressing the pad assembly and seat support together.

Rather then the exemplary dimples, other signage or indicia can be embossed into the chair seat and/or back, including for example and without limitation the name of a company, department or individual, or other pleasing designs.

In alternative embodiments, the pad assembly is secured to the seating structure with adhesives, mechanical fasteners such as screws and the like, or combinations thereof. In one embodiment, an anchor member, such as a screw or the insert portion of the "Christmas tree" fastener 505 is in-molded with the attachment portion extending from a rear or bottom side thereof. The attachment portion is received in mating holes (not shown) formed in the seating structure, for example with a snap-fit or by threading a nut thereon, so as to secure the pad to the seating structure.

Figure 3:
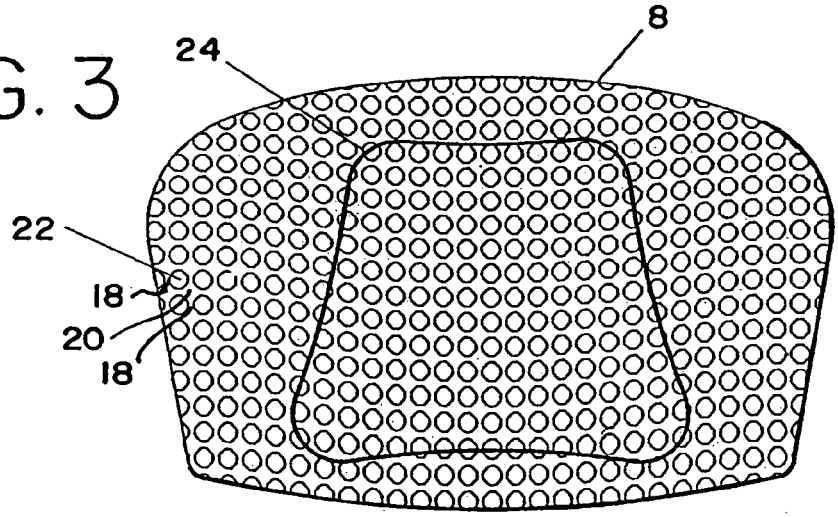
FIG. 3 is a front view of one embodiment of a back support.
Figure 4:
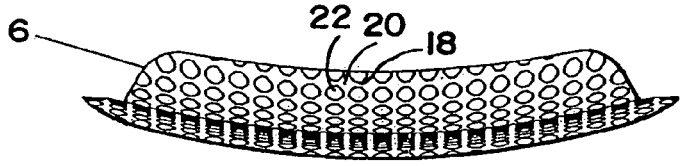
FIG. 4 is a front view of one embodiment of a seat support.
Figure 5:
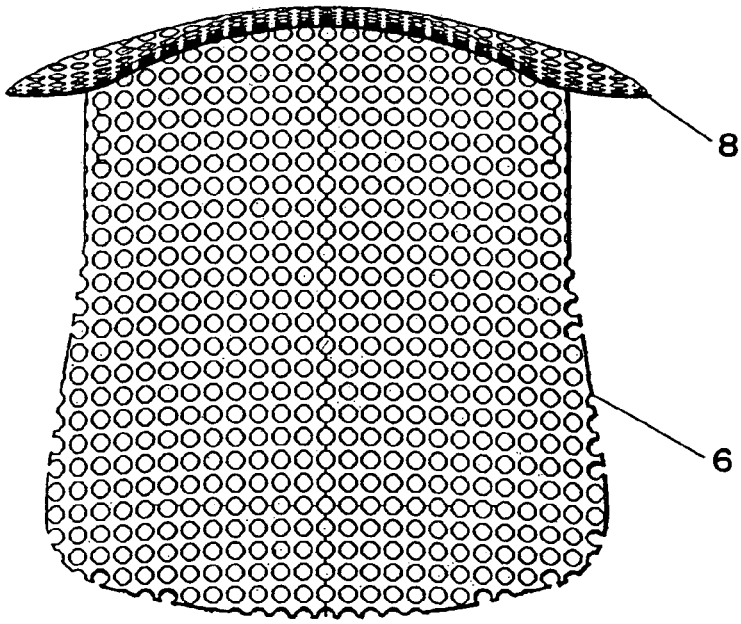
FIG. 5 is a top view of the back support and seat support shown in FIGS. 3 and 4.
Figure 6:
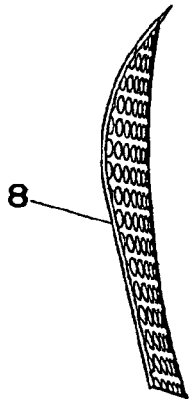
FIG. 6 is a side view of the back support shown in FIG. 3.

Now referring to FIGS. 3 and 4 it can be seen that the seating surface 6, 8 is comprised of a plurality of webs 18, thicker sections configured as bosses/platforms 20, and openings 22. It is through the various geometric combinations of these three basic elements that improved seating comfort is achieved. This configuration or matrix is referred to as being "cellular" in nature, for it is a matrix of individual, independently acting cell structures. In one embodiment, all three of these structures are formed economically from one type of material and process such as plastic and molding. Any of the common molding methods known could be used including, but not limited to, injection, blow, or roto-molding. Additionally, through the use of advanced plastic injection molding techniques known to those in the industry as "two-shot" injection molding and "co-injection" molding, these elements may be selectively made from two or more types of materials to further control the overall engineering attributes of the structure.

For example, a web material can be made of a more flexible material than a boss material. In addition, an uppermost, body-supporting surface or layer of the boss structure can be made of a relatively resilient, softer material to cushion the body of the user, with a more rigid substrate underlying the contact bead. Alternatively, an overlay, such as a gel material, can be applied over the entire surface of the seating structure. Additionally, these various structures could be realized through other manufacturing techniques such as lamination, stamping, punching etc.

Figure 16:
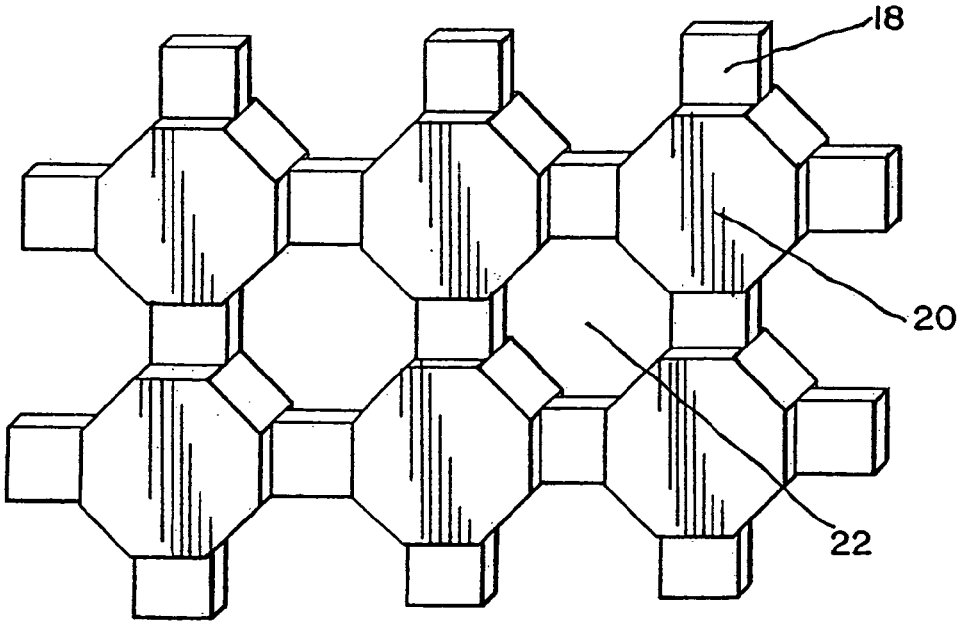
FIG. 16 is a partial perspective view of one embodiment of a support structure.

Referring to FIG. 16, an enlarged view of a portion of the matrix shows that the webs 18 function as thinner or more flexible interconnecting elements to the thicker or more rigid bosses/platform sections 20. It is through these webs that flexure occurs, allowing movement of one thicker or more rigid section relative another thicker section. Of course, it should be understood that the web structures and boss structures can have the same thickness. Depending upon the final geometry selected this movement may have several degrees of freedom.

For example, as shown in FIG. 16, the web structure 18 is predominantly flat in form. The web structure may act as a both a torsional flexure (occurring predominantly across the webs width) for the thicker or more rigid bosses/platform sections, as well as a linear flexure along its length. Additionally, depending on the characteristics of the materials used, the web may stretch or elongate in length, allowing another form of displacement.

Figure 14:
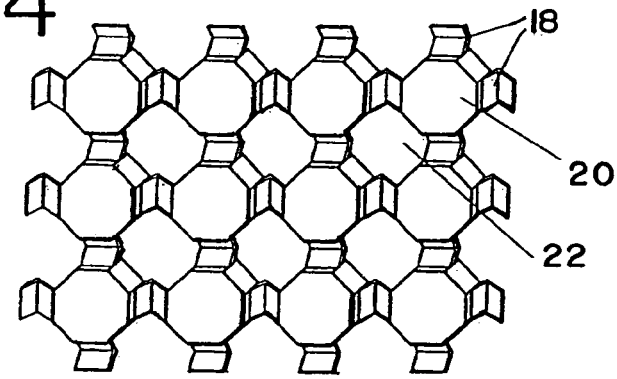
FIG. 14 partial view of a seating support structure configured with web structures having a V-shaped cross-section.
Figure 15:
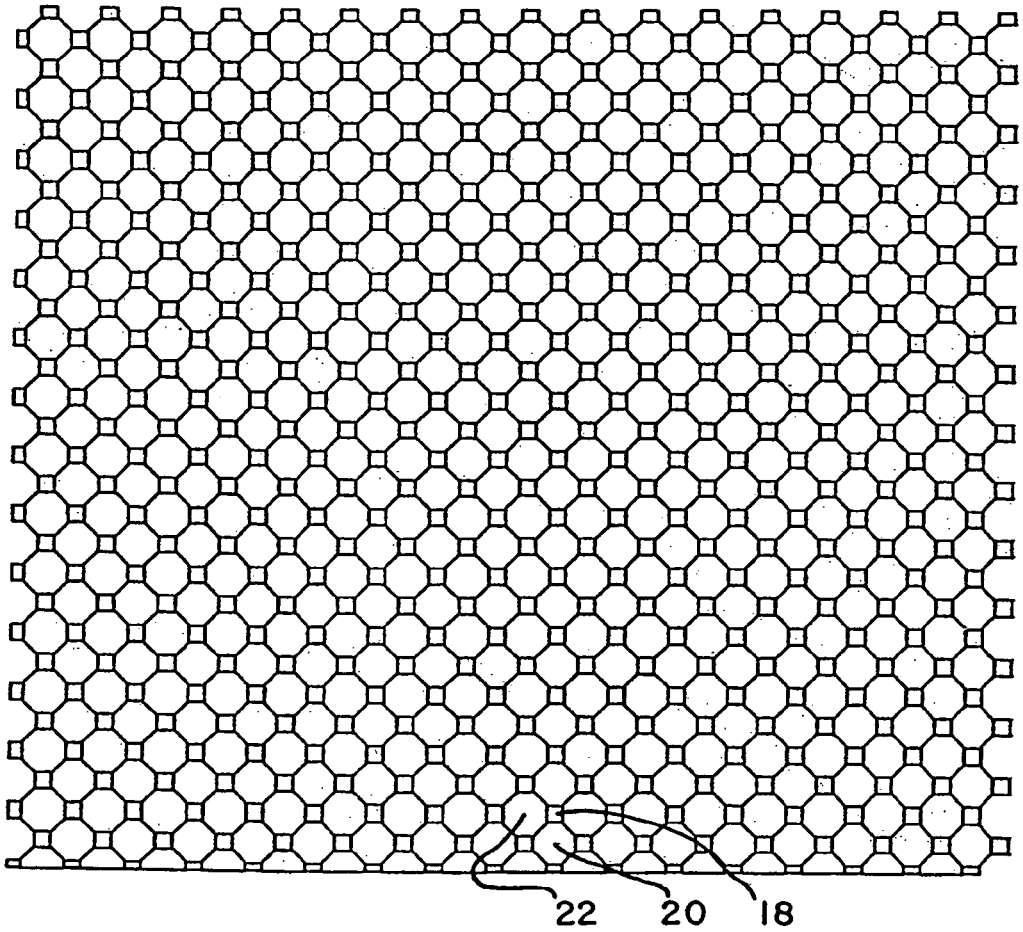
FIG. 15 is a partial plan view of a support structure.

Alternatively, the web can be formed as shown in FIG. 14. In this embodiment, the web structure 18 is formed as a V, or an inverted V. The web structure 18 may exhibit the preceding characteristics as well as act as a living hinge allowing the angle formed by the faces of the V to change. This would result in a different set of degrees of freedom of one boss/platform section relative to another.

Figure 13:
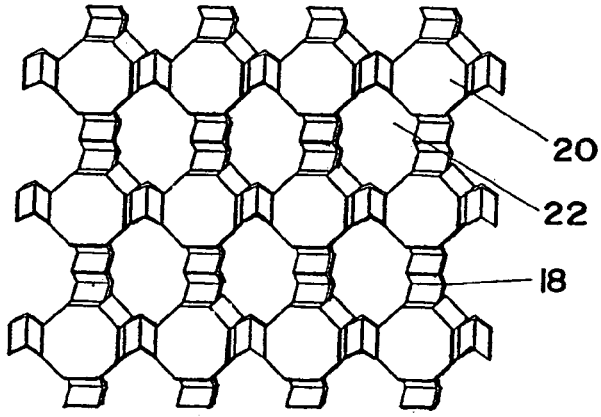
FIG. 13 is a perspective partial view of a seating structure configured with some web structures having a V-shaped cross-section and some web structures having a W-shaped cross-section.

FIG. 13 shows a configuration predominantly the same as FIG. 14. Of note is the fact that the web structures may also take the form of a W or inverted W, which could further increase flexibility. Also of note is the fact that the web structures can be varied, with V-shaped web structures used in some areas or directions and W-shaped web structures used in other areas or directions. FIG. 13 shows W-shaped web structures running vertically and V-shaped web structures running horizontally in the example section. In addition to V-shaped and W-shaped webs structures, it should be understood that other forms are also envisioned, and so a number of varied geometric possibilities exist for the web geometry as well as the bosses/platforms and holes.

All of the aforementioned forms of webs, and other contemplated designs, all may share common types of flexure of varying degrees. It should be noted that the terms "thinner" and "thicker" sections are interchangeable with the terms "sections having greater" or "sections having less" flexibility relative to each other.

Figure 20:
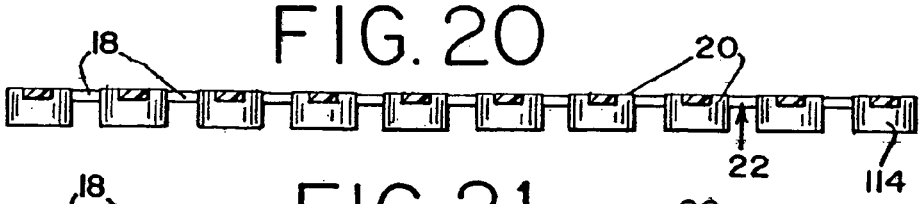
FIG. 20 is a side sectional view taken along cutting line 20-20 of FIG. 19.
Figure 21:
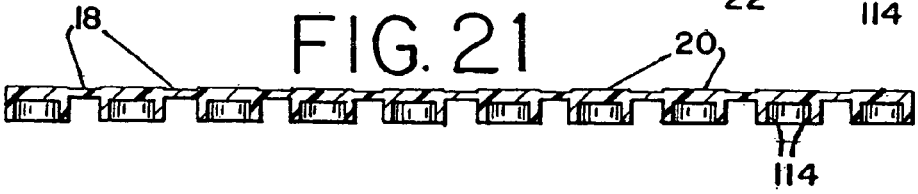
FIG. 21 is a side sectional view taken along cutting line 21-21 of FIG. 19.

Cross-sectional area or thickness is but one way of varying the relative rigidity of the webs vs. the bosses or platforms. Another way is to provide the boss structures or platforms with rigidizing returns, ribs or walls, as shown in FIGS. 20 and 21, so that structurally the bosses or platforms are stiffer than the joining webs. As shown in FIG. 77, a ring 631 of material is added to the bottom of the boss structure to make the structure stiffer.

Additionally, as stated earlier, the materials selected could play an important role in the performance of the geometry. For example, if the material selected is an elastomeric material, such as a urethane, the webs 18 could each stretch or elongate a small amount resulting in or allowing deflection or displacement of the thicker or more rigid bosses/platform sections 20. Another flexible material that may be suitable is Hytrel® polyester elastomer by Dupont. Other suitable materials are polypropylene (e.g., unfilled), PBT, etc. Since each area or boss structure with connecting web structures responds individually, the entire seating surface may emulate a soft cushioning effect to the occupant. For example, suitable materials having a flex modulus of between about 30 and 180 ksi, in one embodiment between 30 and 60 ksi, in one embodiment between about 75 and 85 ksi, and in one embodiment about 120 ksi. Various materials used for the seat and back, including their properties, are provided in Tables 1A -1C as follows:

TABLE 1A

MATERIALS AND PROPERTIES

| | | Tradename | | | | | | | |
|---|---|---|---|---|---|---|---|---|---|
| | | Profax | Profax | Casnano | Akulon | Hytrel | Hytrel | Hytrel | Texin |
| Grade | | SR549M | SB891 | | K223-TP4 | 6356 | 7246 | 8238 | DP7-1173 |
| Manufacturer | | Basell | Basell | Nobel | DSM | DuPont | DuPont | DuPont | Bayer |
| Type | | PP | PP | 33% Nano PP | Nylon | TPE | TPE | TPE | Polyester TPU |
| Specific Gravity | | 0.902 | | | 1.06 | 1.22 | 1.25 | 1.28 | 1.17 |
| Flex Mod | ksi | 157 | 203 | | 247 (74.7*) | 48 | 83 | 175 | 61 |
| Tensile Strength | psi | 4400 | 3916 | | 7330 (3300*) | 5950 | 6650 | 7000 | 6000 |
| Elongation | % | 13 | 6 | | 50 (>100*) | 420 | 360 | 350 | 300 |
| Durometer | ShoreD | N/A | N/A | | N/A | 63D | 72D | 82D | 65D |
| Notched Izod Impact (73° F.) | ft-lb/in | 1.2 | 1.3 | | 10.5 (15*) | NB | 3.9 | 0.8 | |
| MFI | g/100 min | 11 | 35 | | | 8.5 | 12.5 | | |

TABLE 1B

MATERIALS AND PROPERTIES

| | | Tradename | | | | | | | | |
|---|---|---|---|---|---|---|---|---|---|---|
| | | Profax | Fiber fill | Akulon | Profax | Amitel | Crastin | Adflex | Formion | Forte |
| Grade | | SG702 | J68-20 | K224-PG2U | SR857M | EL630 | ST820 | Q100F | FI200 | 18CPP091 |
| Manufacturer | | Basell | DSM | DSM | Basell | DSM | DuPont | Basell | A. Schulman | Noble |
| Type | | PP | 20% gf PP | 13% gf Nylon | PP | TPE | PBT | Polyolefin | Ionomer/ Nylon | PP w/Nano |
| Specific Gravity | | 0.9 | 1.04 | 1.18 | 0.902 | 1.23 | 1.22 | .89 | 1.04 | — |
| Flex Mod | ksi | 160 | 384 | 566 | 140 | N/A | 230 | 12 | 175 | — |
| Tensile Strength | psi | 3000 | 6090 | 13100 | 4000 | 4350 | 5100 | 725 | 5950 | — |
| Elongation | % | 5 | 4 | 4 | 13 | 350 | 50 | 400 | 270 | — |
| Durometer | ShoreD | N/A | N/A | N/A | N/A | 63D | N/A | 30D | — | — |
| Notched Izod Impact (73° F.) | ft-lb/in | 4.4 | 2.3 | 2.7 | 1.5 | NB | 27.6 | — | — | — |
| MFI | g/100 min | 18 | 12 | | 35 | 30 | | 0.6 | — | — |

TABLE 1C

MATERIALS AND PROPERTIES

| | | Tradename | | | | | | | | | |
|---|---|---|---|---|---|---|---|---|---|---|---|
| | | 85% SR 549M Profax, 15% Kraton-G2705 | Flexomer | Styrolux | PP | Styrolux | Styrolux | Exxon PP | Exxon PP | Achieve | Mon-prene |
| Grade | | | DFDB 1085 NT | 33G3 | PP 3482-01 | 684D | 3G 33 | PP 9505E1 | PP 9574E6 | 1635E1 | MP2239 |
| Manufacturer | | Basell | Dow | BASF | A. Schulman | BASF | BASF | Exxon | Exxon | Exxon | Teknor Apex |
| Type | | 85% PP/ 15% SEBS | VLDPE | Styrene-Buta-diene | PP | Styrene-Buta-diene | Styrene-Buta-diene | PP | PP | PP | TPE |
| Tradename | | | 10% Flexomer 90% SR549 | 80% Styrolux 20% Styroflex 2G66 | | | | | | | |
| Specific Gravity | | 0.895 | Material Blend | Material Blend | .900 | 1.01 | 1.01 | | 0.900 | 0.900 | |
| Flex Mod | ksi | 88 | Material Blend | Material Blend | 280 | 170 | 260 | 166 | 145 | 232 | |
| Tensile Strength | psi | 3302 | Material Blend | Material Blend | 5700 | 3700 | 4100 | 4700 | 4100 | 5100 | |
| Elongation | % | | Material Blend | Material Blend | 10 | 250 | 100 | 11 | 14 | 7 | |
| Durometer | ShoreD | | Material Blend | Material Blend | 100R | 68D | 69D | | 87R | | |
| Notched Izod Impact (73° F.) | ft-lb/in | | Material Blend | Material Blend | 0.5 | 0.8 | <44> | | 2 | 0.6 | |
| MFI | g/100 min | | Material Blend | Material Blend | NA | <89-90> | <91.5> | 6 | ? | 6-8% | NA |
| Specific Gravity | | | Material Blend | Material Blend | 5 | 11 | 10 | 30 | 12 | 29 | |

As also mentioned earlier, it is possible through advanced molding techniques or fabrication, to use more than one type of molded material in a finished product. One such technique is to mold a part in one material in one mold and then place the part into another mold that has additional cavity area, and then fill that mold with another type of material. So it may be advantageous to for example to mold all the webs and connective areas in one material in one mold, and then to transfer the part to another mold to form all the thicker or more rigid bosses/platform sections and other features in another material.

In one embodiment, openings 22 otherwise referred to as holes or areas lacking material, are formed in and/or between the web structures and boss structures so as to allow airflow through the seating structure and thereby reduce the amount of heat build up on the seating surface. These holes 22, or areas with no material, further serve to allow the desired movement of the webs and the thicker sections. As shown, the holes are octagons, but any shape found suitable could be used, including circular holes, Y-shaped holes, X-shaped holes and V-shaped holes (when viewing the holes or openings in a direction substantially perpendicular to the support surface of the seating structure). In one embodiment, it is desirable to maintain the smallest dimension of the hole or opening less than 8 mm, such that an 8 mm probe cannot be passed therethrough.

Figure 17:
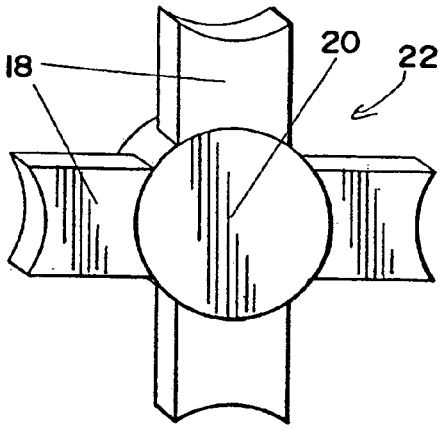
FIG. 17 is an enlarged partial perspective view of another embodiment of a support structure.
Figure 18:
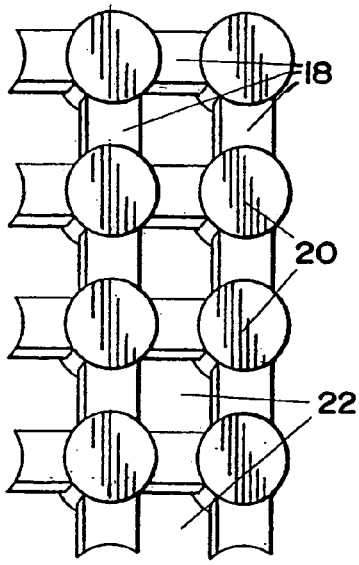
FIG. 18 is a partial perspective view of one embodiment of a support structure.
Figure 19:
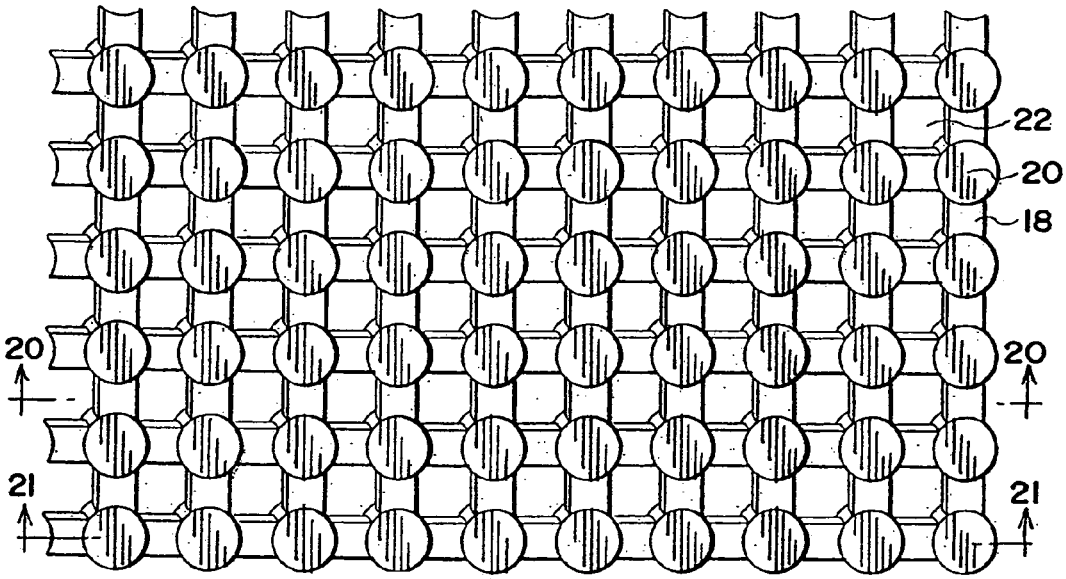
FIG. 19 is a partial perspective view of one embodiment of a support structure.

Referring to FIG. 17, a single structural relationship is depicted, showing another form the web structure may assume. The difference of this form of web structure can be appreciated by referring to FIGS. 19, 20, and 21. Rather than the bosses/platforms 20 being thicker in cross-sectional than the web connecting members 18, the bosses/platforms are provided with structural returns or reinforcing ribs 114. In this way, the bosses/platforms will have a greater structural rigidity relative to their interconnecting web members. FIG. 20 which is a sectional view taken along cutting line 20-20 of FIG. 19 and FIG. 21 which is a sectional view taken along cutting line 21-21 of FIG. 19, show that the bosses/platforms 20 have reinforcing returns 114 that make the bosses/platforms more rigid than the connecting web structure. As shown the return wall 114 on the bosses/platforms forms a ring. This is not a necessity though, the returns could be as simple as a single rib or as complex or as many returns as are needed. In one embodiment, the recesses formed in the bottom of various, selected boss structures are filled, so as to strategically stiffen the web structure.

One aspect of this invention is the ability of the designer/manufacturer to precisely control and alter all aspects of the deflection of the seating surface from area to area simply and controllably. In contrast, when a designer/manufacturer specifies a foam density (firmness/softness) for a cushion, the entire cushion may be compromised by that unifying density. That is not the case with this invention though.

Biomapping is datum created through the comparison of body contours of a given population, or the datum created through the comparison of contact forces exerted between a seating surface and the occupant. Although exercises in generating data have been ongoing for several years, the designer is still limited to selecting generic contours, then hoping that the foam would resolve the final fitting issues. With the present invention, however, it is possible to effectively use the data generated by biomapping to precisely control of the geometry (web-connectors, bosses/platforms, and openings) and thus the engineering properties area by area over the entire seating surface, so that each sector-area is functionally optimized.

So it should be appreciated that by varying the size and shape of the holes, the location of holes, the types of webs and their relative thickness, geometry and size, contour and relative thickness of the boss structures or their geometry, and the various materials, a designer can custom design each area of a seating surface to perform as desired. FIG. 3 shows how the seating surface could be divided into zones; one such zone is indicated by area 24. This could be the zone of greatest flexibility. It should also be appreciated the advantage this offers the designer when he/she is trying to economically manufacture an item from a material such as plastic, as well as the increased comfort that the user will experience.

Figure 68:
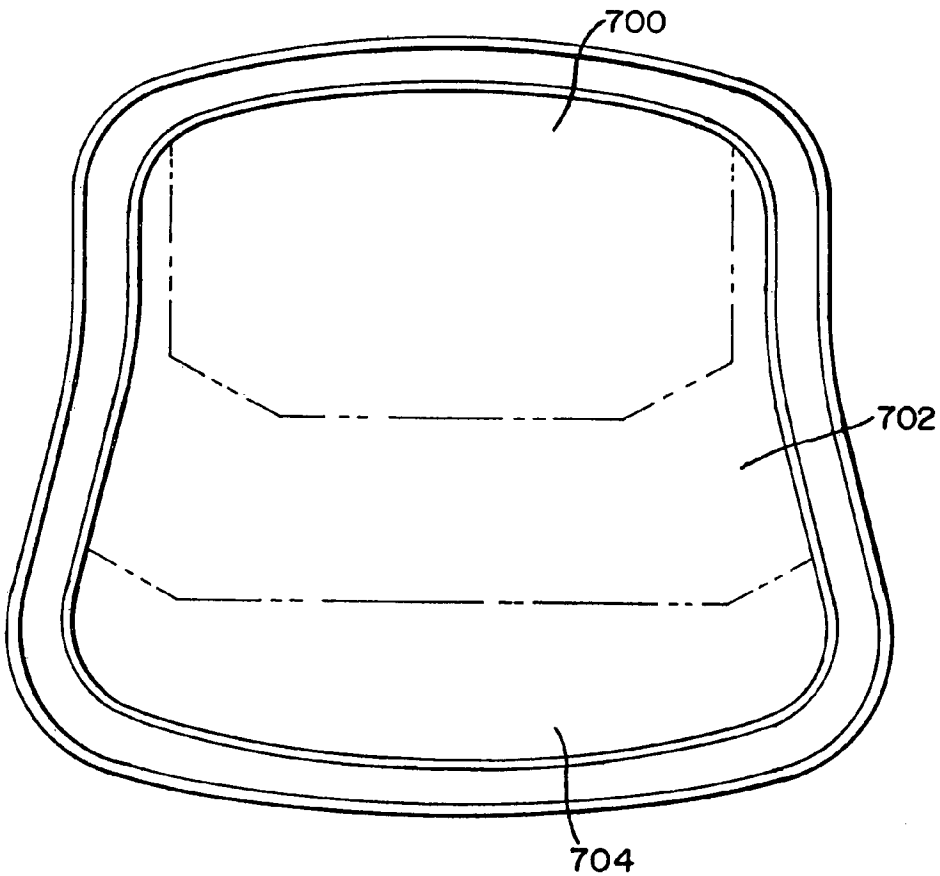
FIG. 68 is a top view of one embodiment of a seat member.

Referring to FIG. 68, the seating surface is divided into three zones. In one embodiment, a rear zone 700 includes web structures having a loop depth of 0.25 inches with no rings. A middle zone 702 has web structures with loop depths transitioning from 0.25 inches to 0.18 inches with no rings. A front zone 704 has web structures with a loop depth of 0.18 inches with rings. In this way, the rear zone is the most flexible, with the middle zone being less flexible and the front zone being the least flexible.

Figure 69:
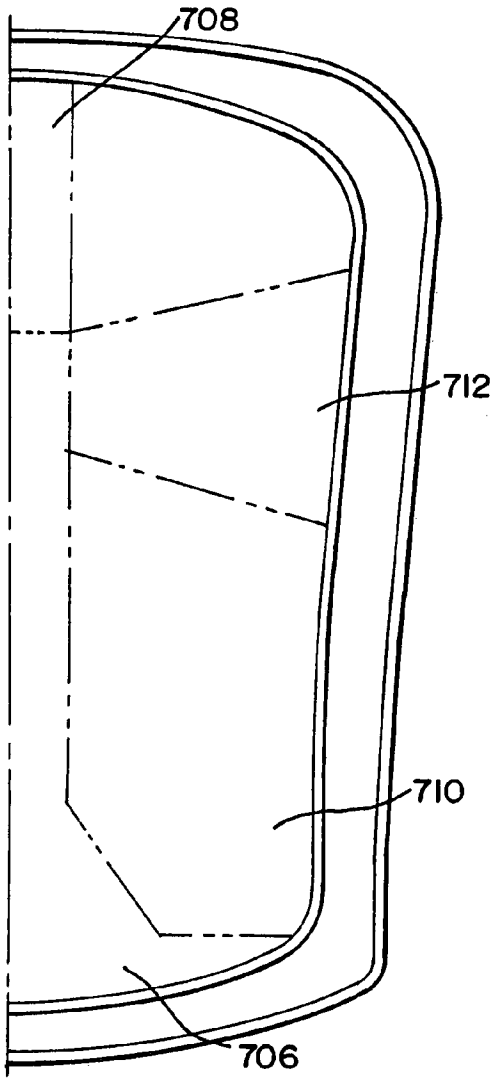
FIG. 69 is a top view of one embodiment of a back member.

Referring to FIG. 69, one half of the back structure is divided into five zones, with the other half being symmetrical. In one embodiment, an upper middle zone 708 includes web structures having a loop depth of 0.18 inches with no rings. A lower middle zone 706 has web structures with a loop depth of 0.18 inches with rings. A lower side zone 710 has web structures with a loop depth of 0.31 inches with no rings. A middle side zone 712 has web structures with a loop depth of 0.31 inches with rings. An upper side zone 710 has web structures with a loop depth of 0.31 inches with no rings. In this way, the upper and lower side zones are the most flexible, with the middle side zones being less flexible, the upper middle zone being less flexible yet and with the lower middle zone being the least flexible.

Figure 43:
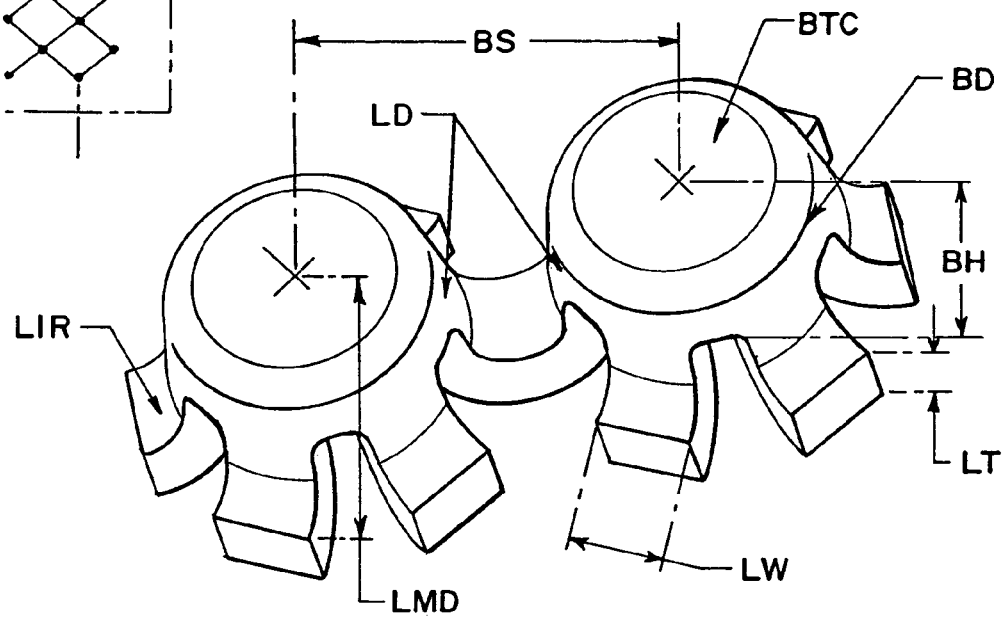
FIG. 43 is a partial schematic view of adjacent boss structures with one embodiment of connecting web structures.
Figure 44:
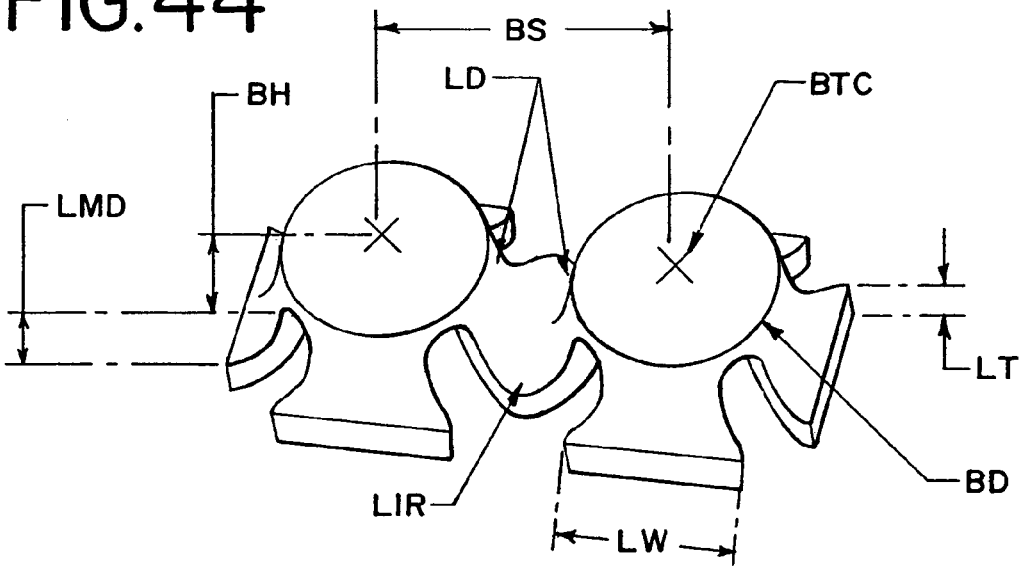
FIG. 44 is a partial schematic view of adjacent boss structures with an alternative embodiment of connecting web structures.

Referring to FIGS. 43 and 44, various dimensional characteristics of two embodiments of a web and boss structure (4-loop design and 6-loop design) are illustrated. It should be understood that the term "loop" as used herein refers to the web structure. The dimensions of various embodiments are provided in Tables 2A and 2B as follows:

TABLE 2A

| | | BOSS AND WEB DIMENSIONS | | | | |
|---|---|---|---|---|---|---|
| | | Seat Plaque | P0.4 | P0.5 | P0.75 (P0.5) | P9.9 |
| Boss | (BD) Diameter: | .625" | .625" | .625" | .625" | .625" |
| | (BTC) Top Curve: | .400" rho | .400" rho | .400" rho | .400" rho | .400" rho |
| | (BH) Height: | .222" | .230" | .230" | .230" | .230" |
| | (BS) Spacing: | .875" | .875" | .875" | .875" | .875" |
| | (BT) Thickness: | .120" | .100" | .100" | .100" | .100" |
| Loop | (LMD) Min Depth: | .250" | .230" | .350" | .350" | .430" |
| | (LMD) Max Depth: | .430" | .230" | .350" | .350" | .430" |
| | (LT) Thickness: | .120" | .120" | .120" | .120" | .100" |
| | (LW) Width: | .312" | .312" | .312" | .312" | .560" |
| | (LIR) Inside Radius: | .092" | .096" | .096" | .096" | .096" |
| | (LBER) Bottom Edge Round: | N/A | N/A | N/A | N/A | N/A |
| | (LD) Loop Draft: | 10° | 10° | 10° | 10° | 10° |
| | (LCD) Cut Draft: | 5° | 5° | 5° | 5° | 5° |

TABLE 2B

BOSS AND WEB DIMENSIONS

| | | P1.0 | P1.45 | P1.75 (P1.5) | P1.9 (M1) |
|---|---|---|---|---|---|
| Boss | (BD) Diameter: | .600" | .600" | .375" | .460" |
| | (BTC) Top Curve: | Contour | Contour | Contour | Contour |
| | (BH) Height: | .230" | .230" | .092" | .080" |
| | (BS) Spacing: | .850" | .850" | .630" | .686" |
| | (BT) Thickness: | .160" | .160" | .140" | .140" |
| Loop | (LMD) Min Depth: | .180" | .180" | .140" | .180" |
| | (LMD) Max Depth: | .385" | .385" | .250" | .310" |
| | (LT) Thickness: | .160" | .160" | .140" | .140" |
| | (LW) Width: | .540" | .540" | .200" | .180" |
| | (LIR) Inside Radius: | .120" | .120" | .145" | .570" |
| | (LBER) Bottom Edge Round: | N/A | .062" | .020" | .060" |
| | (LD) Loop Draft: | 10° | 10° | 10° | 10° |
| | (LCD) Cut Draft: | 5° | 5° | 5° | 5° |

In various embodiments, the range of boss diameter (BD) is preferably between about 0.30 inches and about 0.80 inches, the boss spacing (BS) is preferably between about 0.50 inches and about 0.90 inches, the loop thickness (LT) is between about 0.08 inches and about 0.18 inches, the loop width (LW) is between about 0.06 inches and about 0.50 inches and the loop depth (LD-LMD) is between about 0.20 inches and about 0.70 inches.

Figure 35:
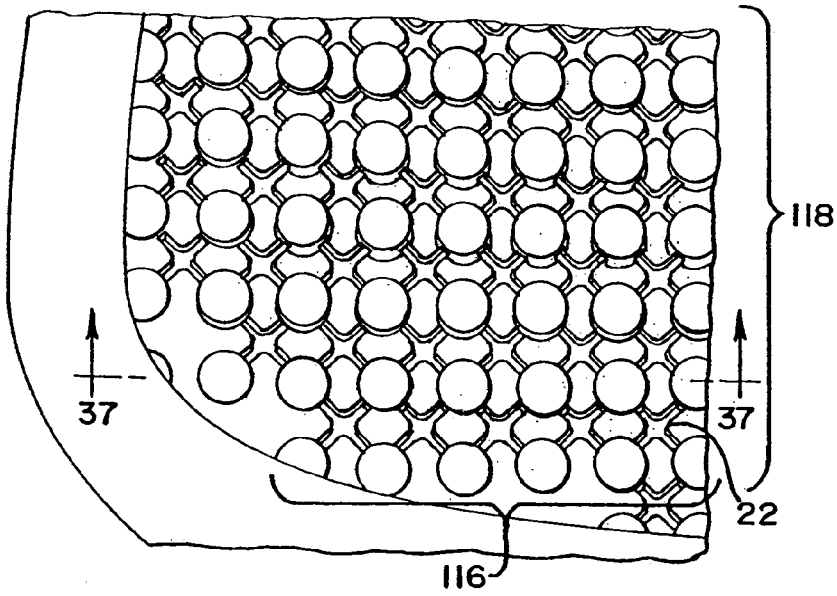
FIG. 35 is a top, perspective view of a portion of another embodiment of a support member.
Figure 36:
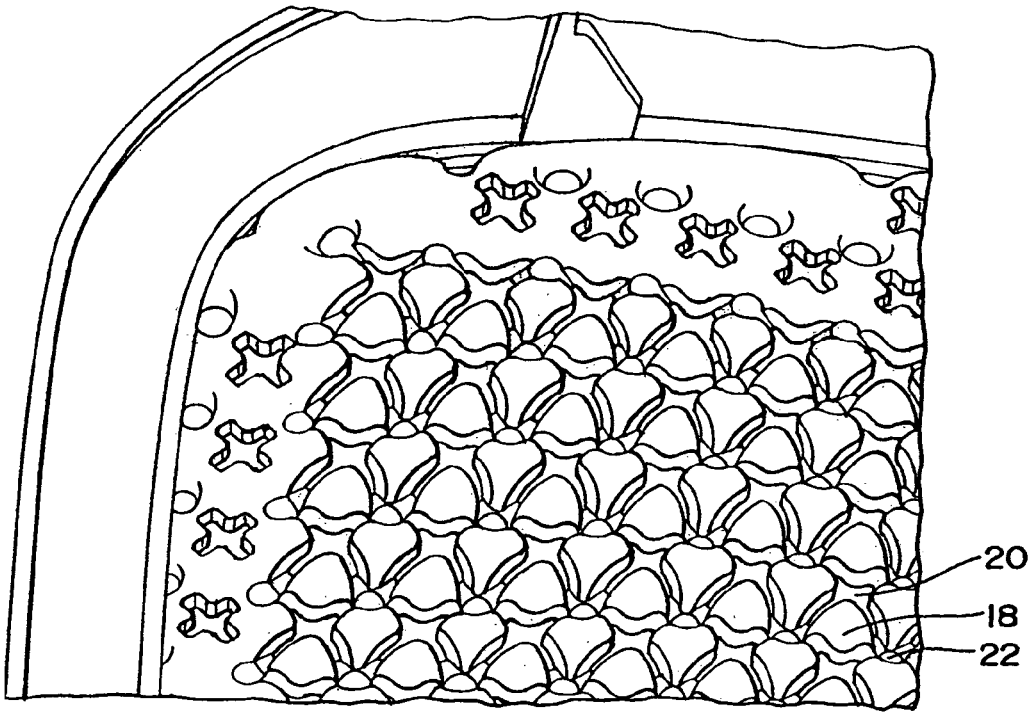
FIG. 36 is a bottom, perspective view of the support member shown in FIG. 35.
Figure 37:
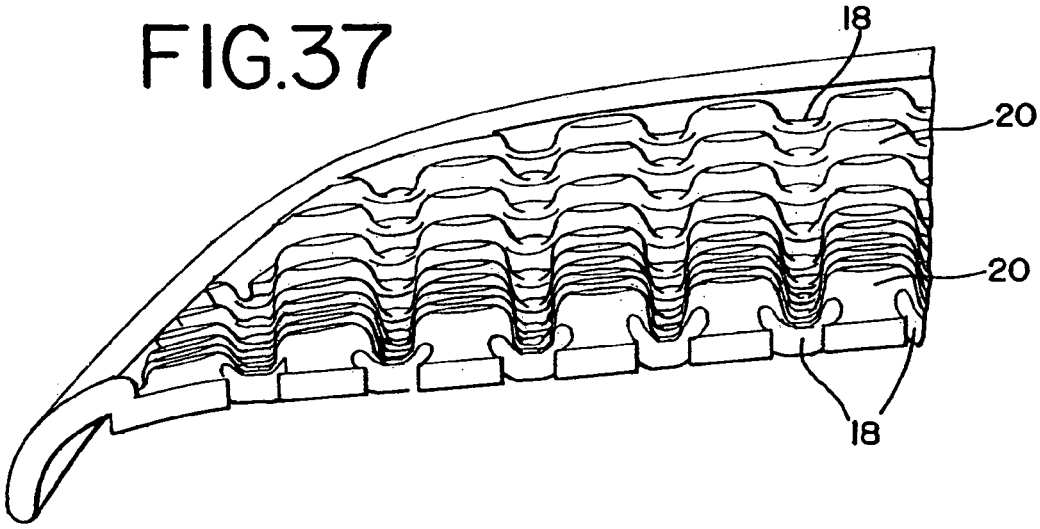
FIG. 37 is a cross-sectional view of the support member taken along line 37-37 of FIG. 35.

Referring to FIGS. 35-37, another embodiment of a support structure is shown as having a plurality of boss structures 20 arranged in a grid-like pattern of rows 116 and columns 118 of boss structures. A plurality of web structures 18 connects adjacent boss structures 20. Preferably, the boss structures have a circular cross-section when viewed from a direction substantially perpendicular to the support surface defined by the plurality of boss structures. However, the boss structures can have any desired shape. In one embodiment, the width of the web structures varies, with it being the greatest at the middle thereof, where the hinge apex is located. This structure provides an X-shaped opening 22 between adjacent web structures connected to adjacent boss structures 20.

Figure 30:
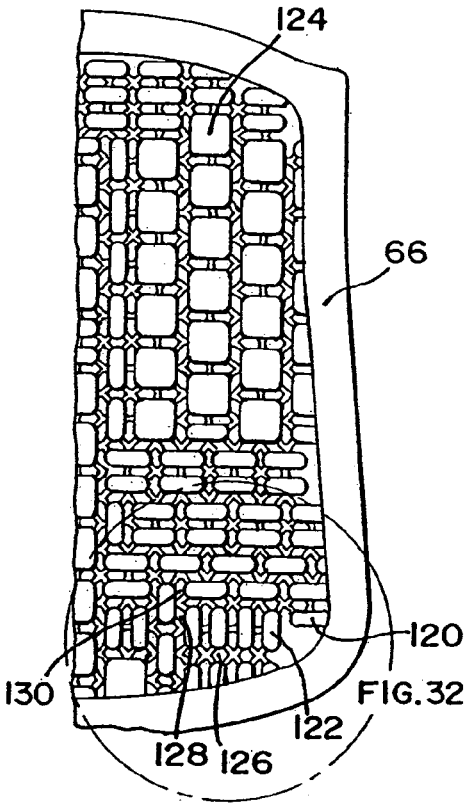
FIG. 30 is a partial front view of one embodiment of a back support member.
Figure 31:
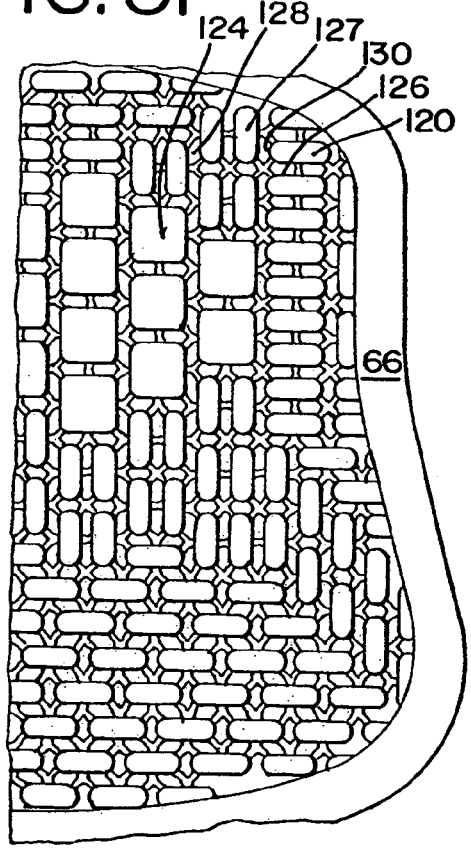
FIG. 31 is a partial top view of one embodiment of a seat support member.
Figure 32:
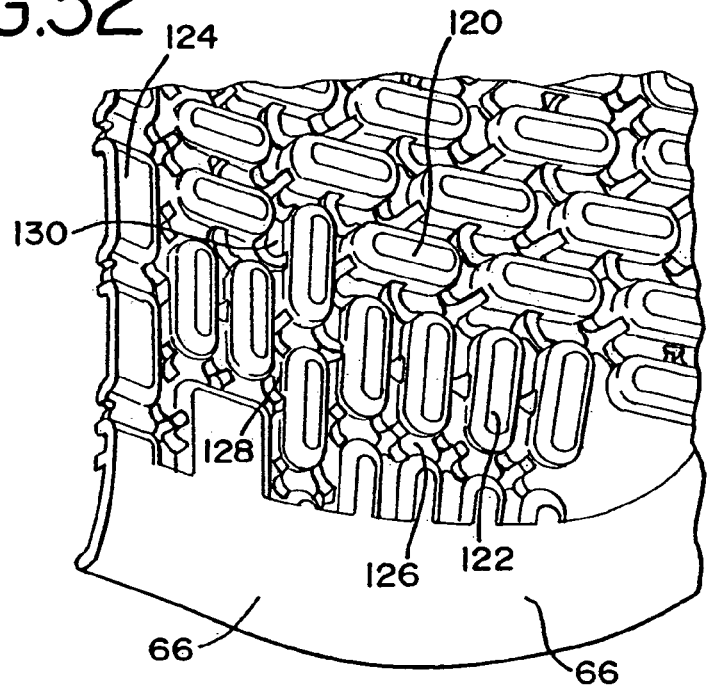
FIG. 32 is an enlarged perspective view of the back support member taken along line 32 in FIG. 30.
Figure 33:
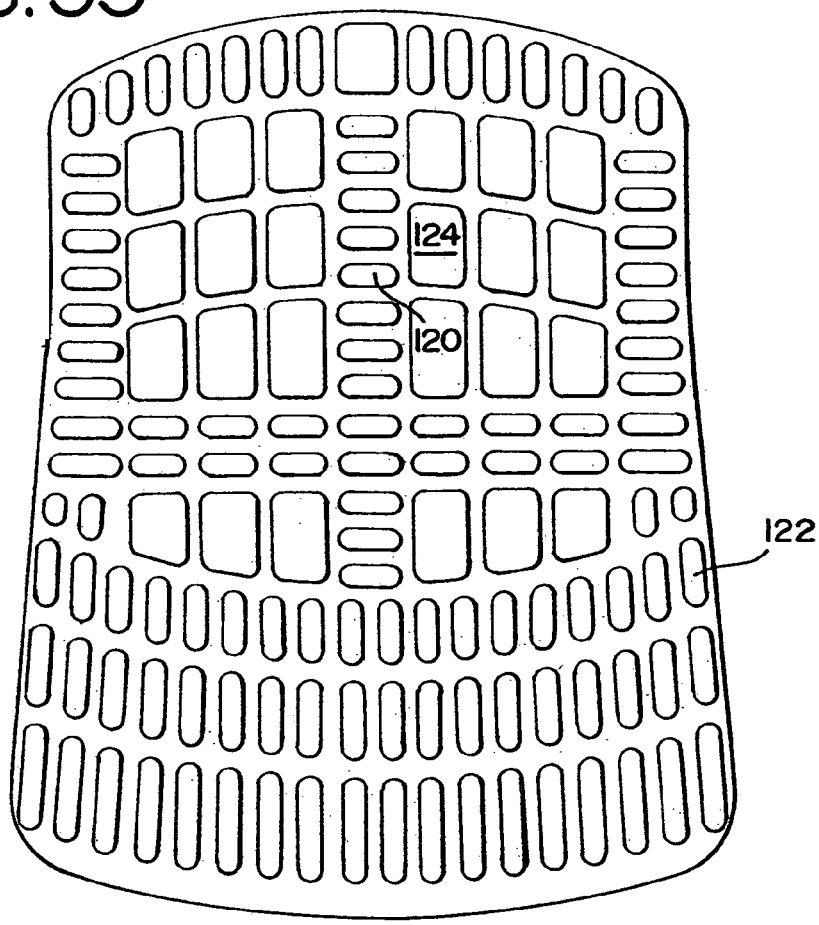
FIG. 33 is a front view of another embodiment of a back support member.

Referring to FIGS. 30-34, other embodiments of support structures are shown with the boss structures 20 and web structures 18 arranged in different patterns. In various embodiments, shown in FIGS. 30 and 33, a back support includes a plurality of laterally (horizontally) elongated boss structures 120, a plurality of longitudinally (vertically) elongated boss structures 122, and a plurality of larger rectangular (shown as substantially square) boss structures 124. In one embodiment, the larger boss structures 124 have a width and height approximately equal to the respective lengths of the horizontally and vertically oriented boss structures 120, 122. The various boss structures 120, 122, 124 can be arranged in various patterns and configurations, as shown for example in FIGS. 30 and 33. It should be understood that the term "substantially rectangular" includes four-sided shapes, even though one or more sides (ends) or corners thereof may be rounded, such that they have a generally obround shape or capsule shape. The boss structures may also be tetragonal, trapezoidal or formed as parallelograms as shown for example in FIGS. 33 and 34. As shown in FIGS. 30 and 33, larger boss structures 124 are positioned in the upper regions of the back support adjacent the shoulders of the user. The embodiment of FIG. 30 further includes larger boss structures 124 vertically positioned along the middle of the back support to support the spine of the user. The various size and orientations of the boss structures and openings provides various degrees of flex and support in desired locations. For example, the larger boss structures provide a greater surface area in contact with the user and assist in distributing the loads of the user. In addition, the orientation can indicate a direction of travel of the user relative to the seating surface, for example by providing longitudinally (or laterally) elongated boss structures on the seat.

As shown in FIGS. 30, 32 and 33, web structures 126, 128, 130 connect adjacent boss structures. When the boss structures are offset in the horizontal or vertical direction, the web structures 128, or a portion thereof (e.g. one or both sides), have a diagonal orientation. In one juncture, the web structure 130 has a linear diagonal side and a "peaked" side with two edges forming an angle or apex. Other web structures 126 are formed as described above, with a varying width, such that the openings formed between the web structures are either substantially X-shaped (small or large) or V-shaped.

Preferably, the width is greater in the middle of the web structure of the hinge apex. The openings are not shown in FIG. 33, but would be formed between the respective web structures and boss structures as shown in FIGS. 30 and 32.

Figure 34:
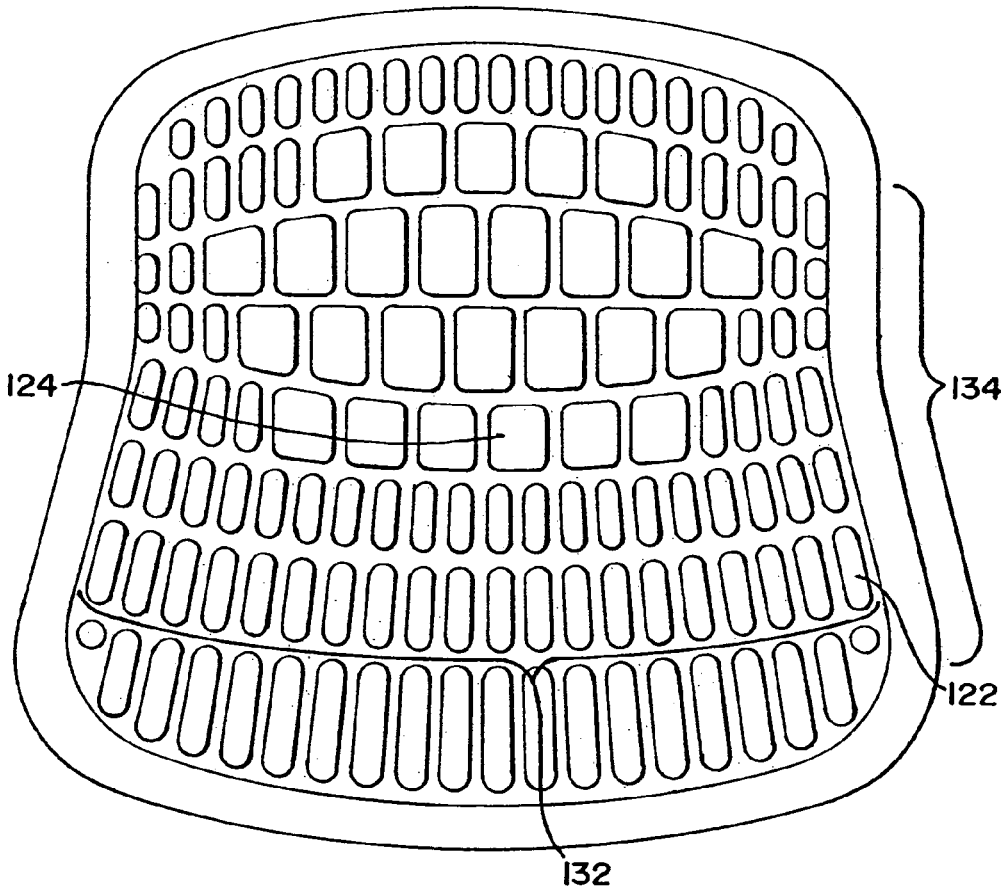
FIG. 34 is a top view of another embodiment of a seat support member.

Referring to FIGS. 31 and 34, a seat support also includes a plurality of laterally elongated boss structures 120, a plurality of longitudinally elongated boss structures 122, and a plurality of larger rectangular (shown as substantially square) boss structures 124. In one embodiment, the larger boss structures 124 have a width and height approximately equal to the respective lengths of the laterally and longitudinally oriented boss structures. The various boss structures can be arranged in various patterns and configurations, as shown for example in FIGS. 31 and 34. For example, as shown in both embodiments, larger boss structures are positioned in the rear portion of the seat adjacent the buttock of the user, while the front portion is configured with smaller longitudinally extending boss structures (FIG. 34) or smaller laterally extending boss structures (FIG. 31).

As shown in FIGS. 31 and 34, web structures 126, 128, 130 connect adjacent boss structures 120, 122, 124. When the boss structures are offset in the horizontal or vertical direction, the web structures 128, 130, or a portion thereof, again have a diagonal orientation. Other web structures are formed as described above, with a varying width, such that the openings formed between the web structures are either substantially X-shaped (small or large) or V-shaped. The openings are not shown in FIG. 34, but would be formed between the respective web structures and boss structures as shown in FIG. 31.

As shown in FIGS. 33 and 34, the boss structures 122 can be arranged in a generally curved array 132 or row in the lateral direction. For example, as shown in FIG. 34, the boss structures can be angled outwardly from the back to the front of the boss structure, and gradually straightened as one moves along the array from the outside in. In the rear portion of the seat as shown in FIG. 34, or at the top of the back as shown in FIG. 33, the length of the boss structures 122 within a particular row or array can be varied to provide the curved configuration, or the boss structures can be longitudinally offset. Of course, it should be understood that arrays 134 or columns of boss structures extending in the longitudinal direction can also be curved, as shown in FIGS. 33 and 34, to form or follow a contour, for example the contour of the outer peripheral frame. The curvature can be achieved by orientation (e.g., angling of the boss structures), by altering the relative width of the boss structures within the columns, or by adjusting the lateral offset of the boss structures relative to each other.

Figure 40:
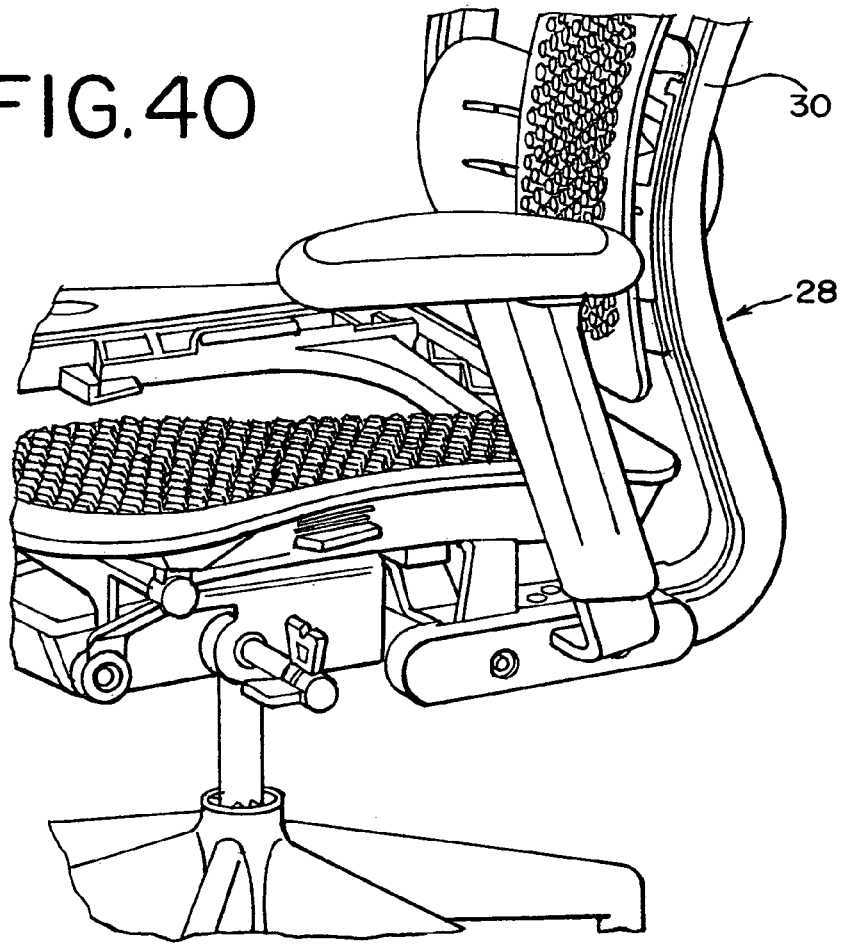
FIG. 40 is a partial front perspective view of one embodiment of a chair.
Figure 41:
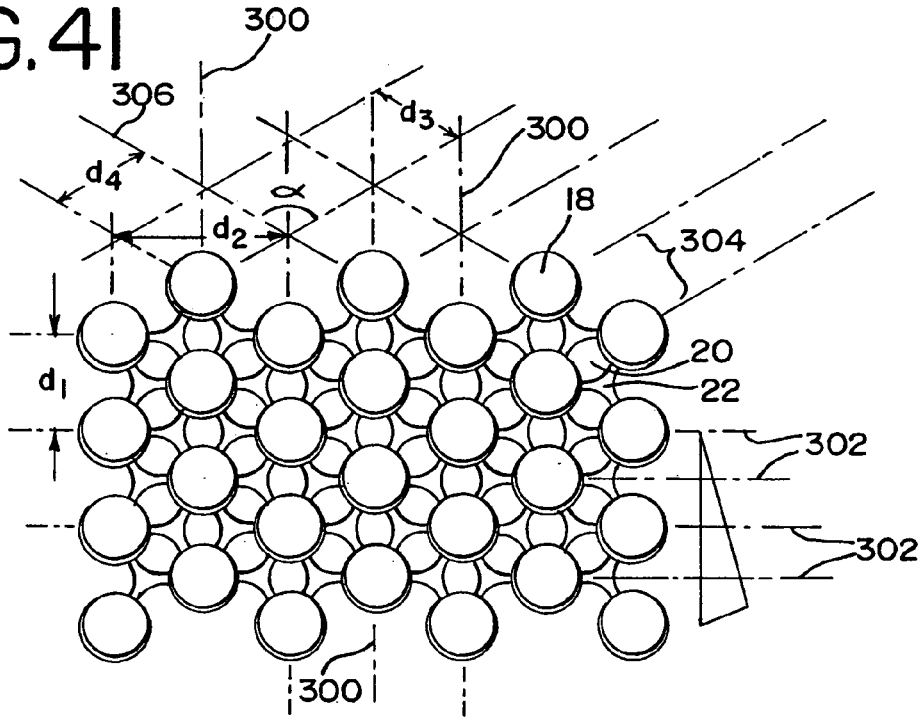
FIG. 41 is plan view of a portion of another embodiment of a support member.

Referring to FIGS. 40 and 41, another suitable pattern of boss structures are shown. In this embodiment, the boss structures can be thought of as being arranged in substantially perpendicular rows 300 and columns 302 extending in first and second directions respectfully, or oblique rows 304 and columns 306 extending in first and second directions respectfully and defining an oblique angle α therebewteen. In this way, it should be understood that the rows and/or columns could extend in any direction, including but not limited to the longitudinal/lateral directions, diagonal directions and vertical/horizontal directions. For example, in one embodiment, the rows/columns 300 run up and down, while the rows/columns 302 run side-to-side.

With respect to the first way of characterizing the pattern, adjacent rows 300 of boss structures 20 are offset or staggered in the first direction. Accordingly, the boss structures 20 in adjacent rows 300 define different columns 302 of boss structures 20. In essence, the boss structures of every other row 300 form and define the columns 302. In addition, the boss structures within each row 300 are spaced a first maximum distance d1 in the first direction, while the boss structures within each column 302 are spaced a second minimum distance d2 in the second direction, with the second distance d2 being greater than the first distance d1. The boss structures within each row 300 are connected with web structures 18, while the boss structures within each column 302 are not directly connected to each other with web structures. Rather, the boss structures in adjacent columns 302 are connected with diagonal web structures. As such, each boss structure is connected to other adjacent boss structures with six web structures.

Figure 42:
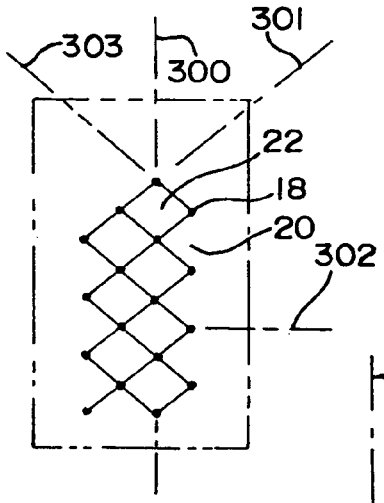
FIG. 42 is a plan view of a schematic of another embodiment of a support member.

Alternatively, as shown in FIG. 42, the web structures connecting adjacent boss structures within each column 300 can be omitted, such that each boss structure is connected to other adjacent boss structures with only four web structures. Alternatively, this construction can be thought of as being similar to that of FIG. 14, but with rows 301 and columns 303 extending in a diagonal direction, as opposed to the longitudinal and lateral directions of the rows and columns shown in FIG. 14. In the embodiment of FIG. 42, the boss structures in each column are preferably spaced the same distance as they are in each row, although it should be understood that the spacing between boss structures in each row could be greater or less than the spacing between boss structures in each column.

In a second way of characterizing the pattern shown in FIG. 41, adjacent rows 304 of boss structures 20 are offset or staggered in a first direction, and adjacent columns 306 of boss structures 20 are offset or staggered in a second direction. Accordingly, the boss structures 20 in adjacent rows 304 define at least in part the columns 306 of boss structures 20. In addition, in a preferred embodiment, the boss structures within each row 304 are spaced a first distance d3 in the first direction, while the boss structures within each column 306 are spaced a second distance d4 in the second direction, with the first and second distances d3, d4 being substantially the same. The boss structures within each row 304 are connected with web structures 18, while the boss structures within each column 306 are also connected with web structures. In addition, the boss structures in adjacent rows 304 and columns 302 are connected with diagonal web structures. As such, each boss structure is connected to other adjacent boss structures with six web structures.

Under either interpretation of the pattern of FIG. 41, the web structures 18 form and define Y-shaped openings, with the understanding that the three arms of the opening are preferably substantially the same size and shape. The boss structures 20 of FIG. 41 are preferably circular, and the web structures are preferably configured as V-shape or W-shape hinge structures. The web structures are preferably of a greater width in a middle portion thereof, with the opposite end portions of the web structures being joined to the boss structures. The boss structures preferably have a surface of area of more than 30%, in one embodiment between 30% and 50% and in one embodiment about 41%. The staggered arrangement of the boss structures provides for a tighter arrangement and greater total surface area that provides additional comfort to the user.

Figure 7:
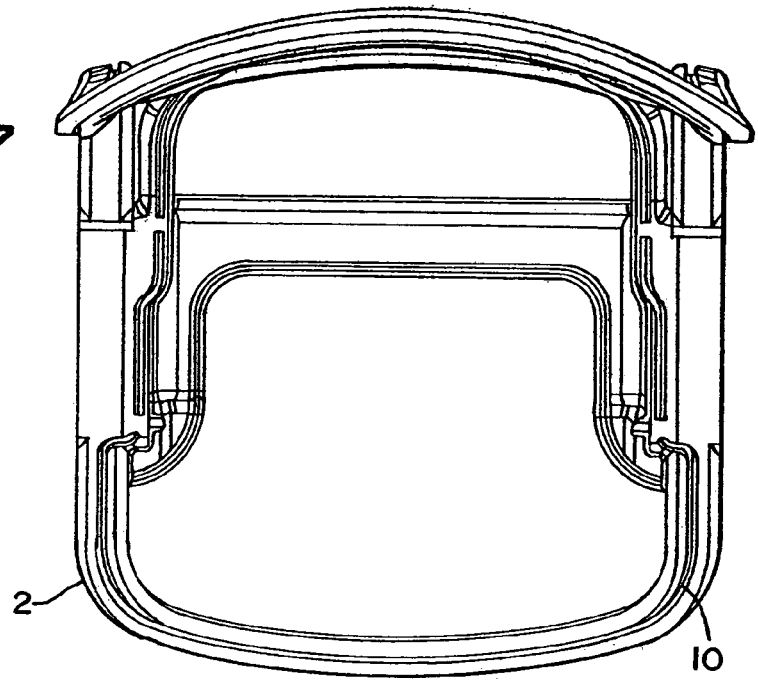
FIG. 7 is a top view of a frame structure configured to support the back support and seat support shown in FIGS. 3-6.
Figure 8:
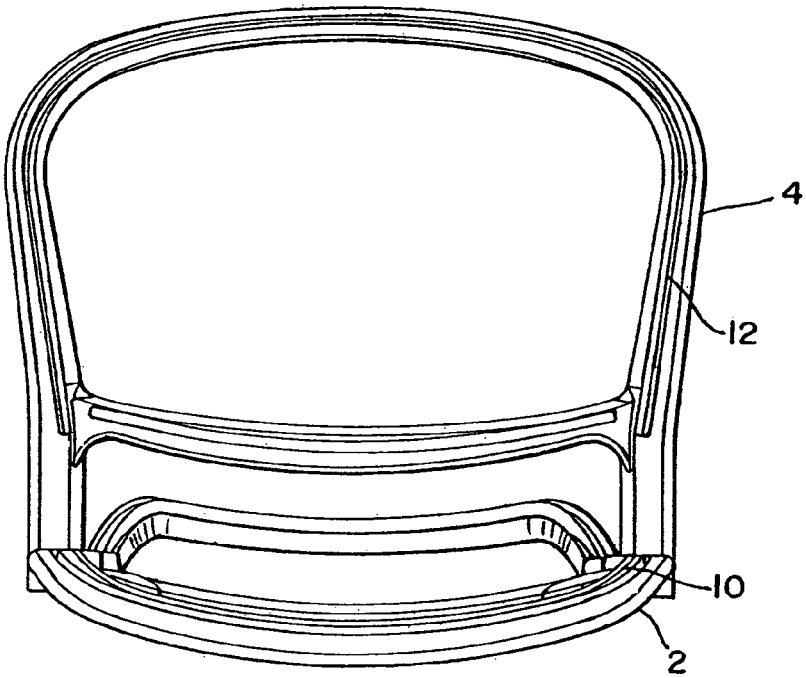
FIG. 8 is a front view of frame structure configured to support the back support and seat support shown in FIGS. 3-6.

Referring to FIGS. 7-9, one embodiment of a seat frame 2 and back frame 4 are shown. The frames 2, 4 are preferably, substantially more rigid than the seat and back seating surfaces or structure formed by the web and boss structures. The frames provide a support structure for the seating surface, and as a means to connect the seating surface to the rest of the chair. In one contemplated embodiment the seating surface is carried within the seating frame by way of mounting grooves 10 and 12.

It should be appreciated that the seating surface and the frame could be formed or manufactured as a single unit, as shown in FIGS. 30-31. However, some advantages may be realized if they are separate. For example, the frame and seating surface can be made of different materials. In this way, each of the materials selected for their respective part may be optimized functionally. Another advantage is that the way in which the two members, the seating surface and its frame, are attached may be varied. Techniques of manufacture and assembly could be used which would allow movement relative to one another. This would give yet more degrees of movement and cushioning to the occupant.

An example of an attachment means is a rubber mount that may take the form of a series of intermediate mounting pads, which occur between the seating surface and its frame. Similarly, the rubber or resilient material could take the form of a gasket occurring between the seat surface and frame. Another way that such movement could be achieved is to produce a groove integral to the seating surface that would follow the same path as the mounting groove. Such a groove could be pleated like the web found in FIG. 14, and thus would allow a degree of lateral movement.

Another method would be to have the seating surface snap into place using tabs and slots that had enough free-play relative to each other to yield desirable results. Either the seating surface or the frame could have the slots and the other the tab members.

Yet another method would be to configure the two elements so that one or the other had standing legs formed predominantly perpendicular to the other element. In this way, when the two are assembled, and allowed to shift relative to each other, the legs flex. This, like the rubber or resilient mounts would allow biased relative movement, which would not feel loose. These tabs or the functionality of them could be combined with the snap tabs, as a matter of fact; any of the methods could be successfully combined.

Additionally, any of these attachment techniques could occur using mounting grooves such as 10 and 12, or could surface mount directly on the surface of the seat/back frames. It is also contemplated that the entire assembly (frames, resilient seating surface inserts, and flex gasketing material) could be manufactured using the advanced multi-material molding techniques (two-shot, co-injection) previously mentioned. This would have the potentially obvious advantages of increased economy, and ease of manufacture, and increased structural integrity.

Another consideration when configuring the way in which the seating surfaces interact with the seating frame is sizing.

As previously mentioned, it can be difficult for a designer to design a chair, or other seating structure, with the proper contours appropriate for the full range of the population. The resulting designs and contours are necessarily compromises, and thus are not optimal for any given individual. As also previously mentioned, in an effort to overcome these limitations, manufacturers have produced "sized" (i.e. small, medium and large) chairs that effectively narrow the amount of contouring-compromise that the designer must normally exercise.

One of skill in the art should understand that there are several aspects to sizing. The first consideration is the overall sizing of the surfaces as far as width, height etc. As far as comfort is concerned, this is the least important aspect of seating surface design. Appropriately sized seating surfaces can be formulated that satisfy the extremes. Of more importance is the contouring that occurs within whatever sized seating surface is chosen. Often, the contouring varies greatly from a small individual, to a large one. Additionally, some individuals who seemingly share the same body types prefer differing contours, for example stronger/weaker lumbar contours. Although the present invention addresses this need for variable contouring through its innovative flexure structure, further advantages in comfort can be realized if the initial contours of the seating structure are in the proper range for the occupant.

Through the unique method of construction disclosed herein, these goals are all achievable. As previously outlined, the seating surfaces can be attached to the seating frame by a variety of methods. Therefore, the manufacturer can produce one basic chair frame(s) and insert many different contoured seating surfaces. Obviously, this has the advantage of eliminating the need of the manufacturer having to tool three independent products instead of one. In addition, because the seating surfaces are so easily attached and detached from their frames, it is conducive to a field-customization. In this way, wholesalers, and retailers could stock frames, and then have a variety of seating surfaces in various contours and colors. This would allow the retailer to customize the product on the spot for the customer. Additionally, the end user is not stuck with a chair that at some point in the future may be the wrong size. The size/color scheme can be updated at any point of the products life by simply obtaining a fresh set of seating surfaces.

Thus, a new and improved method of chair seat and back pan construction, which provides greater comfort through superior surface adjustment for a variety of users, has been provided. Also provided is a new and improved method of chair seat back pan construction that provides greater airflow to contact areas of the occupant's body. Also provided is a new and improved method of chair seat back pan construction that is more efficient and economical to produce.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A seating structure comprising:

a plurality of boss structures arranged in a pattern, wherein each of said boss structures has a body-facing surface, said plurality of boss structures comprising at least some rows of boss structures extending in a first direction and at least some columns of boss structures extending in a second direction, wherein said first and second directions are substantially perpendicular, and wherein at least some adjacent rows of boss structures are offset in said first direction such that said boss structures in said adjacent rows of boss structures define at least in part different columns of boss structures;

a plurality of web structures joining at least some adjacent boss structures within said pattern, wherein at least some of said web structures are non-planar and wherein at least some of said web structures form a hinge structure; and wherein at least some adjacent web structures defining said plurality of web structures are spaced apart such that said spaced apart adjacent web structures define openings therebetween and between adjacent boss structures.

2. The seating structure of claim 1 wherein said boss structures defining each of said rows of boss structures are spaced a maximum first distance in said first direction and wherein said boss structures defining each of said columns of boss structures are spaced a minimum second distance in said second direction, wherein said second distance is greater than said first distance.

3. The seating structure of claim 1 wherein said boss structures in said adjacent rows of boss structures are connected with some of said web structures.

4. The seating structure of claim 3 wherein said boss structures within each row of boss structures are connected with some of said web structures.

5. The seating structure of claim 4 wherein said boss structures within each column of boss structures are not directly connected with any of said web structures.

6. The seating structure of claim 1 wherein said boss structures are substantially circular.

7. The seating structure of claim 1 wherein at least some of said web structures are V-shaped.

8. The seating structure of claim 1 wherein said web structures are spaced apart from said body-facing surface of said boss structures, with said body-facing surface of said boss structures being more proximal to an occupant than said web structures when the occupant is supported by the seating structure.

9. The seating structure of claim 1 further comprising a covering disposed over at least some of said plurality of boss structures and said plurality of web structures.

10. The seating structure of claim 9 wherein said covering comprises a modable material and an outer fabric.

11. The seating structure of claim 10 wherein said covering comprises at least one embossment formed in a body-facing surface of said covering.

12. The seating structure of claim 1 wherein said web structures each have a width, opposite end portions and a middle portion, wherein said widths of at least some of said web structures are greater at said middle portion than at said opposite end portions.

13. The seating structure of claim 1 wherein at least some of said boss structures have at least four web structures connected thereto.

14. The seating structure of claim 13 wherein at least some of said boss structures have at least six web structures connected thereto.

15. The seating structure of claim 1 wherein at least some of said openings are Y-shaped.

16. The seating structure of claim 1 wherein at least some of said boss structures have a width of between about 0.30 inches and about 0.80 inches, wherein at least some of said boss structures are spaced apart between about 0.50 inches and about 0.90 inches, wherein at least some of said web structures have a thickness of between about 0.08 inches and about 0.18 inches, wherein at least some of said web structures have a width of between about 0.06 inches and about 0.50 inches and wherein at least some of said web structures have a depth of between about 0.20 inches and about 0.70 inches.

17. The seating structure of claim 1 wherein said at least some of said web structures forming said hinge structure have a W-shape.

18. A seating structure comprising:

a plurality of boss structures arranged in a pattern, wherein each of said boss structures has a body-facing surface, said plurality of boss structures comprising at least some rows of boss structures extending in a first direction and at least some columns of boss structures extending in a second direction, wherein said first and second directions form a substantially oblique angle;

a plurality of web structures joining at least some adjacent boss structures within said pattern, wherein at least some of said web structures are non-planar and wherein at least some of said web structures form a hinge structure; and wherein at least some adjacent web structures defining said plurality of web structures are spaced apart such that said spaced apart adjacent web structures define openings therebetween and between adjacent boss structures.

19. The seating structure of claim 18 wherein said boss structures within each row of boss structures are connected with some of said web structures, and wherein said boss structures within each column of boss structures are connected with some of said web structures.

20. The seating structure of claim 19 wherein said boss structures in said adjacent rows of boss structures are connected with some of said web structures, and wherein said boss structures in said adjacent columns of boss structures are connected with some of said web structures.

21. The seating structure of claim 18 wherein at least some adjacent rows of boss structures are offset in said first direction and wherein at least some adjacent columns of boss structures are offset in said second direction, wherein said boss structures in said adjacent rows of boss structures define at least in part said columns of boss structures.

22. The seating structure of claim 18 wherein at least some of said boss structures within each of said rows are spaced a first distance and wherein at least some of said boss structures within each of said columns are spaced a second distance, wherein said first distance is substantially equal to said second distance.

23. The seating structure of claim 18 wherein said web structures are spaced apart from said body-facing surface of said boss structures, with said body-facing surface of said boss structures being more proximal to an occupant than said web structures when the occupant is supported by the seating structure.

24. The seating structure of claim 18 wherein said web structures each have a width, opposite end portions and a middle portion, wherein said widths of at least some of said web structures are greater at said middle portion than at said opposite end portions.

25. The seating structure of claim 18 wherein at least some of said boss structures have at least six web structures connected thereto.

26. The seating structure of claim 18 wherein said at least some of said web structures forming said hinge structure have a V-shape.

27. The seating structure of claim 18 wherein said at least some of said web structures forming said hinge structure have a W-shape.

28. A seating structure comprising:

a plurality of boss structures arranged in a pattern, wherein each of said boss structures has a body-facing surface;

a plurality of web structures joining at least some adjacent boss structures within said pattern, wherein at least some of said boss structures have at least six web structures connected thereto, wherein at least some of said web structures are non-planar and wherein at least some of said web structures form a hinge structure; and wherein at least some adjacent web structures defining said plurality of web structures are spaced apart such that said spaced apart adjacent web structures define openings therebetween and between adjacent boss structures.

29. The seating structure of claim 28 wherein said at least some of said web structures forming said hinge structure have a V-shape.

30. The seating structure of claim 28 wherein said at least some of said web structures forming said hinge structure have a W-shape.

* * * * *